US005357317A

United States Patent [19]

Fukuchi et al.

[11] Patent Number: 5,357,317

[45] Date of Patent: Oct. 18, 1994

[54] ELECTROSTATIC RECORDING APPARATUS USING VARIABLE BIAS DEVELOPING VOLTAGE

[75] Inventors: Masakazu Fukuchi; Shizuo Morita; Shizuo Kayano; Kunihisa Yoshino, all of Hachioji, Japan

[73] Assignee: Konica Corporation, Tokyo, Japan

[21] Appl. No.: 25,641

[22] Filed: Mar. 2, 1993

[30] Foreign Application Priority Data

| | | | |
|---|---|---|---|
| Mar. 10, 1992 | [JP] | Japan | 4-087667 |
| Apr. 9, 1992 | [JP] | Japan | 4-116973 |
| Apr. 14, 1992 | [JP] | Japan | 4-121436 |
| Apr. 14, 1992 | [JP] | Japan | 4-121437 |
| Apr. 16, 1992 | [JP] | Japan | 4-122636 |

[51] Int. Cl.[5] ..... G03G 21/00

[52] U.S. Cl. ..... 355/208; 355/246; 355/326 R

[58] Field of Search ..... 355/203, 204, 208, 214, 355/246, 266, 326 R, 327; 118/645; 346/108, 157, 153.1; 358/80, 296, 300

[56] References Cited

U.S. PATENT DOCUMENTS

| | | | |
|---|---|---|---|
| 5,146,240 | 8/1992 | Hayashi et al. | 346/108 |
| 5,182,575 | 1/1993 | Kato et al. | 346/108 |
| 5,196,886 | 3/1993 | Nakane et al. | 355/246 |
| 5,206,686 | 4/1993 | Fukui et al. | 355/208 |
| 5,227,842 | 7/1993 | Hayashi et al. | 355/208 |
| 5,237,369 | 8/1993 | Maruta et al. | 355/208 |

FOREIGN PATENT DOCUMENTS 57-136669 8/1982 Japan .

*Primary Examiner*—A. T. Grimley
*Assistant Examiner*—William J. Royer
*Attorney, Agent, or Firm*—Frishauf, Holtz, Goodman & Woodward

[57] ABSTRACT

An image forming machine, such as a printer or a copying machine for forming a toner image on a photoreceptor includes an image writer, such as a laser beam generator, for forming a latent image on the photoreceptor; a developer for developing the latent image with a developer, which includes a toner and a carrier; a controller for controlling a toner concentration of the developer so that the toner concentration is equalized; a circuit to automatically form a reference toner image on the photoreceptor; a detector for detecting a toner deposition amount of the reference toner image; and a controller circuit for decreasing a toner charge amount of the toner when the toner concentration is equalized and the toner deposition amount of the reference toner image is smaller than a predetermined value.

6 Claims, 27 Drawing Sheets

C

M

Y

B

G

R

BK

C

M

Y

B

G

R

M

B

R

M

B

R

BK

BK

BK

C

M

Y

B

G

R

BK

ELECTROSTATIC RECORDING APPARATUS USING VARIABLE BIAS DEVELOPING VOLTAGE

BACKGROUND OF THE INVENTION

The present invention relates to an image recording apparatus by which an electrostatic latent image is developed with a 2-component developer composed of toner and carrier, and more particularly relates to an electrostatic recording method by which the electrical charge given to the toner is controlled so as to provide an appropriate image density.

In a developing device by which an electrostatic latent image on an image carrier such as a photoreceptor drum is visualized with 2-component developer composed of toner and carrier, the mixing ratio by weight of toner to carrier in the 2-component developer, which will be referred to as toner concentration $T_c$ hereinafter, has great influence on the developing property. For example, in the case where toner concentration of 2-component developer is lower than an appropriate value, the image density obtained by development is lowered. On the contrary, in the case where toner concentration is excessively high, the image density obtained by development is increased too high, so that fogging is caused on the image. As a result of the foregoing, an appropriate recorded image can not be provided on a transfer sheet when the developed image is transferred onto the surface of the transfer sheet.

Accordingly, in order to always provide an image of desirable density, it is necessary to set the toner concentration of 2-component developer to an appropriate level and to maintain it. Conventionally, a toner concentration control system for 2-component developer has been proposed in which the toner concentration of 2-component developer is maintained constant by controlling the amount of supplied toner. The aforementioned toner concentration control system is operated in the following manner: when changes are detected, such as changes in permeability of 2-component developer, volume of the developer, image density after development, and color of the 2-component developer, toner concentration is detected; and according to the detected toner concentration, an amount of toner to be supplied is controlled so that the toner concentration can be maintained on an appropriate level.

However, in the aforementioned toner concentration detecting system in which changes are detected, it is difficult to carry out the detecting operation stably over a long period of time because it is difficult to prevent misdetection and also it is difficult to compensate for the deterioration of the photoreceptor surface that progresses with age.

A method to solve the problem is disclosed in Japanese Patent Publication Open to Public Inspection No. 136669/1982 "Concentration Control Device for 2-component Developer". This concentration control device for 2-component developer is composed as follows:

In order to stably maintain the developing performance of an image recording apparatus over a long period of time, a plurality of detection levels to detect the volume of 2-component developer in the developing unit are provided. In order to detect the developing performance, the density of a developed image or that of an image formed on the photoreceptor surface from a reference image is optically detected. According to the detected image density, the plurality of detecting levels are changed over by a central computing unit so that the toner concentration of 2-component developer can be controlled in order to maintain the developing performance as stably as possible.

The object has been generally accomplished by the aforementioned apparatus.

However, the blackening ratio of a document to be recorded fluctuates due to the difference in image density. Accordingly, in the case where documents of a low blackening ratio such as a line image or a character image are continuously developed so as to form images, a predetermined image density corresponding to the toner concentration can not be provided although the toner concentration is maintained constant, so that the relation between toner concentration and image density can not be maintained. It has been found that the aforementioned phenomenon tends to occur in an electrostatic color recording apparatus by which color images can be reproduced with 2-component developer of various colors.

The inventors have investigated the cause of the aforementioned problem, and obtained the following knowledge.

The inventors have analyzed the aforementioned phenomenon that will become a problem in the image recording operation. As a result of the investigation, they have found that: a developing sleeve and a stirring means are continuously rotated in the developing unit during the image forming process conducted by the electrostatic recording apparatus; and the aforementioned problem relates to the stirring time in the developing unit, that is, the problem relates to the 2-component developer remaining time in which the 2-component developer remains in the toner hopper (hereinafter, called the toner remaining time). In the case of a document of low density, the toner consumption per unit time is small compared with that of a usual case. Accordingly, the toner remaining time is increased. In the case where a difference is caused in the toner consumption of 2-component developer of each color, the toner remaining time is different at each color.

The aforementioned phenomenon occurs even when the toner concentration is constant. Therefore, it can be guessed that the aforementioned phenomenon is not caused by a condition of "spent-toner" in which toner particles are deposited around carrier particles so that the toner charge amount is reduced. It can be considered that: since the aforementioned phenomenon relates to the toner remaining time, toner and carrier particles rub each other over a long period of time when the toner remaining time becomes longer so that the toner charge amount is increased; and when the toner charge amount is increased beyond a predetermined range, it affects image density. Therefore, an investigation has been made to find the relation between the toner charge amount and the image density.

FIG. 20 is a graph showing the change of image density CD with respect to the change of toner charge amount Q/m ($\mu$C/g) in the case where the toner concentration in 2-component developer is constant.

The graph in FIG. 20 shows that image density CD is lowered as toner charge amount Q/m is increased. Specifically, when toner charge amount Q/m is 10 ($\mu$C/g), image density CD is 1.4. When toner charge amount Q/m is 20 ($\mu$c/g), image density CD is 1.0. When toner charge amount Q/m is 30 ($\mu$C/g), image density CD is 0.5.

Specific numerals showing the relation between the image density CD and toner charge amount Q/m are different according to the specific conditions such as the developer to be used. In general, the relation can be determined by a force (referred to as developing force, hereinafter) applied to toner in a developing region, the toner being contained in 2-component developer magnetically carried by a developing sleeve in which a permanent magnet is provided.

When developing force is represented by $F_t$, it can be expressed by the following equation.

$$F_t = q_t E - k(q_t q_c / r^2) - q_t(V_B/R) \quad (1)$$

where $q_t$ is a toner charge amount, E is an electrical field caused by an electrostatic latent image (referred to as a latent image electrical field), $q_c$ is a carrier charge amount, r is a distance between toner and carrier, $V_B$ is a voltage impressed upon the developing sleeve (referred to as developing bias), and R is a distance between the surface of the photoreceptor and that of the developing sleeve.

Equation 1 shows that developing force $F_t$ can be obtained when an adhesion force (referred to as Coulomb force) caused between toner and carrier, and a developing bias force applied to toner are subtracted from a force caused by latent image electric field E.

It should be noted here that: a force to determine developing force $F_t$ is proportional to toner charge amount $q_t$ (Q/m); and Coulomb force that decreases developing force $F_t$ tends to increase more than other forces because carrier charge amount $q_c$ is increased as toner charge amount $q_t$ (Q/m) is increased. Consequently, when toner charge amount $q_t$ (Q/m) is increased, developing force $F_t$ is lowered, and when toner charge amount $q_t$ (Q/m) is decreased, developing force $F_t$ is increased .

FIG. 21 is a graph showing the change of image density CD with respect to the toner concentration (wt %) in 2-component developer loaded in the developing unit.

In this case, the 2-component developer includes nonconductive magnetic carrier (coated with resin, and a magnetic particle resin dispersion type), the average particle size of which is 20 to 100 μm, and toner, the average particle size of which is 5 to 15 μm.

In FIG. 21, solid line A shows a case in which developing bias $V_B$ is 200 V. As shown by solid line A, when toner concentration is 1 wt %, image density CD is about 0.4, and when toner concentration is 5 wt %, image density CD is about 1.0, and when toner concentration exceeds 5 wt %, image density CD is saturated at about 1.2. According to this solid line A, image density CD varies from about 0.4 to 1.2 so that the contrast is sufficiently wide, and the adhesion force between toner and the photoreceptor drum is sufficient, and further an amount of image shift is small during the process of image formation . Therefore, it is preferable that image density CD is controlled in accordance with solid line A.

In FIG. 21, one-dotted chain line B represents a relation between toner concentration $T_c$ (wt %) and image density CD in the case where 2-component developer has been stirred over a long period of time so that toner charge amount $q_t$ (Q/m) is increased too much compared with the case shown by solid line A. In this case, other conditions such as developing bias $V_B$ are the same as those of solid line A. As can be seen from expression (1), since Coulomb force is increased compared with other electrostatic forces, the attraction force to attract the toner to the photoreceptor drum is relatively lowered and the image density is decreased. Specifically, it is shown that one-dotted chain line B is saturated at a point where toner concentration is 5 wt % and the image density is 0.5. Consequently, sufficient image density CD corresponding to the document density on line B can not provided, and sufficient contrast can not be provided, either.

Dotted line C represents a relation between toner concentration $T_c$ (wt %) and image density CD in the case where the toner charge amount is reduced compared with solid line A due to environmental fluctuation such as an increase in relative humidity. In this case, it is shown that the adhesion force (Coulomb force) between toner and carrier is not sufficient, so that image density CD is increased compared with a case shown by solid line A. Specifically, image density CD reaches 0.7 when the toner concentration is about 1 wt %, and as the toner concentration (wt %) is increased, it is saturated at about 1.4. Therefore, in the case of development carried out on dotted line C, sufficient contrast width can be provided, however, a large amount of toner is scattered, so that too much toner is deposited on the latent image, which can not be put into practical use from the viewpoint of faithful reproduction of a document image. Further, since the adhesion force between the photoreceptor drum and toner is not sufficiently high, image shift tends to occur.

Further, problems caused when a color image is recorded are stated as follows.

FIG. 34(*a*) is a graph showing the amount of consumed toner with respect to the number of copies in a color image forming apparatus by which color images are recorded with 2-component developer of a plurality of colors. FIG. 34(*b*) is a graph showing the toner charge amount of each color corresponding to the number of copies in a color image forming apparatus. FIG. 34(c) is a graph showing optical image density (CD) corresponding to the number of copies in a color image forming apparatus.

In this case, optical image density CD is defined as image density corresponding to reflected light sent from a reference toner image formed in the following manner: an optical scanning system irradiates the surface of a photoreceptor drum with exposure light in accordance with an image signal corresponding to reflected light sent from a reference density plate; and the exposed portion is developed under a predetermined electrostatic process condition to obtain the reference toner image.

FIG. 34(*a*) shows an example in which a color document is copied. Solid line BK shows an amount of consumed toner corresponding to the number of copies of black toner. Specifically, the following amount of toner is consumed: in the case of A4-size paper, the average toner consumption is 80 mg/sheet, so that 240 g of toner is consumed to copy 3000 sheets. Solid line Y shows an amount of yellow toner consumption corresponding to the number of copies. Specifically, the average toner consumption is 50 mg/sheet, so that 150 g of toner is consumed to copy 3000 sheets. Solid line C shows an amount of cyan toner consumption corresponding to the number of copies. Specifically, the average toner consumption is 50 mg/sheet, so that 150 g of toner is consumed to copy 3000 sheets. Solid line M shows an amount of magenta toner consumption corresponding to the number of copies. Specifically, the average toner consumption is 10 mg/sheet, so that 30 g of toner is consumed to copy 3000 sheets. The graph in FIG. 34(*a*) shows that the amounts of consumed toner are different according to the color of developer.

An ideal case is explained above in which the developing property of each color is not changed even after 3000 copies have been made.

However, in a common image recording apparatus, the developing sleeve and the stirring means provided in the developing unit are continuously rotated during developing in the image forming process in order to simplify the control of the apparatus. Accordingly, toner remains in the developing unit over a long period of time, so that the toner charge amount of each color is varied. An example in which the toner charge amount is changed will be explained as follows.

In FIG. 34(*b*), solid line BK shows a change of black toner charge amount Q/m with respect to the number of copies. As can be seen from the graph, the toner charge amount is approximately constant irrespective of the increase in the number of copies. The reason why the toner charge amount is approximately constant, is as follows: since toner concentration is controlled, a necessary amount of toner is successively supplied in accordance with the amount of consumed toner, so that a small amount of toner remains in the developing unit over a long period of time.

Solid line Y shows a change of yellow toner charge amount Q/m with respect to the number of copies. Solid line C shows a change of cyan toner charge amount Q/m with respect to the number of copies. According to solid lines Y and C, it can be seen that the toner charge amount is slightly increased as the increase in the number of copies. The reason why the toner charge amount is slightly increased, is presumably as follows: since toner concentration is controlled, a necessary amount of toner is successively supplied in accordance with the amount of consumed toner, however, a very small amount of toner remains in the developing unit over a long period of time exceeding an allowable range.

Solid line M shows a change of magenta toner charge amount Q/m with respect to the number of copies. Compared to solid line M, lit can be seen that the magenta toner charge amount is extremely increased in accordance with the increase in the number of copies. The reason why the toner charge amount is extremely increased is presumably as follows: since toner concentration is controlled, a necessary amount of toner is successively supplied in accordance with the amount of consumed toner, however, a large amount of toner remains in the developing unit over a long period of time exceeding an allowable range.

When new developer of each color is provided into the developing unit, a difference of the toner charge amount between developers is small so that the difference does not affect the developing properties. However, as the number of copies is increased, a difference is caused between the amounts of consumed toner. Therefore, amounts of toner remaining in the developing unit over a long period of time are different, so that a difference is caused between the toner charge amounts, and as a result, a difference is caused between the developing properties of toners.

Since the difference is caused between the charge amounts of toners, the following phenomena occur. In FIG. 34(*c*), solid line BK represents a change of optical image density (CD) of black toner corresponding to the number of copies. As shown in the graph, optical image density (CD) of black approximately constant irrespective of the increase in the number of copies. That is, the developing property is approximately constant. Solid line Y shows a change of optical image density (CD) with respect to the number of copies. Solid line C shows a change of optical toner density (CD) with respect to the number of copies. According to solid lines Y and C, it can be seen that optical image density (CD) is slightly increased with the increase in the number of copies, which shows that the developing properties of yellow and cyan toners are a little lowered. Solid line M shows a change of optical image density with respect to the number of copies. Compared to solid line M, it can be seen that optical image density (CD) is extremely increased in accordance with the increase in the number of copies, which shows that the developing properties of magenta toner is extremely lowered.

As described above, in case of an image forming apparatus in which the developer is continuously stirred in the developing unit, amounts of consumed developers are different, so that the remaining time of each developer is different. As a result, the stirring time of each developer is different. Therefore, the developing properties are affected. Consequently, the following problems are caused: When an image of a single color is reproduced, the image density is lowered. In the case of a color copying operation, a predetermined amount of each toner is not provided for development, so that the colors of an image become ill-balanced.

SUMMARY OF THE INVENTION

The present invention has been achieved in order to solve the aforementioned problems, and the first object of the present invention is to provide an electrostatic recording method characterized in that: in the case where image density is lowered even though the toner concentration is maintained approximately at a predetermined value, the lowered image density is detected and the toner charge amount is controlled to a predetermined value so that an appropriate image density can be provided in the image reproduction process.

In order to accomplish the aforementioned first object, the first example of the electrostatic recording method of the present invention is composed in the following manner: In an electrostatic recording method in which an electrostatic latent image on a photoreceptor is developed with 2-component developer including carrier and toner so as to form a toner image, in the case where the toner concentration of the 2-component developer is approximately constant and the toner deposition amount of a reference toner image developed by the aforementioned toner on the photoreceptor is smaller than a predetermined value, a member, having the same polarity on the triboelectric electrification scale as that of the toner, and the triboelectric charge amount of which is larger than that of the toner, is rubbed with the 2-component developer, or fine particles disposed on the opposite polarity on the triboelectric electrification scale to that of the toner are added to the 2-component developer, so that the toner charge amount of the 2-component developer is reduced, and after that the toner image is formed.

By the above mentioned operation, the toner charge amount is decreased, and the toner deposition amount of the toner image developed on the photoreceptor drum is increased, so that the decrease in image density can be prevented.

The present invention solves the aforementioned problems, and the second object of the present invention is to provide an image recording apparatus characterized in that: in the case where image density is lowered or raised even though the toner concentration is maintained approximately at a predetermined value, the lowered or raised image density is detected and the electrostatic process condition is controlled to a predetermined value so that an appropriate image density can be provided in the image reproduction process.

In order to accomplish the second object, the second example of the present invention is to provide an image recording apparatus including: a charging means to uniformly charge a photoreceptor; an image exposure means to form an electrostatic latent image on the photoreceptor uniformly charged by the charging means when the photoreceptor is irradiated with an optical signal having image information; a developing means to develop the electrostatic latent image on the photoreceptor with 2-component developer including carrier and toner; a toner concentration detecting means to detect the concentration of toner in the 2-component developer; a toner supply control means to control toner supply in accordance with the toner concentration detected by the toner concentration detecting means; a reflected density detection means to detect the reflected density of a reference toner image formed on the photoreceptor; and an electrostatic latent image potential range control means operated in the following manner. The electrostatic latent image potential range control means is operated as follows: when the reflected density of the reference toner image detected by the reflected density detection means is lower or higher than a predetermined level, and also when the toner concentration detected by the toner concentration detecting means is substantially constant, the charging means and the image exposure means are controlled so that the potential range of the electrostatic latent image on the photoreceptor can be changed; and then, at a point of time when the reflected density of the reference toner image has returned to a predetermined level, the aforementioned potential range is returned to a predetermined value.

The charging means uniformly charges the photoreceptor. The image exposure means irradiates the surface of the photoreceptor uniformly charged by the charging means, with an optical signal containing image information. The 2-component developing means develops an electrostatic latent image formed on the photoreceptor by the image exposure means, with 2-component developer. The toner concentration means detects the concentration of toner in the 2-component developer. The toner supply control means controls the supply of toner in accordance with the toner concentration detected by the toner concentration detecting means. The reflected density detection means detects the reflected density of the reference toner image formed on the photoreceptor.

The electrostatic latent image potential range control means is operated in the following manner:

In the case where the reflected density of the reference toner image detected by the reflected density detecting means, that is, the actual image density is lower or higher than a predetermined level although the toner concentration detected by the toner concentration detecting means is substantially constant, the charging means and the image exposure means are controlled so as to change the potential range of the electrostatic latent image on the photoreceptor so that the image density can be returned to a predetermined level; and after that, the potential range of the electrostatic latent image is returned to a predetermined value.

The third example of the present invention solves the aforementioned problems, and the object of the third example is the same as that of the first and second examples, that is the object of the third example is to provide an image recording apparatus in which: in the case where image density is lowered or raised even though the toner concentration is maintained approximately at a predetermined value, the lowered or raised image density is detected and the developing condition is controlled to a predetermined value so that an appropriate image density can be provided in the image reproduction process.

The image recording apparatus of the third example of the present invention includes: a 2-component developing means to develop an electrostatic latent image on the photoreceptor with 2-component developer including carrier and toner; a toner concentration detecting means to detect the concentration of toner in the 2-component developer; a toner supply control means to control toner supply in accordance with the toner concentration detected by the toner concentration detecting means; a reflected density detecting means to detect the reflected density of a reference toner image formed on the photoreceptor; and a developing bias control means operated in the following manner. That is, when the reflected density of the reference toner image detected by the reflected density detection means is lower or higher than a predetermined level, also when the toner concentration detected by the toner concentration detecting means is substantially constant, the developing bias is changed; and then, at a point of time when the reflected density of the reference toner image has returned to a predetermined level, the developing bias is returned to a predetermined value.

The 2-component developing means develops an electrostatic latent image on the photoreceptor upon which the developing bias is impressed, with 2-component developer including carrier and toner. The toner concentration detecting means detects the concentration of toner in the 2-component developer. The toner supply control means conducts control of the toner supply in accordance with the toner concentration detected by the toner concentration detecting means. The reflected density detecting means detects the reflected density of the reference toner image formed on the photoreceptor.

The developing bias control means is operated in the following manner:

In the case where the reflected density of the reference toner image detected by the reflected density detecting means, that is, the actual image density is lower or higher than a predetermined level although the toner concentration detected by the toner concentration detecting means is substantially constant, the developing bias is changed so that the image density can be returned to a predetermined level; and after that, the developing bias is returned to a predetermined value.

The fourth example of the present invention has been achieved in view of the aforementioned problems with respect to the reproduction of color images. The object of a fourth example of the present invention is to provide a color image forming apparatus in which: in the case where image density is lowered or increased among developers of various colors although the toner concentration is maintained approximately constant, the image density unbalance is detected and the electrostatic process conditions are controlled, so that the image density can be maintained to be appropriate and the reproduced colors are well-balanced.

In order to accomplish the aforementioned object, the fourth example of the present invention is a color image forming apparatus that forms a color toner image on a photoreceptor with plural 2-component developing means, the color image forming apparatus including: a charging means to uniformly charge the photoreceptor; an image exposure means to irradiate the photoreceptor uniformly charged by the charging means with an optical signal containing color image information; a plurality of 2-component developing means provided corresponding to a plurality of colors so as to develop an electrostatic latent image formed on the photoreceptor by the image exposure means, each 2-component developing means including a bias means; a toner concentration detecting means to individually detect the concentration of toner in the 2-component developer of each color; a toner supply control means to control the supply of toner for each color in accordance with toner concentration detected by the toner concentration detecting means; a toner deposition amount detecting means to detect the deposition amount of toner of each color when reference toner images of the plurality of colors are formed on the photoreceptor; and a toner deposition amount control means that increases a developing potential gap in the case of 2-component development in accordance with the decrease in toner deposition amount by controlling the charging and developing bias means with respect to a color, the toner deposition amount on the reference toner image of which is lowered to be smaller than a predetermined value, and the toner concentration of which is substantially constant, wherein the toner deposition amount is detected by the toner deposition amount detecting means, and the toner concentration is detected by the toner concentration detecting means.

The charging means uniformly charges the photoreceptor. The image exposure means irradiates the photoreceptor surface with an optical signal including color image information so as to form an electrostatic latent image on the photoreceptor uniformly charged by the charging means. The plurality of 2-component developing means are provided corresponding to predetermined colors. Each 2-component developing means includes a developing bias means, and develops an electrostatic latent image formed on the photoreceptor by the image exposure means, with 2-component developer of each color, so that toner images of a plurality of colors are superimposed on the photoreceptor.

The toner concentration detecting means detects the concentration of toner in the 2-component developer of each color. The toner supply control means controls the supply of toner of each color in accordance with the toner concentration detected by the toner concentration detecting means. The toner deposition amount detection means individually forms reference toner images of a plurality of colors on the photoreceptor, and detects the toner deposition amount of each color.

The toner deposition amount control means appropriately recovers the developing properties in the following manner: with respect to a color, the reference image toner deposition amount of which is lower than a predetermined value although the toner concentration detected by the toner concentration detecting means is substantially constant, that is, with respect to a color, the developing property of which is deteriorated, the charging means and the developing bias means are controlled so that the developing potential gap in the case of 2-component development can be increased in accordance with the degree of decrease in the toner deposition amount.

In order to solve the problems with respect to reproduction of color images, the fifth example of the present invention is to provide a color image forming method by which an electrostatic latent image is formed on a uniformly changed photoreceptor by means of dot type image exposure and the formed electrostatic latent image is developed with 2-component developer of each color so as to form a color toner image including a plurality of colors, the color image forming method in which: with respect to a color, the toner deposition amount of which is lower than a predetermined value in the case where the electrostatic latent image of reference density is developed with 2-component developer although the toner concentration is substantially constant, a dot size is extended in the case of dot exposure of the electrostatic latent image to be developed by 2-component developer.

The photoreceptor is uniformly charged, and an electrostatic latent image is formed on the photoreceptor when image exposure is carried out. This electrostatic latent image is developed with 2-component developer for each color, so that a color toner image of a plurality of colors is formed.

In this case, with respect to a color, the toner deposition amount of which is lower than a predetermined value in the case where the electrostatic latent image of reference density is developed with 2-component developer although the toner concentration is substantially constant, that is, with respect to a color, the developing property of which has been deteriorated, a dot size is extended in the case of dot exposure of the electrostatic latent image to be developed by 2-component developer. In the aforementioned manner, the developing potential gap in the case of development conducted by 2-component developer can be increased so that the developing property can be appropriately recovered.

BRIEF DESCRIPTION OF THE DRAWINGS

FIGS. 26(*d*), 26(*e*), 26(*f*) and 26(*g*) respectively represent a sectional view of a toner image reproducing blue (FIG. 26(*d*)), green (FIG. 26(*e*)), red (FIG. 26(*f*)), and black (FIG. 26(*g*)).

FIGS. 27(*d*), 27(*e*) and 27(*f*) illustrate blue, green and red respectively wherein a toner deposit on a cyan toner layer would be sufficient but would not be sufficient on a magenta toner layer.

FIG. 34(*b*) is a graph showing a relation between the number of copies and the toner charge amount of each color used for color image formation; and FIG. 34(*c*) is a graph showing a relation between the number of copies and image density of each color used for color image formation.

DETAILED DESCRIPTION OF TEE INVENTION

With reference to the attached drawings, the first example of the present invention will be explained as follows.

Figure 1:
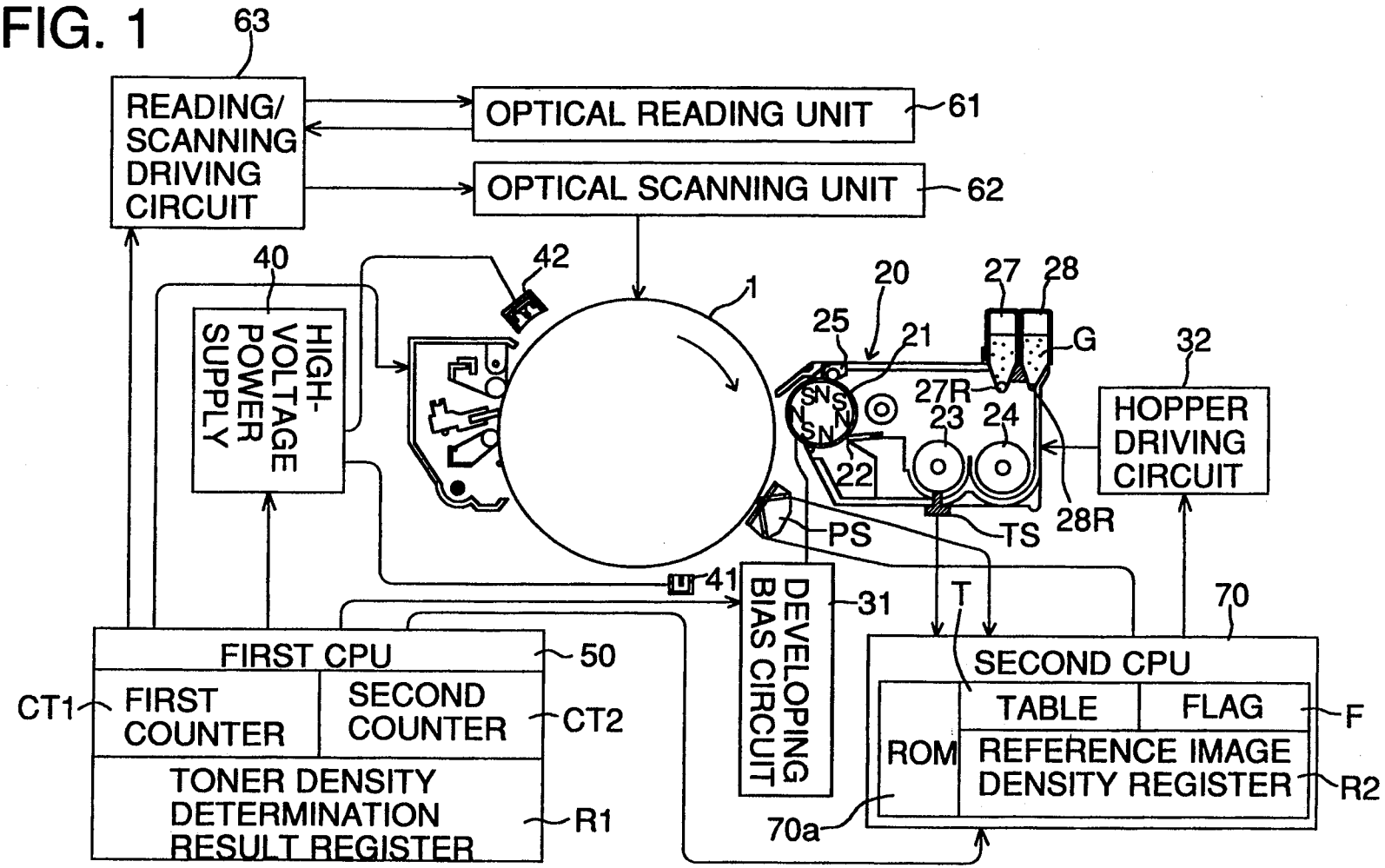
FIG. 1 is a block diagram of an image recording apparatus to which the electrostatic recording method of the first example of the present invention is applied.

FIG. 1 is a block diagram of an image recording apparatus to which the electrostatic recording method of the first example of the present invention is applied. The image recording apparatus 100 includes the photoreceptor drum 1, developing unit 20, developing bias circuit 31, hopper circuit 32, toner concentration detecting means TS, high voltage power supply circuit 40, transfer unit 41, charger 42, first CPU50, reading optical unit 61, scanning optical unit 62, reading and scanning optical drive 63, second CPU70, and optical density measuring means PS . When a copy button not shown is pressed, copy operations are carried out in the following manner: in accordance with a timing signal sent from the first CPU50, the scanning optical system 62 emits light in accordance with an image signal corresponding to the density of a document image; the photoreceptor drum 1 is irradiated with the light so that an electrostatic latent image is formed on the surface of the photoreceptor drum 1; the formed electrostatic latent image is developed with the developing unit 20 so that a toner image is formed; and when the transfer unit 41 is driven in accordance with a registration signal, the toner image is transferred onto a transfer paper. After that, the transferred image is fixed.

The photoreceptor drum 1 is composed in the following manner: a conductive drum-shaped support made of aluminum, the diameter of which is 80 mm, is used for the photoreceptor drum 1; an intermediate layer made of ethylene vinyl acetate, the thickness of which is 0.1 μm, is provided around the support; and a photosensitive layer, the thickness of which is 35 μm, is provided on the intermediate layer so as to be formed into an OPC photoreceptor. Accordingly, when the photoreceptor drum 1 is irradiated with light, its surface potential is lowered. Consequently, when the photoreceptor drum 1 is irradiated with light in accordance with the density of a document image after it has been uniformly charged with a predetermined potential, the surface potential of the photoreceptor drum 1 becomes nonuniform, so that a portion of low potential can be formed on the photoreceptor drum 1. This portion is referred to as an electrostatic latent image. The photoreceptor drum 1 is not limited to the specific example, for example, a photoreceptor made of amorphous silicon or TeSe may be applied. The configuration of the photoreceptor is not limited to a drum-shape, but a belt-shaped photoreceptor may be applied. In this specification, an OPC photoreceptor is taken for an example.

The developing unit 20 comprises: the developing sleeve 21 in which a magnet roller having N and S poles is provided; the scraper 22 that scrapes off the developer from the developing sleeve 21; and the first and second screw-shaped stirring rollers 23, 24; in which the developing sleeve 21, the scraper 22, and the first and second stirring rollers 23, 24 are disposed in the developing tank composed of lower and upper casings. The thin layer forming means 25 is disposed above the developing sleeve 21. The developing unit 20 is provided with the toner hopper 27 to supply new toner into the developing tank, and also provided with the additive hopper 28. The toner supply roller 27R is disposed in the lower opening portion of the toner hopper 27, and the additive adding roller 28R is disposed in the lower opening portion of the additive hopper 28.

The first stirring roller 23 is structured so that the developer can be conveyed to the viewer's side in the drawing, and the second stirring roller 24 is structured so that the developer can be conveyed to the side opposite to the viewer's side. In the developing unit 20, a partition is provided between the first and second rollers 23 and 24, so that the 2-component developer can be circulated smoothly and the 2-component developer can not be held in one position.

The scraper 22 comes into pressure contact with the sleeve 21, so that the 2-component developer, in which the toner has been consumed when it passes through the developing region, is scraped off from the sleeve 21. As a result of the foregoing, the 2-component developer conveyed to the developing region can be replaced. Accordingly, the developing conditions can be stabilized.

The developing sleeve 21 is connected with the developing bias circuit 31 through a protective resistance so that a voltage including DC and AC bias components can be impressed upon the developing sleeve 21 in order to prevent the occurrence of fogging.

The developing bias circuit 31 includes: an AC power supply that impresses an AC bias and a high voltage DC power supply that impresses a DC bias so as to alternate the toner between the sleeve and the photoreceptor drum 1 in the developing region.

The hopper drive circuit 32 is a circuit to drive the toner supply roller 27R and the additive addition roller 28R according to a supply signal sent from the second CPU70. Due to the action of the hopper drive circuit 32, toner is supplied to the developing unit 20, and additive G is added to the 2-component developer in the developing unit 20.

In this case, additive G is a toner charge amount control agent to control the toner charge amount. Additive G is composed of fine particles on the opposite side to the toner particles on the triboelectric electrification scale, for example, particles of titanium oxide $TiO_2$ are used for additive G. Other examples used for additive G are as follows: metals such as gold and copper; semiconductive material such as silicon, germanium and carbon black; conductive metallic oxide such as magnetite, reduced titanium oxide, doped antimony oxide, tin oxide, yttrium oxide and reduced zirconium oxide; a conductive organic polymer such as reduced polyacetylene; and a semimetal such as carbon. Examples preferably used for this example of the invention are Regal 330, carbon black, Reven 420 carbon black, Reven 420 carbon black, and a solid solution (ZYP powder) of yttrium oxide and zirconium oxide. These materials can be positively charged with respect to styrene and vinyl chloride resin. In general, arbitrary materials capable of forming fine particles, the diameter of which is not more than about 1 μ, can be applied.

Another example is silica particles treated by hexamethyl disilazanyl in order to improve the fluidity. Organic complex containing chromium can be applied to not only black toner but also yellow, magenta and cyan toners.

In the case where one of the aforementioned additives G is added to the 2-component developer, a relatively small number of particles are required. When the particles of additive G are deposited on or contacted with the toner particles in the 2-component developer in the stirring process carried out by the first stirring roller 23 or the second stirring roller 24, the toner charge amount can be controlled. Preferably, additive G is added in the following manner: for example, additive G, the amount of which is 0.1 to 10% of the entire toner in the 2-component developer provided in the developing unit 20, is added each time . More preferably, additive G is added in the following manner: additive G, the amount of which is 0.5% of the entire toner in the 2-component developer, is added each time.

It should be understood that the toner charge amount control agent is not limited to additive G. Other toner charge amount control agents will be described later.

Toner concentration detection means TS detects the toner concentration by detecting a change in magnetic permeability of the 2-component developer provided in the developing unit 20. Toner concentration detection means TS is not limited to the specific example but other means can be applied. For example, the toner concentration can be detected when the volume level of the 2-component developer in the developing unit 20 is detected. For the convenience of explanation, the toner concentration detecting means, in which magnetic permeability is used, is applied here. The high voltage power supply circuit 40 impresses a predetermined high voltage upon the transfer unit 41 and the charging unit 42. A corona charger is preferably used for the charging unit 42, and a corona transfer unit is preferably used for the transfer unit 41. However, any type of chargers and transfer units may be applied as long as the discharge efficiency is uniform.

The optical reading system 61 includes an illuminating lamp provided integrally with the first scanning mirror, and also includes the second mirror (V mirror) moved at half the speed of the first mirror. Accordingly, the optical reading system 61 is capable of scanning the surface of a document while the length of the optical path before the lens is maintained constant. As a result, a reflected light beam sent from the document image disposed on the platen can form an image on the light receiving section of a solid image sensor by the action of the optical image reading system 61. The optical image reading system 61 sends an output signal of the solid image sensor to the reading and scanning system drive means 63.

The optical scanning system 62 includes: a laser scanning system having a polygonal mirror that conducts a rotational scanning operate on the laser beam sent from the semiconductor laser, wherein the laser beam is modulated in accordance with the image signal; and a fixed scanning system in which LED arrays and liquid crystals are used. The intensity modulation method and pulse modulation method are used for optical modulation of the laser beam irradiated by the optical scanning system 62. In this case, image data corresponding to an optical image sent from a reference density plate is previously stored in ROM, the image data being referred to as reference density data. In this example, reference density data corresponding to image density of about 1.0 is stored.

The optical reading scanning system of a digital system is explained above, however, the present invention is not limited to the specific example, and in the case of an analog system, an optical scanning system of the prior art is used. For example, the analog optical scanning system is composed in the following manner. The optical reading system includes an illuminating lamp provided integrally with the first scanning mirror, and also includes the second mirror (V mirror) moved at half the speed of the first mirror. The second mirror is moved to conduct a scanning operation while the optical length before the lens is always maintained to be constant. In the aforementioned system, a reference density plate corresponding to optical reflection density 1.0 is provided in a lower edge portion of the platen glass, and the reference density plate is irradiated with a light beam emitted from the illuminating lamp, so that a reference latent image is formed on the photoreceptor drum 1, and then the latent image is developed with toner.

The reading and scanning optical scanning system drive circuit 63 includes: a circuit that controls a mechanism such as a polygonal mirror; and an image processing circuit that color-processes an image sent from the optical reading system 61. For example the image processing is carried out as follows: reference image density data that varies stepwise or continuously in a range from optical reflection density 0 to 1.0, is stored in the ROM; and a reference latent image is formed in accordance with the stored data. In this example, the reference image density data corresponds to optical reflection density 1.0, however, the present invention is not limited to the specific example, and image density data, the optical reflection density of which corresponds to 1.0 to 0, may be applied.

Optical density measurement means PS uses an LED for the light source, and a beam of light emitted from the LED is reflected on the reference toner image on the photoreceptor drum 1. The reflected beam is photoelectrically converted into an electric signal, and the electric signal is outputted to the second CPU70. Optical density measurement means PS may use a tungsten lamp for the light source, which includes a light receiving section composed of a single photosensor.

The first CPU sequentially controls an image forming process, and includes an image formation program to carry out the image forming process. In accordance with a start signal outputted when the copy button is pressed, the first CPU50 starts the image formation program to carry out the image formation.

Figure 8:
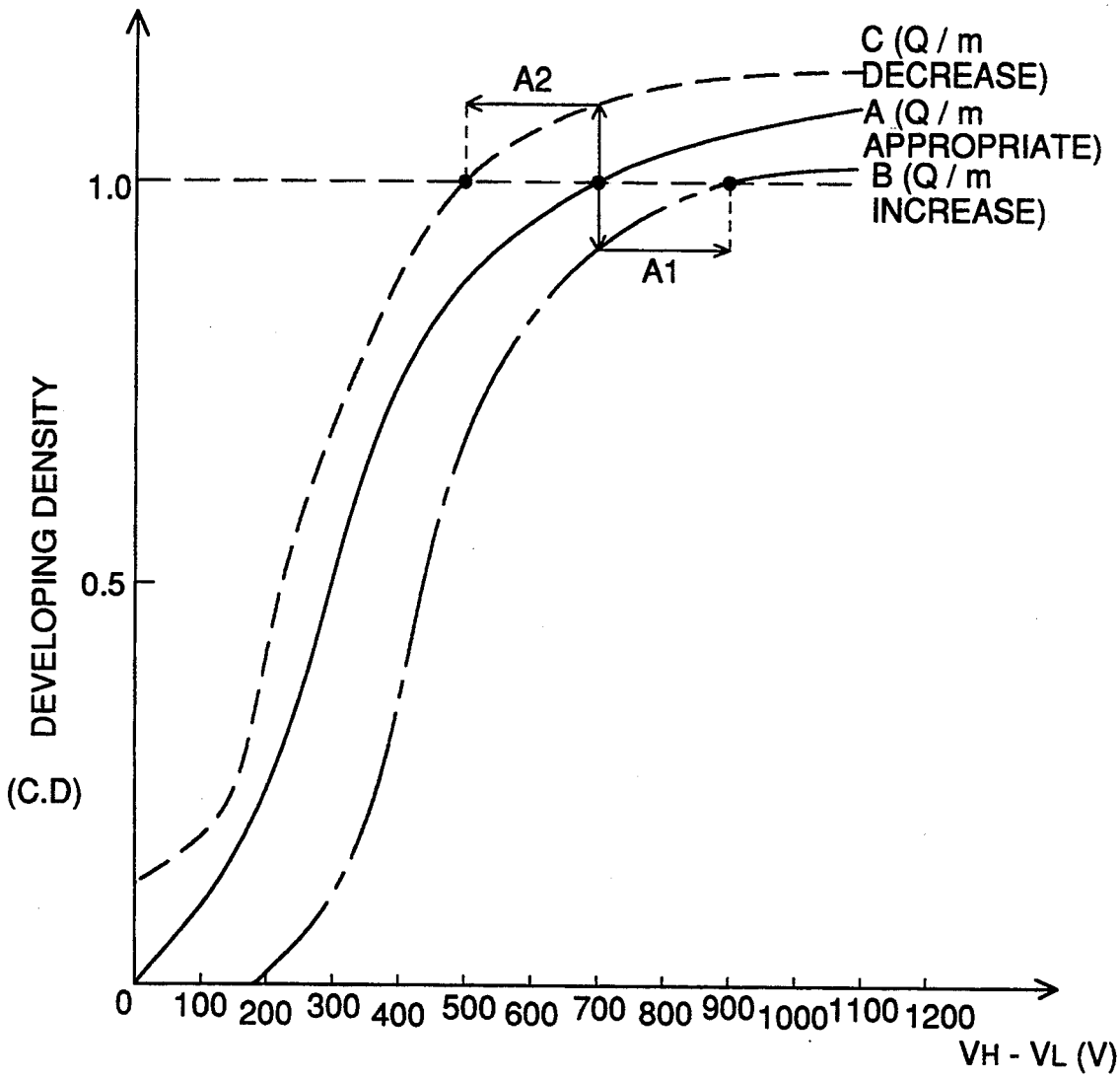
FIG. 8 is a graph showing a relation between the developed image density and the electrostatic latent image potential in the case of a normally developed image in the second example.

The second CPU70 stores a lookup table T and an image density control program in its ROM 70*a*, wherein lookup table T includes a relation between image density CD shown on solid line A, one-dotted chain line B and broken line C in FIG. 8, and toner concentration $T_C$, and wherein the image density control program includes a toner concentration judgment program and a toner charge amount control program.

The toner concentration judgment program judges whether or not the toner concentration detected by toner concentration detection means TS has been reduced to less than a predetermined value. In the case where the toner concentration has been reduced to less than the predetermined value, a toner concentration NG signal is sent to the first CPU50 by the toner concentration judgment program, and in the case where the toner concentration has not been reduced to less than the predetermined value, toner concentration OK signal is sent to the first CPU50 by the toner concentration judgment program. The first CPU50 is provided with toner concentration judgment result register R1 in which the toner concentration NG signal or the toner concentration OK signal received from the second CPU70 is registered. In the case where the toner concentration NG signal is registered in the toner concentration judgment result register R1, the hopper drive circuit 32 is controlled so that the toner supply roller 27R is rotated. When the toner supply roller 27R is rotated, the toner in the toner hopper 27 is supplied into the developing tank so that the toner concentration can be maintained constant.

The toner charge amount control program is operated as follows:

In the case where a detection signal sent from optical density measurement means PS shows that the image density is decreased or increased although the toner concentration is almost constantly maintained at a predetermined value, the toner charge amount control program detects this and controls the hopper drive circuit 32 so that the additive supply roller 28R is rotated. Accordingly, additive G in the additive hopper 28 is added to the 2-component developer in the developing tank 20 so that the toner charge amount can be reduced.

In this case, the increase or decrease in the image density is detected in the following manner:

A reflected image density of a toner image formed on the photoreceptor drum 1 corresponding to the reference density plate is detected, and compared with image density CD which is about 1.0 [toner concentration $T_C=5$ (wt %)] that is a reference to be read out from lookup table T. In this case, the reference image density is registered in reference image density register R2.

The first CPU50 is provided with the first counter CT1 that counts the number of copies, and is also provided with the second counter CT2. The first counter CT1 counts the number of copies in the case of continuous copying in accordance with a detection signal sent from the paper discharge sensor. The second counter CT2 counts the number of copies that indicates the timing in which the toner charge amount control program is carried out, that is, the second counter CT2 counts the overall number of copies after the previous toner charge amount control was carried out. Specifically, the toner charge amount control program is carried out at each 1000 copies.

The reason why the toner charge amount control program is carried out at each 1000 copies is as follows: It is practical that the toner charge amount control is carried out intermittently. Further, the toner used for forming the reference toner image is scraped off by the cleaner to clean the photoreceptor drum 1, so that the toner can not be used for an ordinary copy operation. Therefore, it is necessary to save toner.

Figure 2:
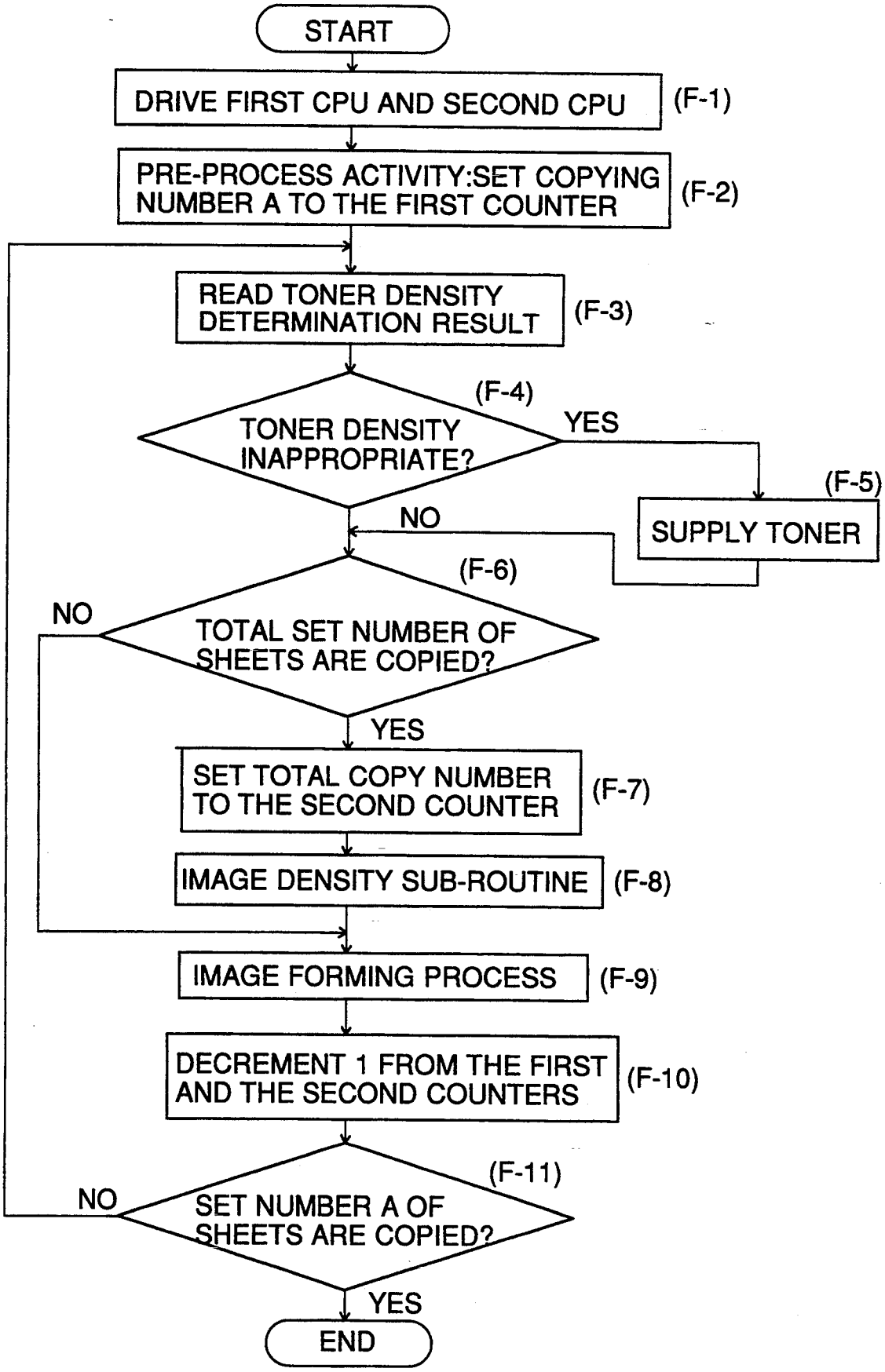
FIG. 2 is a flow chart showing an image recording operation of the electrostatic recording method of the first example of the present invention.
Figure 3:
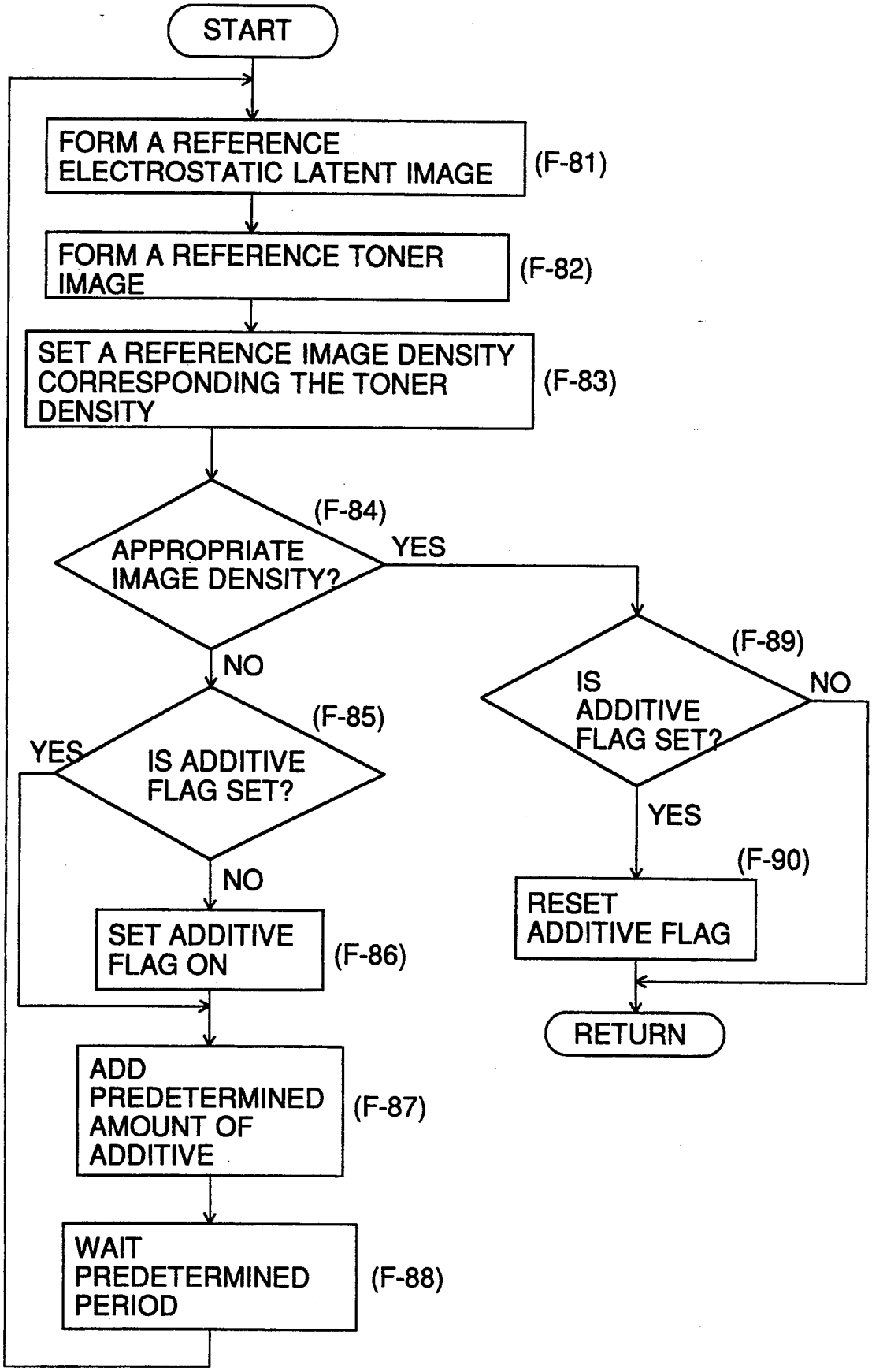
FIG. 3 is a flow chart showing an image density control operation by the electrostatic recording method of the first example.

With reference to the flow charts shown in FIGS. 2 and 3, an image recording operation of this image recording apparatus will be explained as follows. FIG. 2 shows a main flow to be carried out by the first CPU50, and FIG. 3 is a toner charge amount control flow to be carried out by the second CPU70.

When a main switch (not shown) is pressed, electrical power is supplied to the apparatus. As a result of the foregoing, the first CPU50 and the second CPU70 are started (step F-1 in FIG. 2).

The first CPU50 controls the first motor driver 10, so that the main motor is started, and the first and second stirring rollers **20*e*, 20*f* of the developing unit 20** is connected with this drive system so that the 2-component developer is stirred. Further, a heater of the fixing unit is heated to a predetermined temperature.

Also, the first CPU50 conducts the following preprocessing:

The photoreceptor drum 1 is connected with the main motor drive system so that the photoreceptor drum 1 is rotated. Then, the photoreceptor drum 1 is charged by the charging unit 41. After that, charging and discharging are repeatedly conducted so that the image process conditions are adjusted. Further, in the preprocessing, number A of copies produced by a continuous copying operation that has been set by an operator through a predetermined button operation, is set in the first counter CT1 (step F-2).

As described above, according to the toner concentration judgment program, the second CPU70 always judges whether or not the toner concentration detection signal sent from toner concentration detection means TS has been reduced to not more than 5 (wt %). In the case where it has been reduced to not more than 5 (wt %), a toner NG signal is transmitted to toner concentration judgment result register R1 of the first CPU50, and in the case where it has not been reduced to less than 5 (wt %), a toner OK signal is transmitted to toner concentration judgment result register R1.

Then, the first CPU50 reads out a signal that has been set in toner concentration judgment result register R1 (step F-3), and judges whether it is a toner concentration NG signal or not (step F-4). In the case where it is a toner concentration NG signal, toner is supplied (step F-5), and the program advances to step (F-6). On the other hand, in the case where of a toner concentration OK signal, the program immediately advances to step (F-6). In step (F-6), it is judged whether the count value in the second counter CT2 is "0" or not, so that it is judged whether the count value of overall copies has reached 1000 or not. In the case where the overall number of copies has not reached 1000, the program advances to step (F-9). In the case where the overall number of copies has reached 1000, the first CPU50 sets the number "1000", which is the setting value of the number of overall copies, on the second counter CT2 (step F-7), and the image density control is interrupted, and then a toner charge amount control signal is outputted to the second CPU70 (step F-8).

Then, the second CPU70 responds to the toner charge amount control command signal sent from the first CPU50, and starts the optical scanning system 62 so as to turn on the light source. The emitted light irradiates the reference density plate. The reflected light sent from the reference density plate forms an image on the photoreceptor drum 1 through the first and second mirrors and the like. In this way, a reference electrostatic latent image is formed (step F-81 shown in FIG. 3). Then, the developing unit 20 is driven, so that the reference electrostatic latent image is visualized to form a reference toner image (step F-82). Next, the second CPU70 reads out reference image density CD corresponding to the toner concentration detection signal sent from toner concentration detection means TS, from lookup table T, and the reference image density CD is set in reference image density register R2 (step F-83).

Figure 4:
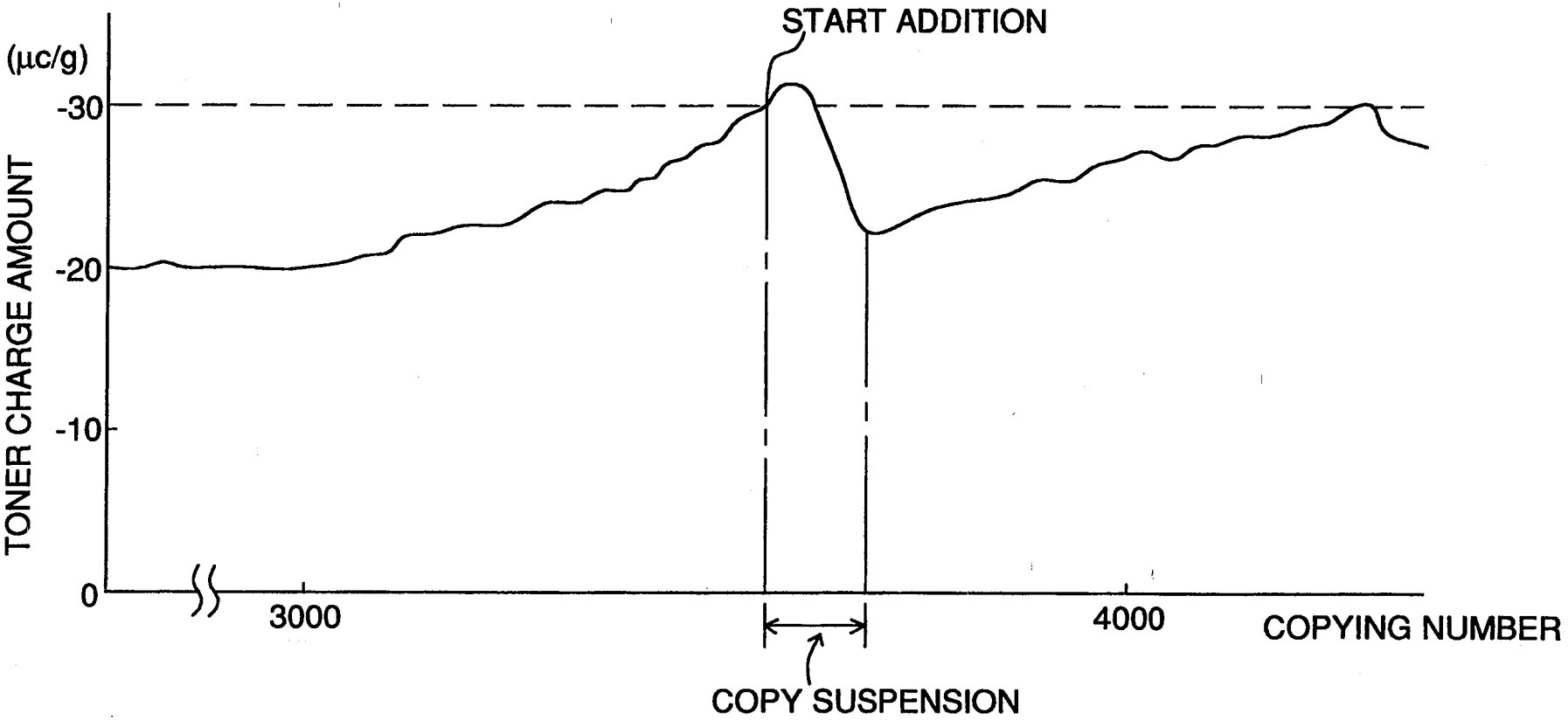
FIG. 4 is a graph showing a state of toner charge amount that is decreased as an additive is added to the toner.

Then, the actual optical image density is read from optical image density measurement means PS and compared with the reference image density held in reference image density register R2 so as to judge whether the actual optical image density coincides with the reference image density or not (step F-84). In the case where the actual optical image density does not coincide with the reference image density, it is judged whether addition flag F is set up or not, that is, it is judged whether additive G is being added at that time or riot (step F-85). In the case where addition flag F is not set and additive G is not being added at that time either, addition flag F is set (step F-86), and the hopper drive circuit 32 is controlled so that the additive supply roller 28R is rotated by a predetermined number of revolutions. In this way, a predetermined amount of additive G stored in the additive hopper 28 is added into the 2-component developer in the developing tank 20 (step F-87). In this case, the first and second stirring rollers 23 and 24 are continuously rotated, so that additive G is mixed with the 2-component developer . Therefore, the toner charge amount is reduced as shown in FIG. 4. In this case, the reason why the toner charge amount increases for a while after additive G has started to be added, is as follows: Additive G and the 2-component developer are not sufficiently mixed, so that the increase in the toner charge amount caused by stirring is higher than the decrease in the toner charge amount caused by additive G. Accordingly, the program waits for a period of time during which additive G is sufficiently mixed with the 2-component developer (step F-88). In order to confirm that the actual optical image density has been recovered to the reference image density due to the decrease in the toner charge amount, the program returns to step (F-81). In the case where it is judged that addition flag F is set in step (F-85), it is due to the following: although additive G has added by a predetermined amount, the addition amount is not sufficient, so that the actual optical image density is not recovered to the reference image density. Consequently, the program skips step (F-86) and advances to step (F-87).

In the case where it has been judged in step (F-84) that the actual optical image density coincides with the reference image density, it is judged whether addition flag F is set or not. In the case where addition flag F is set, it means that the actual optical density has been recovered to the reference image density as a result of the action of additive G. Therefore, in order to complete the adding operation of additive G, addition flag G is reset (step F-90) and returned. On the other hand, in the case where addition flag F has already been reset, it means that the optical image density initially coincides with the reference image density so that it is not necessary to add additive G. For that reason, the program returns as it is.

Then, the first CPU50 carries out an image forming process according to the image forming program (step F-9 shown in FIG. 2). Then, 1 is subtracted from the counted value of the number of continuous copies of the first counter CT1, and also 1 is subtracted from the counted value of the number of overall copies of the second counter CT2 (step F-10). When it is judged whether or not the counted value of the number of continuous copies of the first counter CT1 is "0", it is judged whether or not the number of copies has reached A, which is the number of continuous copies relating to settling (step F-11). In the case where the counted value of the first counter CT1 is "0" and the number of copies has reached the number A of continuous copies, the program is completed. On the other hand, in the case where the number of copies has not reached the number A of continuous copies, the program returns to step (F-3) so as to conduct a continuous copy operation.

Even when the triboelectric charging polarity of additive G added into the developer is the same as that of the toner, the additive G can be applied to the present invention. In this case, it is required that additive G is lower than the toner on the triboelectric electrification scale.

As a specific example, a case will be explained as follows in which fine powder of titanium oxide is used for additive G:

Nonconductive carrier was made in such a manner that the surfaces of ferrite cores were covered with resin, the average particle size of which was 40 μm. An appropriate amount of negative charged toner was added to the nonconductive carrier so as to make 2-component developer. The 2-component developer was provided into the black developing unit of KONICA 9028 (a brand name), and running copy operations were carried out. At the start, the toner charge amount was −19.5 μC/g, and the maximum reflecting density was 1.28 on a transfer sheet after development. The density of a portion on the photoreceptor drum 1 corresponding to reference density 1.0 was 1.08. After 3000 copies had been made, the toner charge amount was increased to about −31 μC/g, and the maximum reflection density was lowered to 0.8. Then, independent from the supply of toner, titanium oxide powder of 60 mg corresponding to 0.1 wt % with respect to the entire toner amount of the 2-component developer, was intermittently added twice, so that titanium oxide powder of 120 mg was added, wherein the entire amount of the 2-component developer was about 1.5 Kg, the entire toner amount was 60 g and the toner concentration was about 4 wt %. After the 2-component developer was stirred for some time, image formation was carried out. Then, the toner charge amount was reduced to about −22 μC/g, and the maximum reflecting density was recovered to 1.2. Then, the copy operation was continued, and the developing properties were deteriorated each time 1500 to 5000 copies were made. Therefore, fine powder of titanium oxide was added by 60 mg each time, and fine powder of titanium oxide was added twice or three times in total. As a result, the developing properties were recovered.

Figure 5:
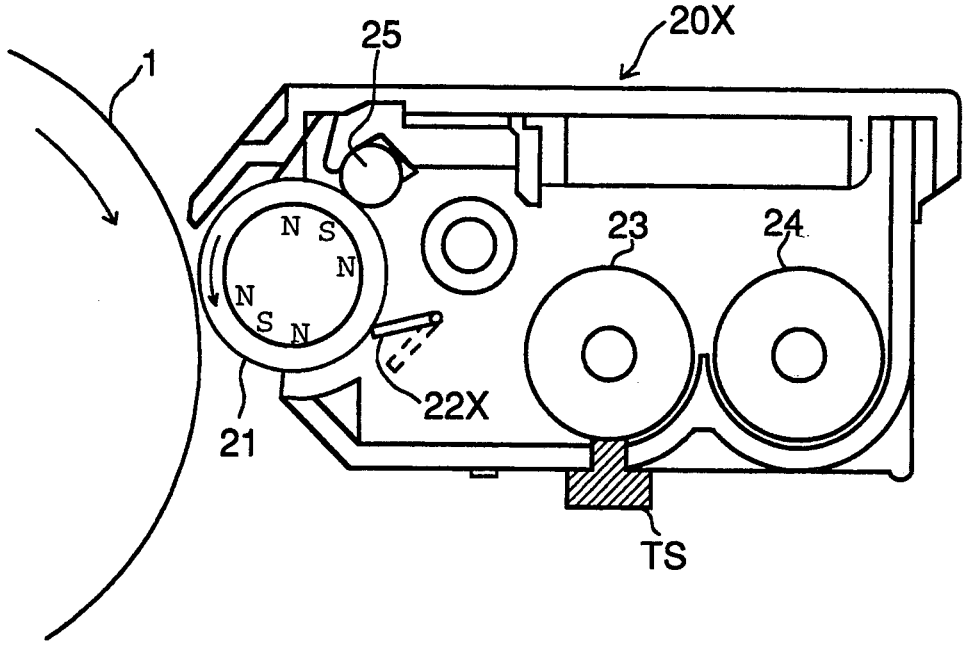
FIG. 5 is a view showing the structure of an applied example of a developer in the first example.
Figure 6:
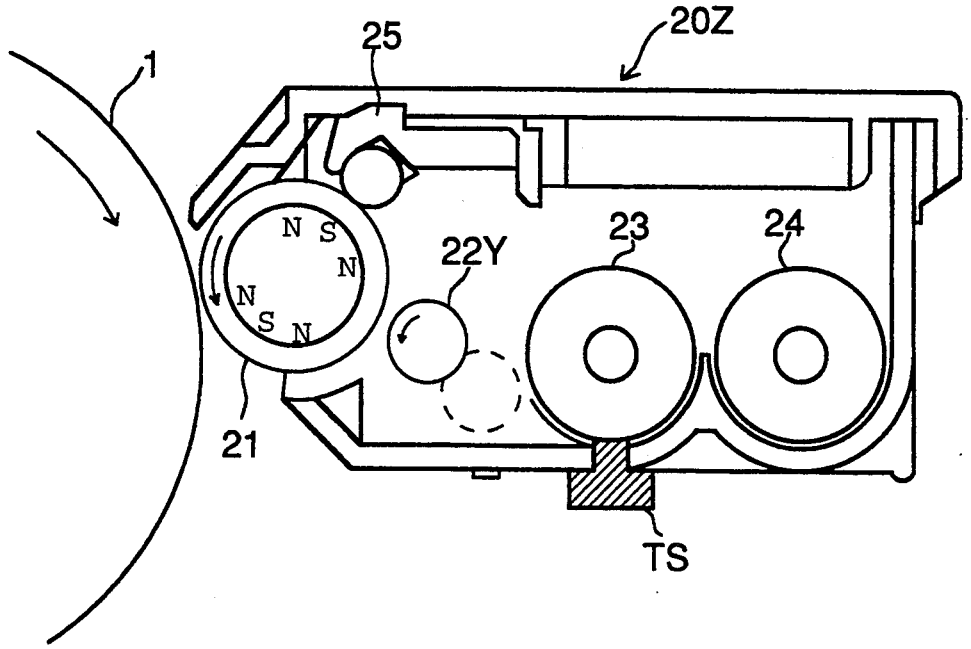
FIG. 6 is a view showing the structure of an applied example of a developer in the first example.

Next, with reference to FIGS. 5 and 6, variations of the toner charge amount control member will be explained as follows. FIGS. 5 and 6 are sectional views showing a developing unit provided with variation of the toner charge amount control member.

Developing units 20X and 20Z are structured in the following manner: instead of the scraper 22, a toner charge amount control member is attached to the developing unit 20 shown in FIG. 1; the additive hopper 28 to supply additive G, and the additive adding roller 28R are omitted; and other structures are the same as those of developing unit 20. Like parts in each of the drawings are identified by the same reference character, and the explanations are omitted here.

The toner charge amount control member shown in FIG. 5 is composed of a blade 22X made of silicon rubber. The blade 22X is rotatably provided so that it can be rotated from a position shown by a dotted line to a position shown by a solid line. Specifically, the toner charge amount control member is disposed so that it can be apart from the developing sleeve 21 by 0.3 to 20 mm, wherein the developing sleeve 21 is provided with a fixed magnet and rotated counterclockwise in such a manner that the surface of the developing sleeve 21 advances in the same direction as that of the photoreceptor drum 1. As a result of the foregoing, it becomes possible to control the charge amount of toner in the 2-component developer that is carried by the developing sleeve 21. Therefore, the toner charge amount can be adjusted to an appropriate value. In the case where the blade 22X is made of silicon rubber or Teflon, it is preferable to dispose the blade 22X so that it can lightly rub the magnetic brush. The material of the blade 22X is not limited to the specific example. As long as the polarity on the triboelectric electrification scale is the same and the triboelectric charge amount is large, any materials can be used.

In this case, a toner charge amount control member drive circuit is necessary to drive the blade 22X in accordance with a control signal sent from the second CPU70.

In the apparatus shown in FIG. 6, the toner charge amount control member is composed of a triboelectric charging roller 22Y. The radius of curvature of the triboelectric charging roller 22Y is preferably the same as that of the developing sleeve 21. The triboelectric charging roller 22Y is rotatably provided so that it can be moved from a position shown by a dotted line to a position shown by a solid line. Specifically, the triboelectric charging roller 22Y is disposed from the developing sleeve 21 by a distance of about 0.3 to 2.0 mm. As a result of the foregoing, when the 2-component developer is scraped off from the developing sleeve 21 in the case where the 2-component developer carried on the developing sleeve 21 returns into the developing unit 20, and also when the returned 2-component developer is stirred and mixed with the 2-component developer in the developing unit 20Z, the charge amount of toner in the developer can be controlled. When the distance between the triboelectric charging roller 22Y and the developing sleeve 21 is adjusted, and also when the rotational speed and rotational direction of the triboelectric charging roller 22Y are adjusted, the toner charge amount can be controlled. In the case where the optical reflection density is greatly lowered, the triboelectric charging roller 22Y may be moved toward the developing sleeve 21, or the rotational speed of the triboelectric charging roller 22Y may be increased. In the case where the triboelectric charging roller 22Y is made of silicon rubber or Teflon, it is preferable to dispose the triboelectric charging roller 22Y so that it can lightly rub the magnetic brush. The material of the triboelectric charging roller 22Y is not limited to the specific example. As long as the polarity on the triboelectric electrification scale is the same and the triboelectric charge amount is large, any materials can be used.

A specific example will be explained in which a running copy operation was carried out using a developing unit shown in FIG. 5. At the start of the running copy operation, the toner charge amount was $-19.5\ \mu C/g$, and the reflection density was 1.08 in a portion on the photoreceptor drum 1 where the reference density was 1.0. Then, the blade 22X made of silicon rubber containing fluorine was attached in such a manner that the distance between the blade 22X and the developing sleeve 21 was 1.8 mm, and then the running copy operation was started. After 5000 copies had been made, the toner charge amount was reduced to $-29\ \mu C/g$, and the reflection density of a portion of reference density 1.0 was lowered to 0.8. Then, 100 copies were made while the blade 22X was approached to the developing sleeve 21 by a distance of 0.4 mm. As a result, the toner charge amount was lowered to about $-21\ \mu C/g$, and the reflection density of a portion of reference density 1.0 was recovered to about 1.0. Therefore, the distance between the blade 22X and the developing sleeve 21 was returned to the initial value 1.8 mm. In this case, the reflection density of a portion of reference density 1.0 was lowered each time 5000 to 8000 copies were made, so that it was necessary to conduct the same process as described above. In this case, it was required to provide a toner charge amount control member drive circuit to drive the triboelectric charging roller 22Y in accordance with a control signal sent from the second CPU70.

It was effective to control the rotational speed of the developing sleeve 21. That is, in the case where the reflection density of the reference density portion has been lowered, the developing property can be improved when the rotational speed of the developing sleeve 21 is increased. Further, since the amount of the 2-component developer controlled by the triboelectric charging roller is also increased, more effect can be presumably provided. However, the aforementioned effects greatly depends on the developing condition. Therefore, a reverse effect may be provided in some cases.

Although the drawings are not included here, a system is effective in which the toner charge amount of the 2-component developer on the developing sleeve 21 is controlled by discharging. For example, the following system may be adopted: corona discharge is conducted by a corona discharger opposed to the 2-component developer on the developing sleeve 21. It is preferable that the corona discharger includes an AC power supply, and the corona discharger does not necessarily include a DC power supply.

As explained above, according to the electrostatic recording method of the first example of the present invention, an image with appropriate image density can be reproduced in the following manner: in the case where image density is lowered although the toner density is maintained to be approximately constant, the lowered image density is detected and the toner charge amount is controlled to a predetermined value.

With reference to the attached drawings, an image recording apparatus of the second example of the present invention will be explained as follows.

Figure 7:
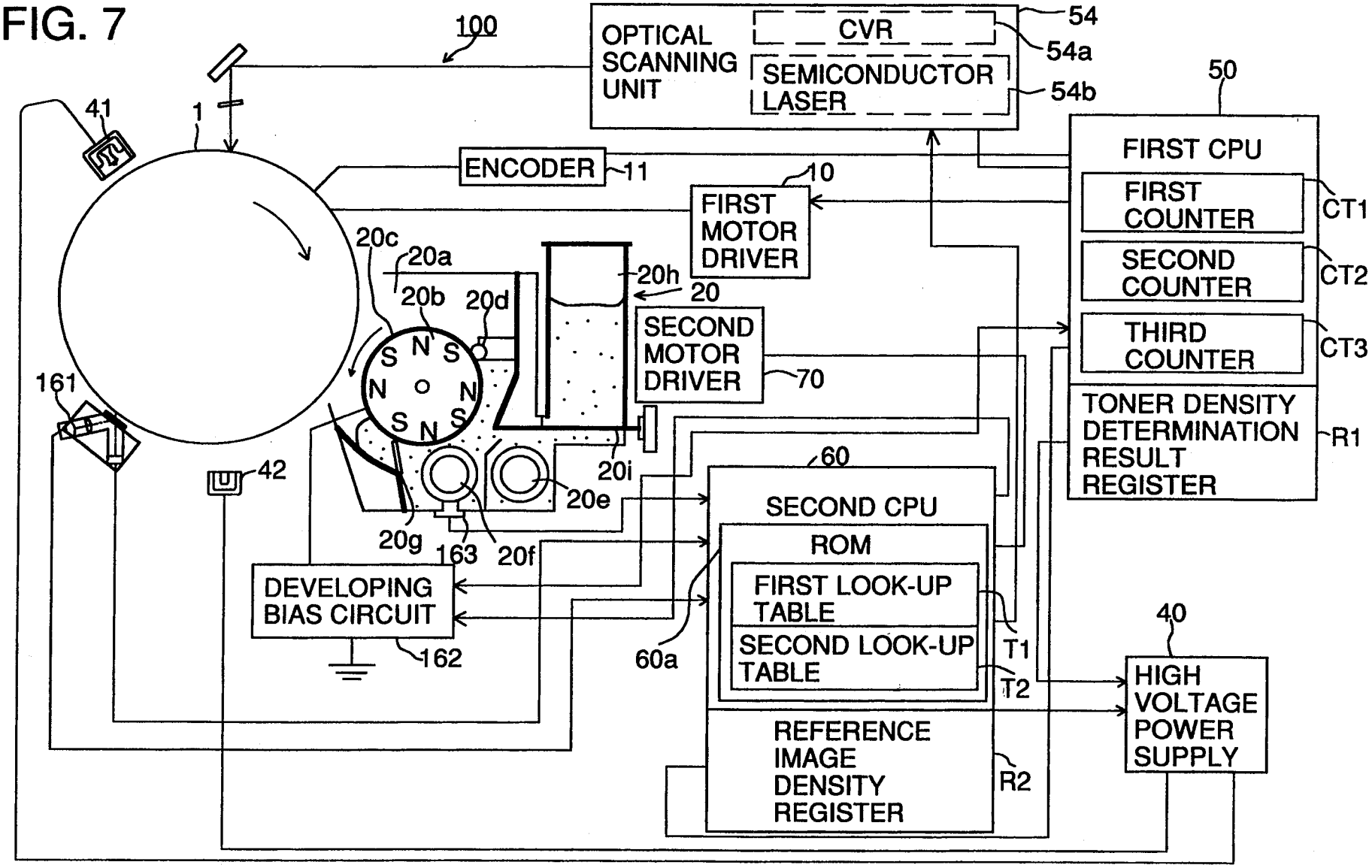
FIG. 7 is a block diagram of the image recording apparatus of the second example.

FIG. 7 is a block diagram of the image recording apparatus of the second example of the present invention. The image recording apparatus 100 includes a photoreceptor drum 1 on which a latent image is formed, first motor driver 10 to control the rotation of the photoreceptor drum 1, developing unit 10, high voltage power supply 40, transfer unit 42, charger 41, optical scanning system 54, first CPU50, second CPU60, optical density measuring means 61, developing bias circuit 62, and toner concentration detection means 63.

The first motor driver 10 is a circuit that mainly controls a main motor (not shown in the drawing) to drive the photoreceptor drum 1. It turns on and off the main motor in accordance with a control signal sent from the first CPU50.

The encoder 11 generates a pulse signal of a predetermined width corresponding to the rotational phase of the photoreceptor drum 1, and outputs the pulse signal to the first CPU50. As a result of the foregoing, the first CPU50 detects the rotational phase of the photoreceptor drum 1.

In the case of an analog system, a scanning system of the prior art is applied to the optical scanning system 54. For example, although not shown in the drawings, the optical scanning system 54 includes an illuminating lamp provided integrally with the first scanning mirror, and the second scanning mirror (V mirror) moved at half the speed of the first scanning mirror. The second mirror is moved to conduct a scanning operation while the optical length before the lens is always maintained to be constant. In the aforementioned system, a reference density plate corresponding to optical reflection density CD=1.0 is provided in a lower edge portion of the platen glass, and the reference density plate is irradiated with a light beam emitted from the illuminating lamp, so that a reference latent image is formed on the photoreceptor drum 1, and then the latent image is developed with toner. The illuminating intensity can be adjusted by controlling the power supply to turn on the illuminating lamp, that is, the illuminating intensity can be adjusted by controlling what is called a CVR54*a*. There are two methods for the digital optical scanning system. One is a method in which the same optical reading scanning system as described above is used, and the other is a method in which image data forming a reference density portion is stored in the memory and a reference latent image is formed in accordance with the data. In the digital system, the optical scanning system 54 to form an electrostatic latent image may be a laser scanning system in which a polygonal mirror is provided to conduct a rotational scanning operation on a laser beam sent from the semiconductor laser 54b modulated by an image signal, and also a fixed scanning system may be used to which LED arrays and liquid crystals are applied.

The digital optical scanning system includes an intensity modulation method and a pulse width modulation method so as to modulate the laser beam. The intensity modulation method is a method by which the irradiating intensity is adjusted, for example, when a current flowing in the semiconductor laser 54b is controlled. The pulse width modulation method is a method by which the irradiating light amount is adjusted, for example, when the level of a reference wave is controlled.

The developing unit 20 includes: the sleeve 20c provided with the magnet roller 20b having N and S poles, the sleeve 20c being disposed in the developing tank 20a composed of lower and upper casings; the regulating member 20d made of a rigid material provided in the lower casing so that the regulating member 20d can be contacted with the sleeve 20c with pressure; the first and second screw-shaped stirring rollers 20e and 20f; and the scraper 20g to scraps off the 2-component developer from the surface of the sleeve 20c. The 2-component developer is composed of toner and carrier, and the toner particles are deposited on the carrier particles and conveyed onto the sleeve 20c. The toner particles are conveyed to the developing region, which is opposed to the photoreceptor drum 1, by the sleeve 20c. In order to supply new toner into the developing tank 20a, the conveyance screw 20i is provided, which is communicated with the toner hopper 20h through a pipe and driven in accordance with a toner supply signal. Instead of the regulating member 20d, a thin layer forming means including a magnetic rod and a magnetic plate may be provided.

The first stirring roller 20e is structured so that the developer can be conveyed to the viewer's side in the drawing, and the second stirring roller 20f is structured so that the developer can be conveyed to the opposite side. A partition is provided between the first and second rollers 20e and 20f, so that the 2-component developer can be circulated smoothly and the 2-component developer can not be held in one position. As a result of the aforementioned structure, the 2-component developer to be conveyed into the developing region can be replaced, so that the developing conditions can be stabilized.

The scraper 20g is rotatably supported by a roller so that it can be contacted with and separated from the sleeve 20c. When the scraper 20g comes into pressure contact with the sleeve 20c, the 2-component developer, the toner component of which has been consumed in the developing region, is scraped off from the sleeve 20c.

The sleeve 20c is connected to the developing bias circuit 162 that impresses a voltage including AC and DC bias components through a protective resistance so as to prevent the occurrence of fogging.

The developing bias circuit 162 moves the toner in the 2-component developer conveyed to the developing region by the sleeve 20c so as to form an electrostatic latent image by the action of an electric field generated on the surface of the photoreceptor drum 1. The developing bias circuit 162 includes an AC power supply that impresses an AC bias to alternate the toner between the sleeve 20c and the photoreceptor 1, and also includes a high voltage DC power supply to impress a DC bias. As described above, the developing bias circuit 162 generates an alternating electrical field between the sleeve 20c and the photoreceptor drum 1, so that the toner particles are alternated between the sleeve 20c and the photoreceptor drum 1. Therefore, even when the 2-component developer is not contacted with the photoreceptor drum 1, a clear toner image can be effectively formed on the photoreceptor drum 1 from toner particles. The developing bias of the developing bias circuit 162 can be changed by a control signal sent from the second CPU60.

The high voltage power supply circuit 40 impresses a predetermined high voltage upon the transfer unit 42 and the charger 41. When the voltage to be impressed upon the charger 41 is changed under the control of the second CPU60, the initial charging potential of the photoreceptor drum 1 can be changed.

The optical density measurement means 161 employs an LED for the light source. Light emitted from the LED is reflected on the reference toner image formed on the photoreceptor drum 1 and received by a photodiode.

The toner concentration detection means 163 detects the toner concentration of the 2-component developer provided in the developing unit 20 by detecting a change in magnetic permeability of the 2-component developer. However, the toner concentration detection means 163 may be composed in such a manner that the toner concentration is detected when the volume of the 2-component developer is detected in the developing unit 20. For convenience of explanation, the toner concentration detection means will be described here that detects the toner concentration by detecting a change in magnetic permeability.

The first CPU50 sequentially controls an image forming process and has an image forming program to carry out the image forming process. In accordance with a start signal generated when the copy button has been pressed, the first CPU50 starts the image forming program and carries out the image forming process.

Figure 21:
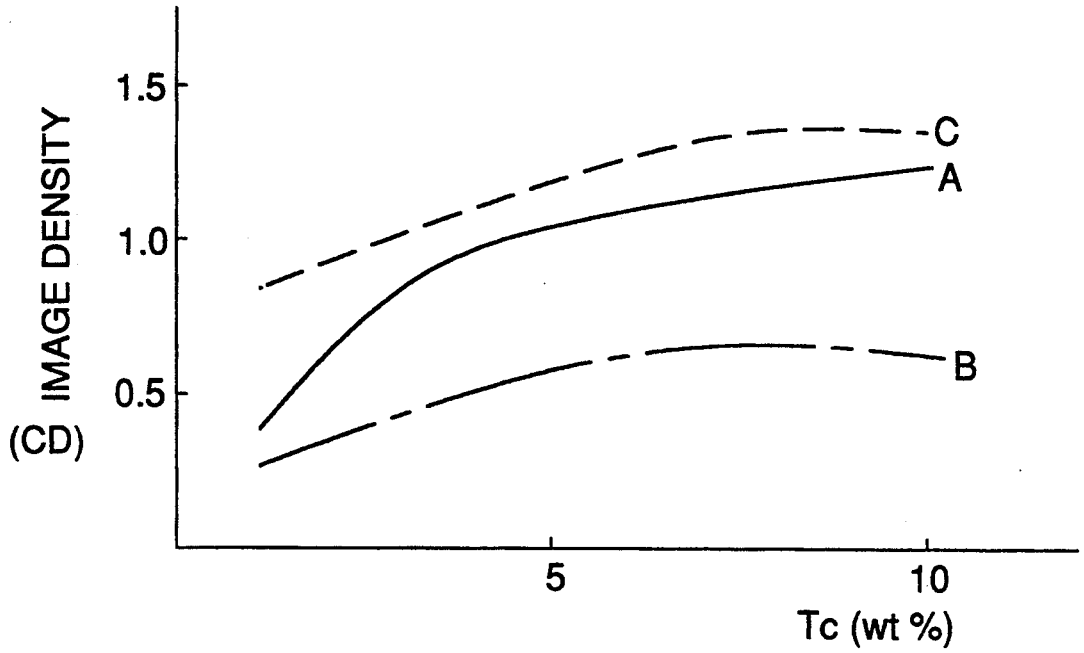
FIG 21 is a graph showing a change in image density CD with respect to charge amount Q/m (μc/g) of toner in 2-component developer provided in the developing unit.

The second CPU60 stores the first lookup table T1 that includes a relation between image density CD shown on solid line A, one-dotted chain line B and broken line C in FIG. 21, and toner concentration $T_C$ in its ROM 60a, and also the second CPU60 stores the second lookup table T2 that includes a relation between development image density CD shown on solid line A in FIG. 8 and the electrostatic latent image potential in its ROM 60a, and further the second CPU60 stores an image density control program including a toner concentration judgment program and an electrostatic latent image potential control program in its ROM 60a.

The toner concentration judgment program judges whether or not the toner concentration detected by the toner concentration detecting means 163 has become smaller than a predetermined value. In the case where the toner concentration has been reduced to a value less than a predetermined value, a toner concentration NG signal is transmitted to the first CPU50, and in the case where the toner concentration has not been reduced to a value less than a predetermined value, a toner concentration OK signal is transmitted to the first CPU50. In this case, the first CPU50 is provided with toner concentration judgment result register R1 in which the toner concentration OK signal or toner concentration NG signal received from the second CPU60 is registered. In the case where the signal in this toner concentration judgment result register R1 is a toner concentration NG signal, toner is supplied to the developing tank 20a from the toner hopper 20h so that the toner concentration can be maintained to be constant.

The electrostatic latent image potential control program maintains the image density at a predetermined value in the following manner: a detection signal sent from the optical density detection means 161 indicates that the image density is decreased or increased although the toner concentration is approximately maintained to be a predetermined value, the electrostatic latent image potential control program refers to the second lookup table T2 and controls the electrostatic latent image potential, so that the image density can be maintained to be the predetermined value. In this case, the increase and decrease in the image density is detected in the following manner: the reflected image density of a toner image on the photoreceptor drum 1 corresponding to the reference density plate is detected; and the reflected image density is compared with CD=about 1.0 [toner concentration $T_C$=5 (wt %)], which is read out from the first lookup table T1 so as to be used for a reference. At this time, the reference image density is set in reference image density register R2.

FIG. 8 is a graph showing a relation between development image density CD and electrostatic latent image potential ($V_H$- $V_L$) in normal development.

In FIG. 8, development density CD is defined as optical image density of a reference density plate or a reference toner image, that has been formed on the photoreceptor drum 1 in accordance with the reference density data under a predetermined image forming condition. The electrostatic latent image potential corresponds to the force that attracts toner and carrier to the sleeve 20c in development. Since a normal developing method is employed here, the electrostatic latent image potential is a potential obtained when development bias $V_B$ is subtracted from initial charging potential $V_H$. Initial charging potential $V_H$ is the surface potential of the photoreceptor drum 1 under the condition that the photoreceptor drum 1 is uniformly charged by the charger 41 before the formation of an electrostatic latent image.

Solid line A in FIG. 8 corresponds to solid line A in FIG. 21, which shows the characteristics of the 2-component developer under the condition that toner charge amount Q/m is appropriate. At least in a range from development density CD =0 to 1.0, contrast control can be easily carried out, and further toner charge amount Q/m is appropriate. Therefore, image slippage hardly occurs in the image forming process after toner image formation.

One-dotted chain line B in FIG. 8 corresponds to one-dotted chain line B in FIG. 21. One-dotted chain line B shows the characteristics of developer under the condition that toner charge amount Q/m is increased compared with solid line A of a normal case. In this case, the depositing force between toner and carrier is increased compared with other force as described before, so that the developing force is lowered. Accordingly, the gradation in a low density portion is not good.

Broken line C in FIG. 8 corresponds to broken line C in FIG. 21. Broken line C shows the characteristics of developer under the condition that toner charge amount Q/m is decreased compared with solid line A of a normal case. In this case, the depositing force between toner and carrier is decreased, so that the developing force is apparently increased. In this case, gradation can not be reproduced in a low density portion, and further the depositing force between the toner image and the photoreceptor drum 1 is lowered. Accordingly, image offset tends to occur in the successive process.

Figure 9:
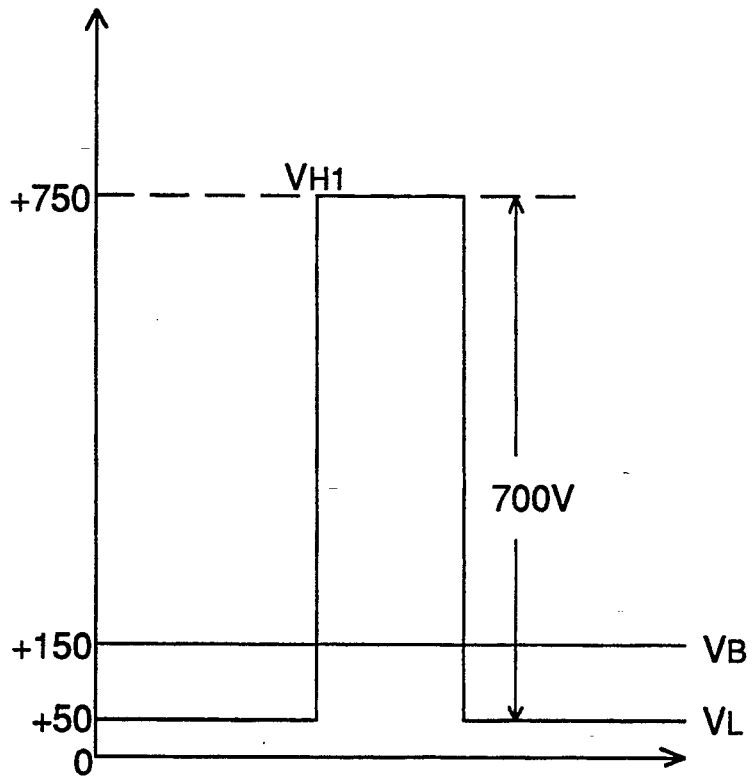
FIG. 9 is a graph showing the initial value of the electrostatic process condition in the case of normal development in the second example.
Figure 10:
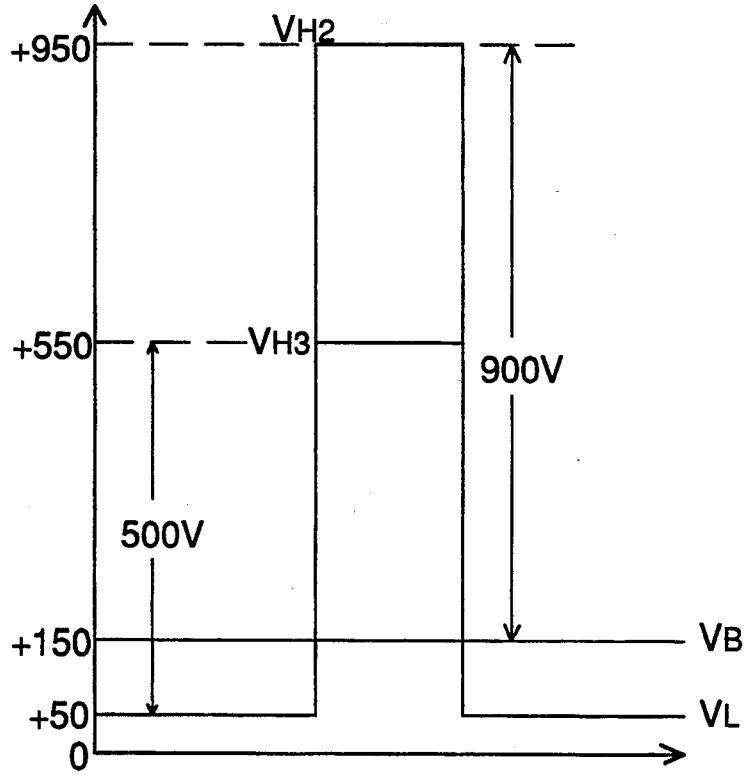
FIG. 10 is a graph showing an example in which the electrostatic process condition is changed in the second example.

FIG. 9 is a view showing an electrostatic latent image potential in the case where toner charge amount Q/m is appropriate in normal development. FIG. 10 is a view showing an electrostatic latent image potential relating to a change when toner charge amount Q/m has deviated from an appropriate value in normal development. In this case, each of $V_{H1}$ to $V_{H3}$ represents initial charge potential $V_H$, and $V_L$ represents the exposure potential, and also $V_B$ represents the developing bias.

In the case of normal development, the second CPU60 maintains initial charging potential $V_{HI}$, for example, at +750 V in the case where toner charge amount Q/m is an appropriate value under the condition that the toner concentration is maintained to be approximately constant. However, in the case where toner charge amount Q/m becomes larger than the appropriate value and the developing force has been lowered under the condition that the toner concentration is maintained to be approximately constant, development density CD is made to be the appropriate value 1.0 (shown by arrow A1 in FIG. 8 and $V_{H2}$ in FIG. 10) when the electrostatic latent image potential (VH-VL) is made higher by changing initial charging potential $V_{H2}$, for example, to +950 V. In the case where toner charge amount Q/m is smaller than the appropriate value and the development force has been increased, development density CD is made to be the appropriate value 1.0 (shown by arrow A2 in FIG. 8 and $V_{H3}$ in FIG. 10) when the electrostatic latent image potential (VH - VL) is made lower by changing initial charging potential $V_{H3}$, for example, to +550 V. In the aforementioned example, the development bias voltage (DC) is maintained to be constant.

The first CPU50 includes the first counter CT1 to count the number of copies, the second counter CT2 and the third counter CT3. The first counter CT1 counts the number of continuous copies using a detection signal sent from the paper discharge sensor. The second counter CT2 counts the number of copies that indicates the timing at which the electrostatic latent image potential control program is carried out, that is, the second counter CT2 counts the number of overall copies after the previous electrostatic latent image potential control was carried out. Specifically, the electrostatic latent image potential control program is carried out each time 1000 copies are made. The third counter CT3 counts the number of copies that indicates the timing to judge whether or not the image density has returned to a predetermined level when the electrostatic latent image potential control program was carried out, that is, the third counter CT3 counts the number of copies that indicates the timing at which the potential is returned. Specifically, it is judged whether or not the image density has returned to a predetermined level at a point of time when 50 copies has been made after the electrostatic latent image potential control program was carried out. According to the result of the judgment, the electrostatic latent image potential is returned to the initial value. The first, second and third counters CT1, CT2 and CT3 are down-counters, and the number of continuous copies, the number of overall copies and the amount of potential return judgment copies are respectively set on the counters. The aforementioned numbers are counted by the counters, and when the counted value becomes "0", the predetermined number of copies can be provided.

Figure 11:
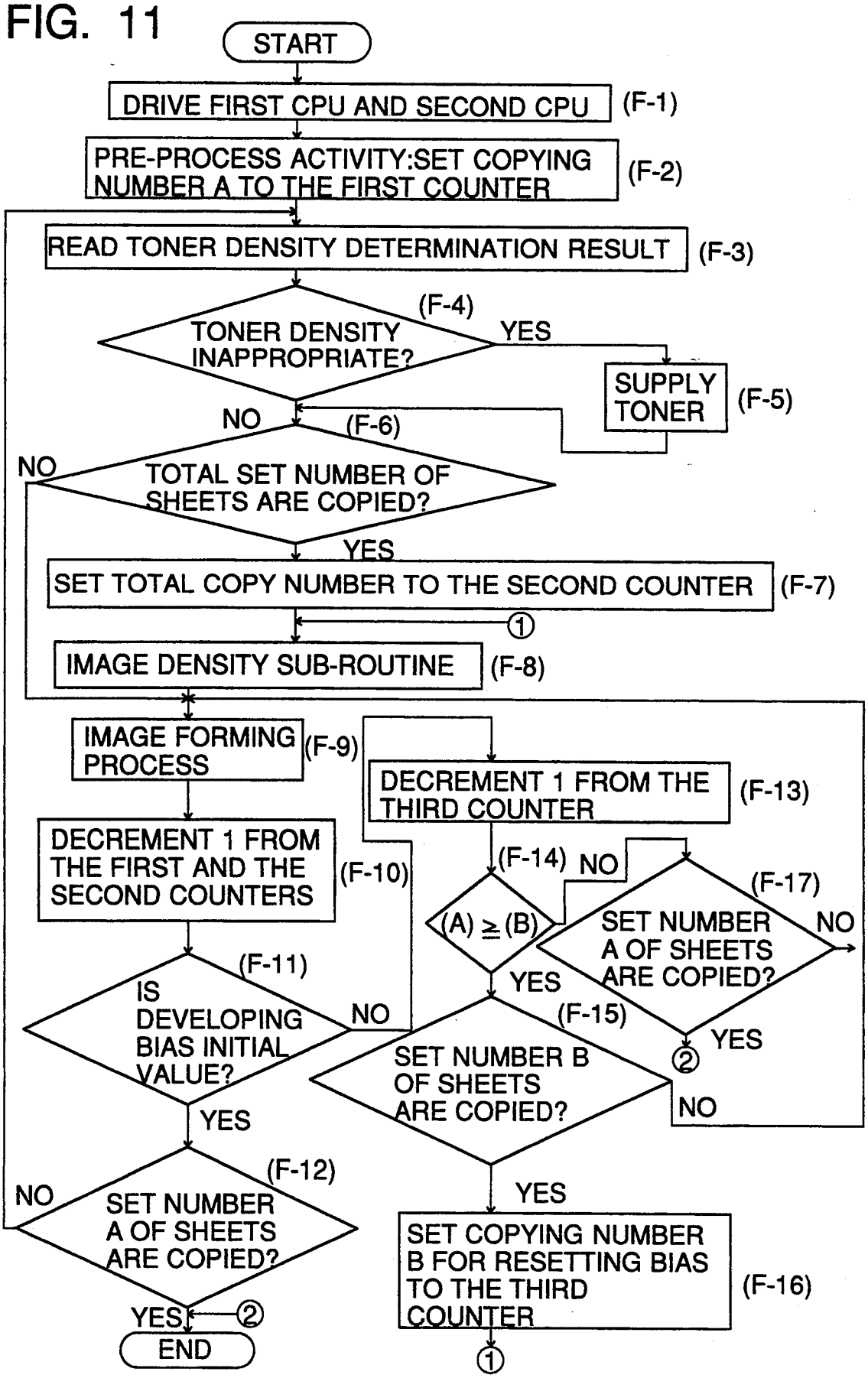
FIG. 11 is a flow chart showing an image recording operation in an image recording apparatus in the second example.
Figure 12:
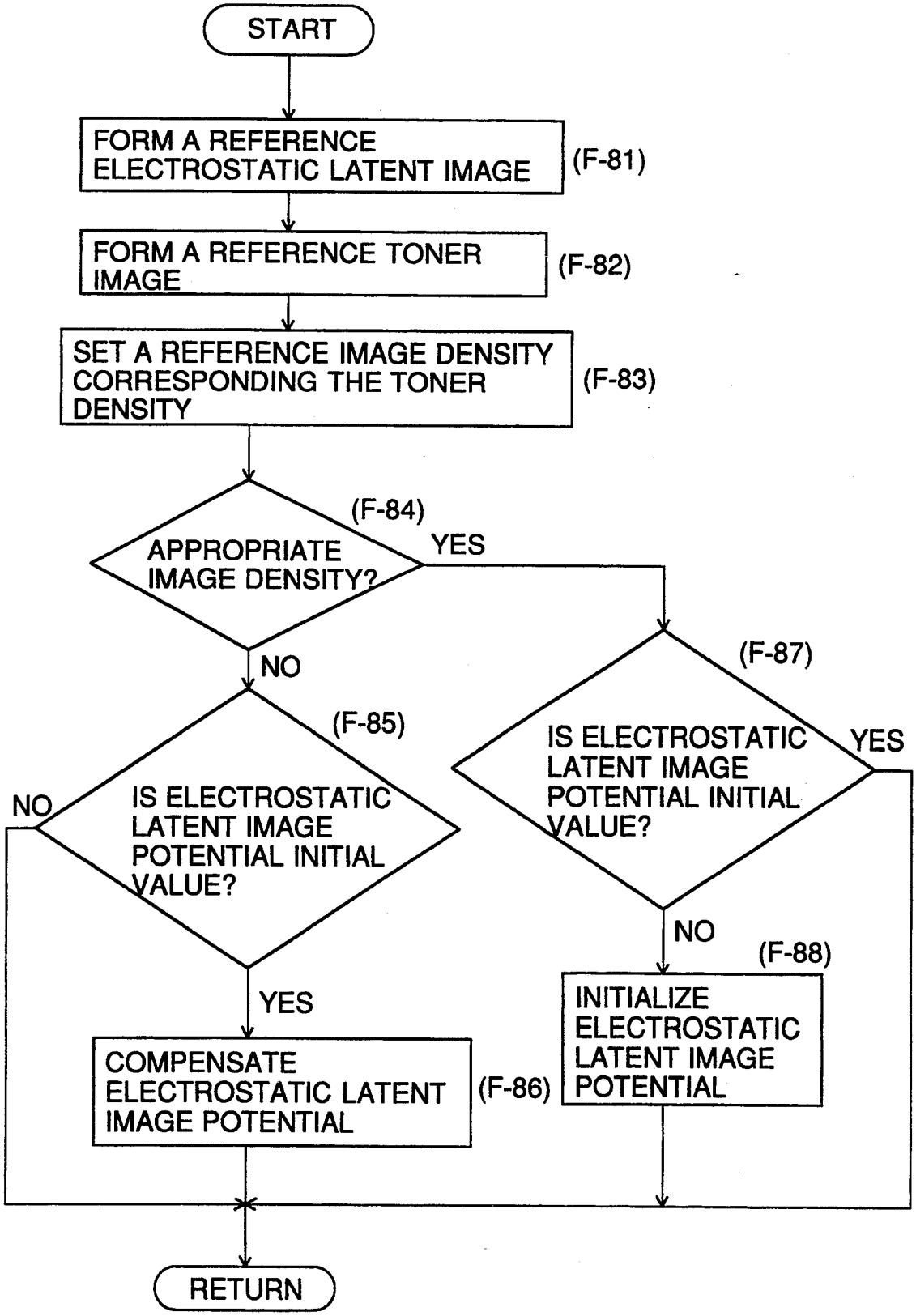
FIG. 12 is a flow chart showing an image density control operation in the image recording apparatus in the second example of the present invention.

Next, with reference to the flow charts shown in FIGS. 11 and 12, the image recording operation of the image recording apparatus of the invention will be explained as follows. FIG. 11 shows a main flow to be carried out by the first CPU50 illustrated in FIG. 7. FIG. 12 is an electrostatic latent image potential control flow to be carried out by the second CPU60.

When a main switch (not shown) is pressed, electrical power is supplied to the apparatus. As a result, the first CPU50 and the second CPU60 are started (step F-1 in FIG. 11).

The first CPU50 drives the first motor driver 10, so that the main motor is started. The first and second stirring rollers 20*e* and 20*f* of the developing unit 20 are connected with this drive system so as to stir the 2-component developer. Temperature of the heater of a fixing unit (not shown) is raised to a predetermined value. Also, the first CPU50 conducts the preprocessing as follows: the photoreceptor drum 1 connected with the main motor drive system is driven; and the photoreceptor drum 1 is repeatedly charged and discharged by the charger 41 and discharger (not shown) so that the process conditions for image formation are adjusted. In the preprocessing, the number A of continuous copies, which has been set by an operator through operating a predetermined button, is set on the first counter CT1 (step F-2).

As described before, the second CPU judges in accordance with the toner concentration judging program whether or not the toner concentration detection signal sent from the toner concentration detection means 163 has become not more than a predetermined value of 5 wt %. In the case where it is not more than 5 wt %, a toner concentration NG signal is transmitted from the second CPU60 to the toner concentration judgment result register R1, and in the case where it is more than 5 wt %, a toner concentration OK signal is transmitted to the toner concentration judgment result register R1.

Then, the first CPU50 reads out a signal that has been set in toner concentration judgment result register R1 (step F-3), and it is judged whether the signal is a toner concentration NG signal or not (step F-4). When it is a toner concentration NG signal, toner is supplied (step F-5), and the program advances to step (F-6). On the other hand, when it is a toner concentration OK signal, the program immediately advances to step (F-6), and when it is judged whether or not the counted value on the second counter CT2 is "0", it is judged whether or not the number of overall copies relating to the counted value setting has reached 1000. When the number of overall copies has not reached 1000, the program advances to step (F-9). When the number of overall copies has reached 1000, the first CPU50 sets the number "1000", which is the setting value of the number of overall copies, on the second counter CT2 (step F-7), and the image density control interruption is generated, so that an image density control command signal is outputted into the second CPU60 (step F-8).

In response to the image density control command signal sent from the first CPU50, the second CPU60 starts the optical scanning system 54 and turns on the light source so that the reference density plate is irradiated with light. Reflected light is sent onto the photoreceptor drum 1 through the first and second mirrors so as to form a reference electrostatic latent image (step F-8 in FIG. 12). Then, the developing unit 20 is driven so that the reference electrostatic latent image can be visualized into a toner image. In this way, a reference toner image is formed (step F-82). Next, the second CPU60 reads out reference image density CD corresponding to a toner concentration detection signal sent from the toner concentration detection means 63, from the first lookup table T1, and the obtained reference image density CD is set in the reference image density register R2 (step F-83).

Actual optical image density is taken in from the optical image density measurement means 161 and compared with the reference image density held in reference image density register R2 so as to judge whether it agrees with the reference image density or not (step F-84). When it does not agree with the reference image density, it is judged whether or not the electrostatic latent image potential is an initial value (step F-85). When it is an initial value, that is, when the electrostatic latent image potential has not been changed, a changing amount of the electrostatic latent image potential corresponding to the actual optical image density (development density CD shown in FIG. 8) is read out from the second lookup table T2 (step F-86). In accordance with the changing amount, the electrostatic latent image potential is changed (step F-87) and the program is returned. The electrostatic latent image potential is changed in the following manner: initial charging potential $V_H$ of the photoreceptor drum 1 is adjusted when the high voltage power supply 40 and the charger 41 are controlled; the amount of irradiating light is adjusted by CVR54*a* and semiconductor laser 4*b*; and the development bias is adjusted by the development bias circuit 162. The detail will be explained later.

In the case where the electrostatic latent image potential is not the initial value, the circumstances are as follows: although the electrostatic latent image potential has been changed, the actual optical image density has not recovered to the reference image density. These circumstances will be explained later. In this case, the program routine immediately returns.

When it has been judged that the actual optical image density and the reference image density coincide with each other, it is judged whether the electrostatic latent image potential is the initial value or not (step F-88). In the case where the electrostatic latent image potential is not the initial value, it means that the actual optical image density has recovered to the reference image density when the electrostatic latent image potential has been changed. Therefore, the electrostatic latent image potential is returned to the initial value (F-89), and the program is returned. On the other hand, in the case where the electrostatic latent image potential is the initial value, the actual optical image density initially coincides with the reference image density. Therefore, it is not necessary to change the electrostatic latent image potential, so that the program routine returns .

Then, the first CPU50 carries out the image forming process in accordance with the image forming program (step F-9 shown in FIG. 11). After that, the counted value of the number of continuous copies on the first counter CT1 is subtracted by 1, and also the counted value of the number of continuous copies on the second counter CT2 is subtracted by 1 (step F-10), and it is judged whether the electrostatic latent image potential is the initial value or not (step F-11). In the case where the electrostatic latent image potential is the initial value, it is judged whether or not the counted value of the number of continuous copies on the first counter CT1 is "0". As a result of the foregoing, it is judged whether or not the number of copies has reached the number A of continuous copies relating to setting (step F-12). In the case where the counted value on the first counter CT1 is "0" and the number of copies has reached the number A of continuous copies, the program is completed. On the other hand, in the case where the number of copies has not reached the number A, the program returns to step (F-3) so that the necessary number of copies can be made.

When electrostatic latent image potential is judged not to be an initial value in Step (F-11), namely when the electrostatic latent image potential is compensated by Second CPU60 and is not reset to the initial value thereafter, decrement of 1 from copying number B for resetting potential on Third Counter CT3 is made (Step F-13). Then, countdown value (A) of copying number A on First Counter CT1 is judged whether it is not less than count down value (B) of copying number B for resetting potential on the Third Counter CT3 or not (Step F-14). When the result of the judgment shows that the count down value (A) of the copying number A is not less than the countdown value (B) of the copying number B for resetting potential on the Third Counter CT3, a judgment is formed whether or not the copies in quantity of the copying number B for resetting potential related to setting have been completed (Step F-15) through a judgment whether or not the countdown value (B) of the copying number B for resetting potential on the Third Counter CT3 is "0". When the result of the judgment shows that the number of copies made has not reached the copying number B for resetting potential, the sequence returns to Step (F-9) because it is apparent that the set copying number A has not been completed.

On the other hand, when the count down value (B) on the Third Counter CT3 is "0" and the copying number B for resetting potential related to setting has been completed, the copying number B for resetting potential is set on the Third Counter CT3 (Step F-16). Then, the sequence returns to Step (F-8) for causing the compensated developing bias to return to its initial value.

In the step (F-14), when the countdown value (A) for copying number A is judged to be smaller than the countdown value (B) for copying number for resetting potential B, the copying number A related to setting is judged whether it has been completed or not (step F-17) through judgment whether the countdown value (A) for copying number A on the first counter CT1 is "0" or not. If the result of the judgment shows that the copying number A has not been completed, the sequence goes back to step (F-9) for completing the copying number A. On the other hand, when the countdown value (A) on the first counter CT1 is "0" and the copying number A related to setting has been completed, the sequence ends. In this case, the sequence ends with electrostatic latent image potential remaining unchanged to its initial value. In the succeeding continuous copying, however, the electrostatic latent image potential is reset to its initial value because processes of step (F-13) and thereafter are executed through step (F-11).

Resetting of electrostatic latent image potential to its initial value in step (F-88) in FIG. 12 has the following meaning. Namely, as explained above, the first CPU50 executes an image forming process after the electrostatic latent image potential is compensated by the second CPU60. When copying is continued for a while with the electrostatic latent image potential compensated to the lower level, developability sometimes becomes too high. Under such conditions, toner having higher toner potential in two-component developer is consumed, and fresh toner supply is started. After compensation of electrostatic latent image potential, therefore, a reference toner image is prepared by executing an image density control program when the predetermined copying number (for example, 50 sheets) has been completed, and when an optical image density is returned to solid line A or the neighborhood thereof, the electrostatic latent image potential is returned to its original proper value .

Next, an operation for controlling electrostatic latent image potential in FIG. 12 conducted by second CPU60 in the case of regular development will be explained concretely. In the case of this example, photoreceptor drum 1 is made of SeTe, and a developer used is a two-component developer (toner concentration 4.5 (wt %) ±0.4 (wt %)) composed of an insulating magnetic coating carrier having a particle size of 80 μm and a toner having a particle size of 10 μm. Optical scanning unit 54 is equipped with a halogen lamp as a light source which can be adjusted in terms of irradiating amount by CVR54*a*. Developing bias contains only DC components and it is fixed at exposure portion potential $V_L = +50$ (V) and developing bias $V_B = +150$ (V), and irradiating intensity of a halogen lamp and initial charging voltage $V_H$ are adjusted.

In the comparative calculation in step (F-84) shown in FIG. 12, when reference image density data held in reference image density register R2 is almost the same as actual image data obtained from optical image density measuring means 161, toner charge amount Q/m in two-component developer contained in developing unit 20 is an optimum value of −22 (μc/g), and electrostatic latent image potential ($V$-$V_L$) at developing density CD=1.0 is +700 (V) as shown in FIG. 9. This condition means that it is on a locus shown with solid line A in FIG. 8 or it is in the vicinity thereof. In this case, it is possible to form toner images of toner particles on photoreceptor drum 1 effectively and clearly. Namely, sufficient image density having a broad range between 0 and 1.2 is obtained and makes adhering force of the toner to photoreceptor drum 1 to be appropriate. Therefore, clear images having no image offset can be made in the subsequent image forming process. Accordingly, it is not necessary to adjust electrostatic latent image potential ($V_H$-$V_L$), and electrostatic process conditions corresponding to developing density CD=1.0 including initial charge potential $V_{H1} = +750$ (V), exposure portion potential $V_L = +50$ (V) and developing bias $V_B = +150$ (V) are maintained as they are.

In the comparative calculation in step (F-84), however, when actual image density is much lower than the reference image density, toner charge amount Q/m is presumed to be about −28.5 (μc/g) that is greater than the optimum value of −22 (μc/g). For example, the toner charge amount is presumed to be on a locus shown with one-dot chain line B in FIG. 8, which makes it impossible to obtain sufficient image density and contrast unless the electrostatic image potential is enhance to be higher.

Due to the background mentioned above, second CPU60 enhances electrostatic latent image potential ($V_H$-$V_L$) for elevating developing power by controlling high voltage power supply 40 and irradiating amount control means CVR54*a*. To be concrete, electrostatic process conditions corresponding to developing density CD=1.0 are adjusted so that they satisfy initial charge potential $V_{H2}=+950$ (V), latent image potential $V_L=+50$ (V) and developing bias $V_B=+150$ (V) as shown in FIG. 10, and then electrostatic latent image potential ($V_H$-$V_L$) is enhanced to +900 V. This elevates the developing power and one-dot chain line B in FIG. 8 is regarded to be corrected to trace the solid line A. Therefore, it is possible to obtain sufficient image density and contrast which reflect images on a document.

Further, when actual image density is much higher than the reference image density in the comparative calculation in step (F-84), a toner charge amount is presumed to be −18 (μc/g) that is smaller than the optimum value of −22 (μc/g). For example, the toner charge amount is presumed to be on a locus shown with one-dot chain line C in FIG. 8, which makes it impossible to reproduce images in high fidelity due to the image density that is too high.

Second CPU60, therefore, enhances developing power by lowering electrostatic latent image potential ($V_H$-$V_L$). To be concrete, electrostatic process conditions corresponding to developing density CD=1.0 are adjusted so that they satisfy initial charge potential $V_{H3}=+550$ (V), exposure portion potential $V_L=+50$ (V) and developing bias $V_B=+150$ (V) as shown in FIG. 10, and then electrostatic latent image potential ($V_H$-$V_L$) is lowered to +500 V. Owing to the foregoing, broken line C in FIG. 8 is regarded to be corrected to trace a locus shown with solid line A, and it is possible to obtain sufficient image density and contrast which reflect a document image.

In this case, however, problems such as image offset and others take place. Therefore, second CPU60 sends a command to first CPU50, instructing the first CPU50 to conduct sufficient agitation inside developing unit 20. After sufficient agitation inside developing unit 20 through control of the first CPU50, the above-mentioned electrostatic latent image potential may be compensated again.

In the present example, when image density is lowered or raised even when toner concentration is kept almost constantly at a predetermined value, it is possible to adjust developing power by detecting the aforementioned change in image density and thereby controlling electrostatic process conditions to predetermined values as explained above, which means a correction to a locus shown with solid line A in FIG. 8. Therefore, it is possible to obtain sufficient image density and contrast which reflect a document image.

Further, even in the case of appropriate conditions including initial charge potential $V_H=+800$ (V), exposure portion potential $V_L=+100$ (V), developing bias $V_B=+250$ (V) and toner concentration 5.5 (wt %) ±0.5 (wt %) in the course of regular development employing developer composed of insulating magnetic coating carrier having a particle size of 65 μm and toner having a particle size of 8 μm, the same effect as in the foregoing was obtained by controlling at initial charge potential $V_H=+950$ (V), exposure portion potential $V_L=+50$ (V) and developing bias $V_B=+200$ (V) when image density is too low, and by controlling at initial charge potential $V_H=600$ (V), exposure portion potential $V_L=+100$ (V) and developing bias $V_B=+300$ (V) when image density is too high on the contrary.

Next, controlling operation for electrostatic latent image potential in FIG. 12 conducted by second CPU60 in the course of reversal development will be explained concretely as follows. In this case, photoreceptor drum 1 is an OPC photoreceptor, developer to be used is composed of coating carrier having a particle size of 40 μm and toner having a particle size of 8.5 μm, and toner concentration is regulated to be kept at 7.5 (wt %) ±0.5 (wt %). In this example, developing bias contains only DC components, to which the invention is not limited and AC components may also be superimposed.

Figure 13:
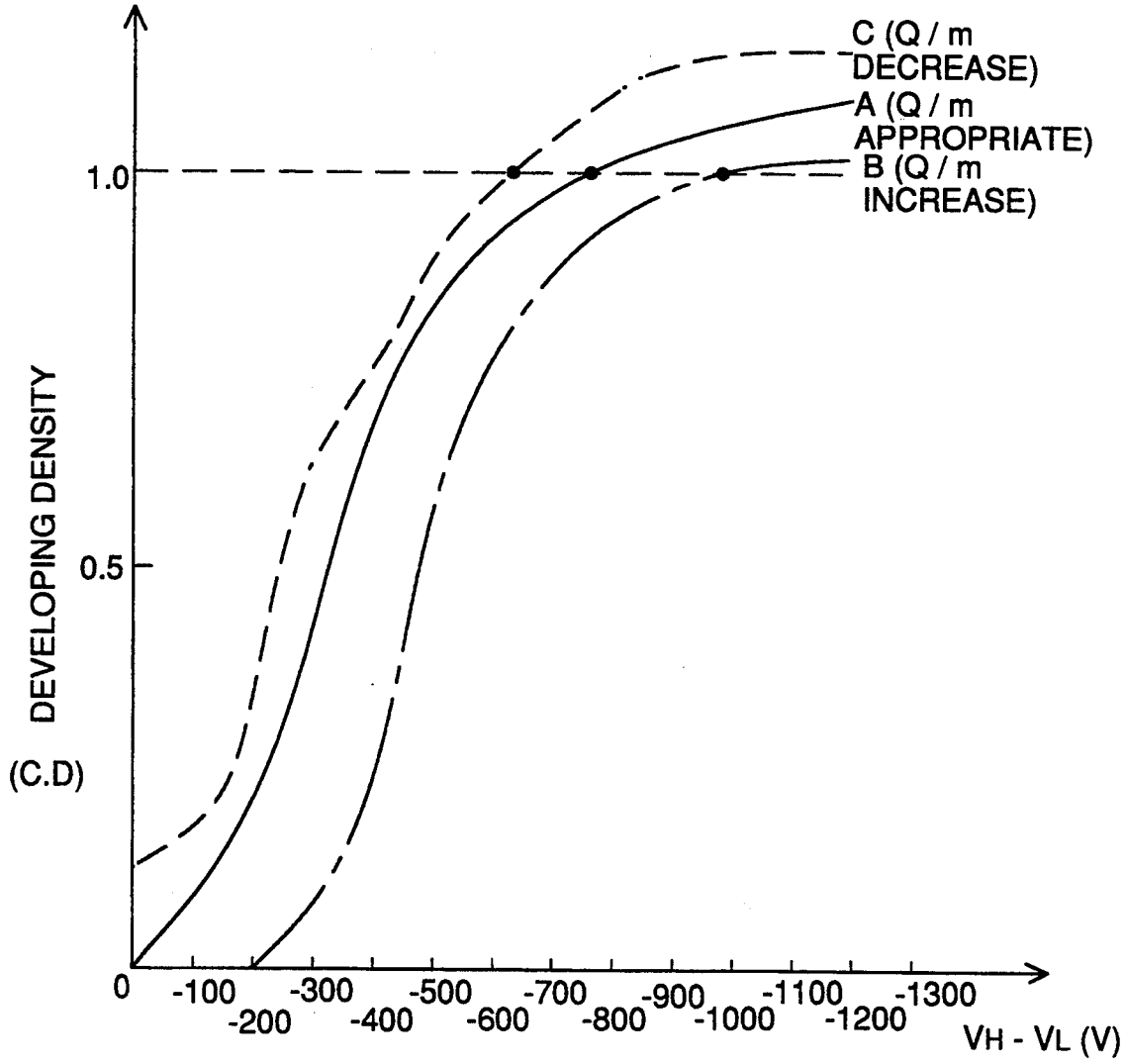
FIG. 13 is a graph showing a relation between the developed image density and the electrostatic latent image potential in reversal development.

FIG. 13 is a diagram showing relation between developing density (CD) in the reverse development and electrostatic latent image potential ($V_H$-$V_L$).

In FIG. 13, only difference from what is shown in FIG. 2 is that the value of electrostatic latent image potential ($V_H$-$V_L$) is negative due to each negative value of initial charge potential $V_H$, exposure portion potential $V_L$ and developing bias $V_B$ caused by the reversal developing method. Namely, except for the foregoing, what is shown in FIG. 13 is the same as the regular development shown in FIG. 2. Therefore, details in FIG. 13 will be omitted.

Figure 14:
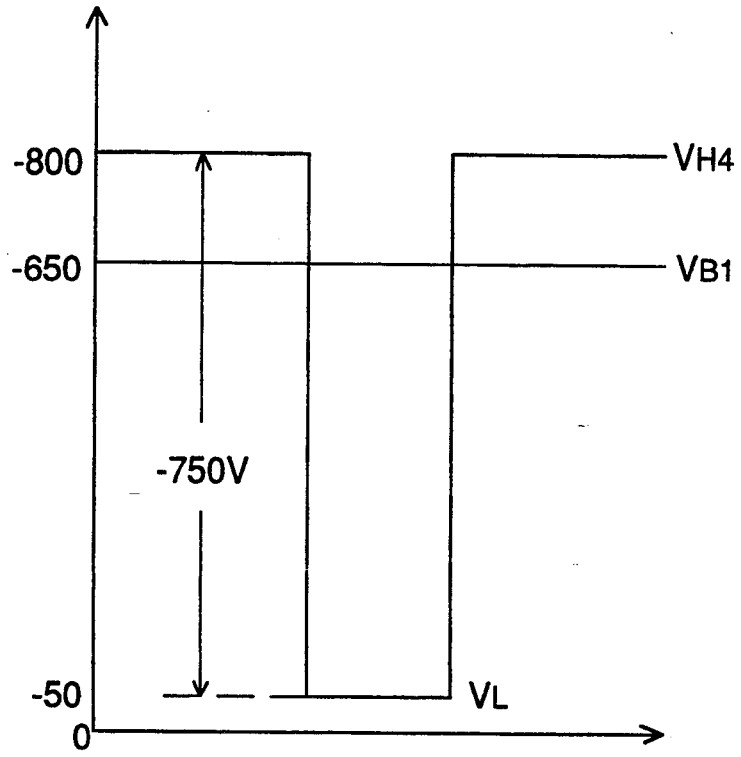
FIG. 14 is a graph showing the initial value of the electrostatic process condition in reversal development.
Figure 15:
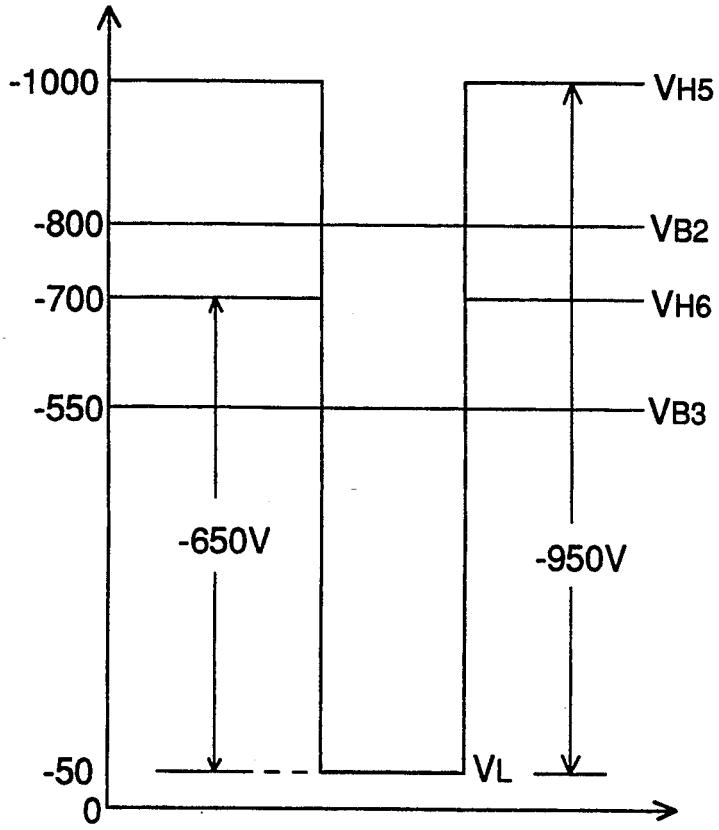
FIG. 15 is a graph showing an example in which the electrostatic process condition is changed in reversal development.

FIG. 14 is a diagram showing electrostatic latent image potential corresponding to optimum toner charge amount Q/m in the reversal development, and FIG. 15 is a diagram showing electrostatic latent image potential compensated for the value of toner charge amount Q/m that is deviated from the optimum value in the reversal development.

In the case of the foregoing, each of $V_{H4}$-$V_{H6}$ represents initial charge potential $V_H$, while $V_L$ represents exposure portion potential and $V_{B1}$-$V_{B3}$ represent developing bias. In this example, electrostatic latent image potential ($V_H$-$V_L$) is adjusted by fixing the exposure portion potential $V_L$ at −50 (V) and by adjusting irradiating amount of semiconductor laser **54*b***, initial charge potential $V_H$ and developing bias $V_B$.

Incidentally, as a method for adjusting irradiating amount of semiconductor laser **54*b*, an intensity modulation method and a pulse width modulation method are available. In the intensity modulation method which will be explained first, output value LD of the semiconductor laser 54*b*** is set initially to 1.2 mW.

In the comparative calculation in step (F-84) shown in FIG. 12, when reference image data held in reference image density register R2 is almost the same as actual image data obtained from optical image density measuring means 61, toner charge amount Q/m in two-component developer contained in developing unit 20 is an optimum value of −25 (μc/g), and electrostatic latent image potential ($V_H$-$V_L$) at developing density CD=1.0 is −750 (V) as shown in FIG. 14. This condition means that it is on a locus shown with solid line A in FIG. 13 or it is in the vicinity thereof. In this case, it is possible to form toner images of toner particles on photoreceptor drum 1 effectively and clearly. Namely, sufficient image density having a broad range between 0 and 1.2 is obtained and makes adhering force between photoreceptor drum 1 and toner to be appropriate. Therefore, clear images having no image ship can be made in the subsequent image forming process. Accordingly, it is not necessary to adjust electrostatic latent image potential ($V_H$-$V_L$), and electrostatic process conditions corresponding to developing density CD=1.0 including initial charge potential $V_{H4}=-800$ (V), exposure portion potential $V_L=-50$ (V) and developing bias $V_{B1}=-650$ (V) are maintained as they are shown in FIG. 14, output value LD=1.2 mW of semiconductor laser **54*b*** is kept as it is.

In the comparative calculation in step (F-84), however, when actual image density is much lower than the reference image density, toner charge amount Q/m is presumed to be greater than the optimum value of −25 (μc/g). For example, the toner charge amount is presumed to be on a locus shown with one-dot chain line B in FIG. 13, which makes it impossible to obtain sufficient image density and contrast unless the electrostatic image potential is enhance to be higher.

Due to the background mentioned above, second CPU60 enhances electrostatic latent image potential ($V_H$-$V_L$) for elevating developing power by controlling high voltage power supply 40, semiconductor laser 54*b* and developing bias circuit 162 . To be concrete, electrostatic process conditions corresponding to developing density CD=1.0 are adjusted so that they satisfy initial charge potential $V_{H5}=-1000$ (V), exposure portion potential $V_L=-50$ (V), developing bias $V_{B2}=-800$ (V) and output value LD=1.5 mW as shown in FIG. 15, and then electrostatic latent image potential ($V_H$-$V_L$) is enhanced to −950 V. This elevates the developing power and one-dot chain line B in FIG. 8 is regarded to be corrected to trace the solid line A. Therefore, it is possible to obtain sufficient image density and contrast which reflect a document image.

Further, when actual image density is much higher than the reference image density in the comparative calculation in step (F-84), a toner charge amount is presumed to be smaller than the optimum value of −25 (μc/g). For example, the toner charge amount is presumed to be on a locus shown with one-dot chain line C in FIG. 8 (−18 (μc/g)), which makes it impossible to reproduce images in high fidelity due to the image density that is too high.

Second CPU60, therefore, enhances developing power by lowering electrostatic latent image potential ($V_H$-$V_L$). To be concrete, electrostatic process conditions corresponding to developing density CD=1.0 are adjusted so that they satisfy initial charge potential $V_{H6}=-700$ (V), exposure portion potential $V_L=-50$ (V), developing bias $V_{B3}=-550$ (V) and output value LD=1.0 mW as shown in FIG. 15, and then electrostatic latent image potential ($V_H$-$V_L$) is lowered to −650 V. Owing to the foregoing, broken line C in FIG. 13 is regarded to be corrected to trace a locus shown with solid line A, and it is possible to obtain sufficient image density and contrast which reflect a document image.

In this case, however, problems such as image offset and others take place. Therefore, second CPU60 sends a command to first CPU50, instructing the first CPU50 to conduct sufficient agitation inside developing unit 20. After sufficient agitation inside developing unit 20 through control of the first CPU50, the above-mentioned electrostatic latent image potential ($V_H$-$V_L$) may be compensated again.

An example for controlling electrostatic latent image potential utilizing a pulse width modulation method in the reversal development will be explained, next. Before that, however, the pulse width modulation method will be explained as follows.

Figure 16:
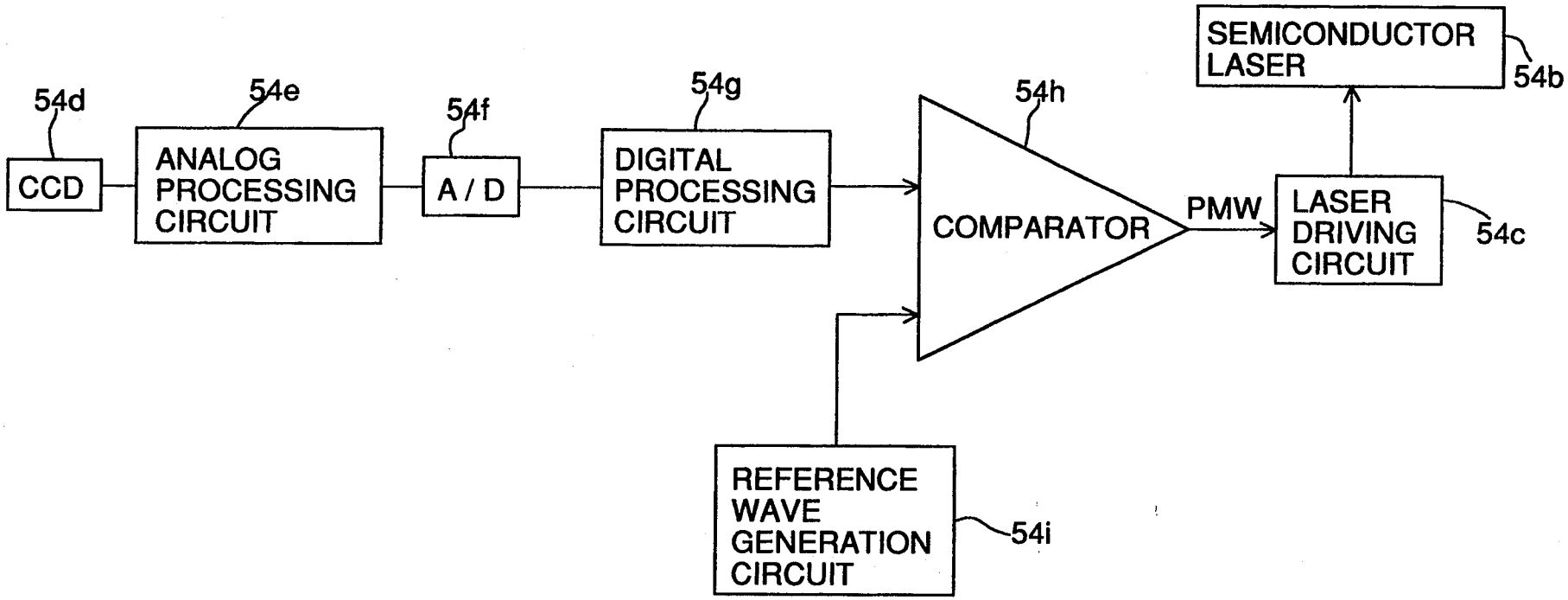
FIG. 16 is a block diagram showing the structure of an optical scanning system in which a pulse width modulation method is used.

When the pulse width modulation method is conducted, optical scanning unit 54 is equipped with a circuit shown in FIG. 16 and semiconductor laser 54*b* is driven by laser drive circuit 54*c*. After optical image data reflecting document information enter CCD54*d*, photoelectric conversion of the optical image data is performed in the CCD54*d*. The electric image data thus obtained are read by analogue processing circuit 54*e* and then are subjected to shading correction. After the shading correction, the image data are subjected to A/D conversion by means of A/D converter 54*f*. Then, the image data are subjected to gamma correction and edge emphasis by means of digital processing circuit 54*g* and inputted in comparator 54*h*.

Reference wave generating circuit 54*i*, on the other hand, generates a triangular wave with a predetermined frequency, and this triangular wave is inputted in comparator 54*h* as a reference wave. Then, the comparator 54*h* prepares, based on the inputted electric image data and the reference wave, pulse width modulation signals PWM and inputs them in laser drive circuit 54*c*. After that, the laser drive circuit 54*c* controls, based on the pulse width modulation signals PWM, the light amount of semiconductor 54*b*, namely, a size (an area of a latent image) of each dot exposure portion corresponding to image density CD=1.0.

Comparator 54*h* takes a pulse width corresponding to a truncated width obtained by truncating a reference wave horizontally at a predetermined level as pulse width modulation signal PWM corresponding to image density CD=1.0, when preparing pulse width modulation signal PWM based on inputted electric image data and a reference wave. In this case, the pulse width modulation signal PWM corresponding to image density CD=1.0 can be changed by altering a truncation level of the reference wave corresponding to image density CD =1.0.

Figure 17:
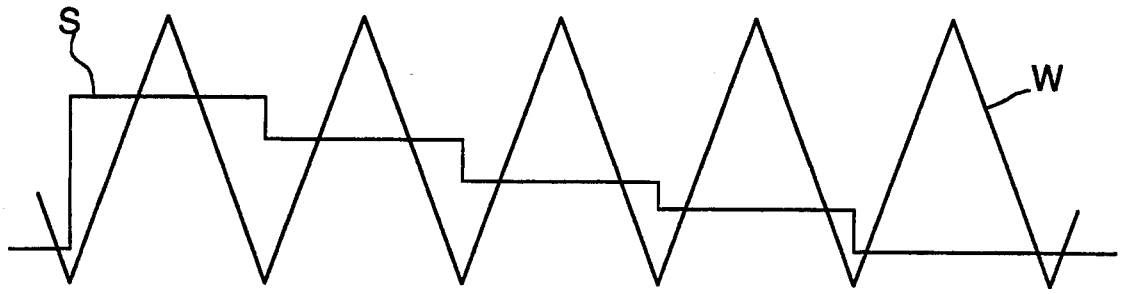
FIGS. 17(*a*) and 17(*b*) are schematic illustrations for explaining the principle of the pulse width modulation method.
Figure 17:
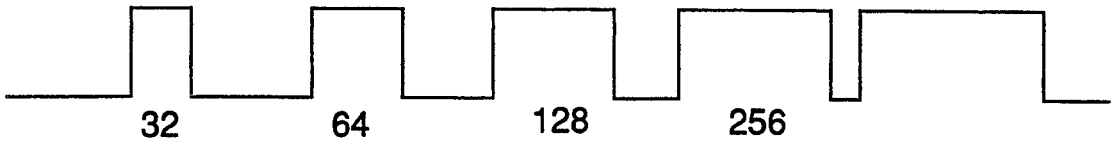

Namely, when the truncation level S for truncating the reference wave W is lowered gradually as shown in FIG. 17(*a*), a truncation width of the reference wave W is broadened gradually as shown in FIG. 17(*b*). Incidentally, values shown in FIG. 17(*b*) represent those each of which is an 8-bit expression of a truncation width. When the truncation width is extended, image density is heightened because a reference value of pulse width modulation signal PWM corresponding to image density CD=1.0 is increased and a latent image area is broadened. On the contrary, when the truncation width is shortened, image density is .Lowered because a reference value of pulse width modulation signal PWM corresponding to image density CD=1.0 is decreased and a latent image area is narrowed.

In the second example, therefore, when electrostatic latent image potential ($V_H$-$V_L$) was initialized to be −750 V as shown in FIG. 14, truncation width W=128 was taken, when the electrostatic latent image potential was caused to be −950 V as shown in FIG. 15, slice width W=256 was taken, and when the electrostatic latent image potential was caused to be −650 V, truncation width W=64 was taken. Incidentally, even when other electrostatic process conditions such as initial charge potential $V_H$, exposure portion potential $V_L$, developing bias $V_B$ and others were caused to be the same as those in the intensity modulation method, the same effect was obtained. In addition to the foregoing, it is more effective to control electrostatic latent image potential by using the intensity modulation method and the pulse width modulation method in combination.

The invention is not limited to the above-mentioned second example, and various methods including one wherein toner concentration control and electrostatic latent image potential control are conducted by only one CPU may be employed.

As explained above, an image recording apparatus in the second example of the invention makes it possible, when image density is lowered or heightened despite toner concentration kept at a predetermined value constantly, to reproduce an image at proper density by detecting the lowered or heightened image density and controlling electrostatic processing conditions to predetermined values.

Next, image recording operation of an image recording apparatus in the third example of the invention will be explained as follows, referring to flowcharts in FIGS. 18 and 19. Incidentally, FIG. 18 represents a main flow to be executed by the first CPU50, while FIG. 19 represents a flow of developing bias control executed by the first CPU50.

Figure 18:
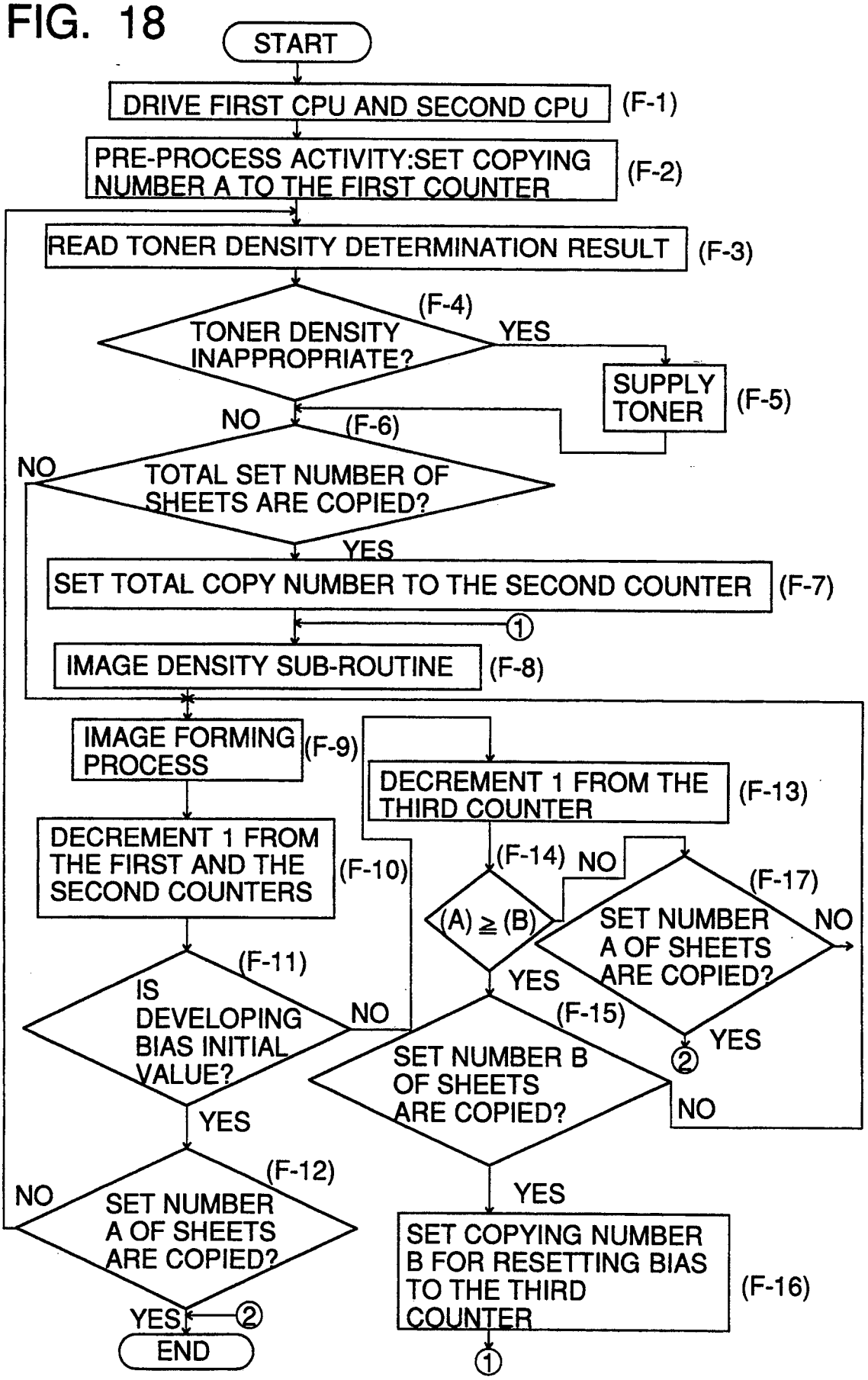
FIG. 18 is a flow chart showing an image recording operation in the image recording device of the third example.
Figure 19:
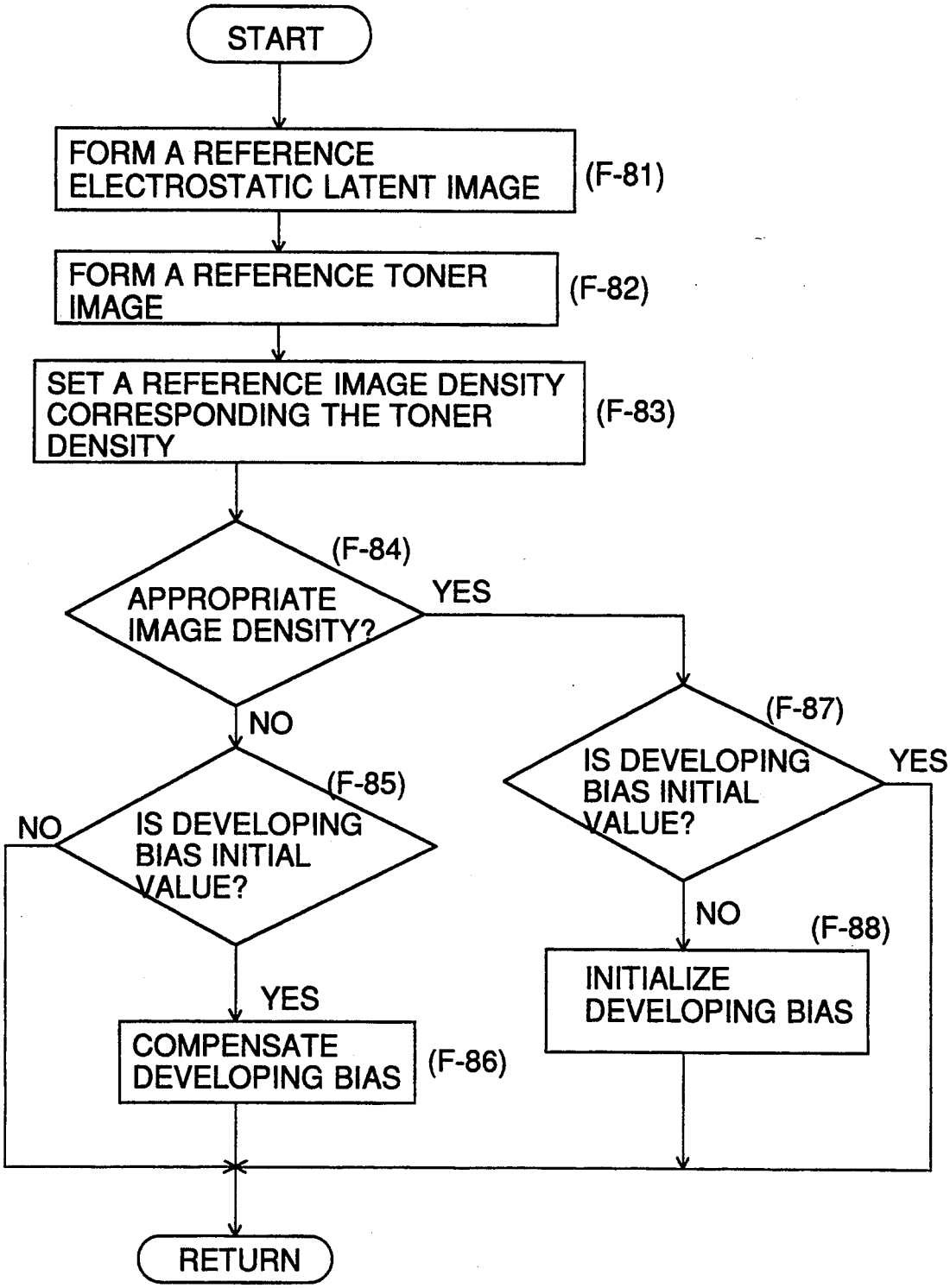
FIG. 19 is a flow chart showing an image density control operation in the image recording apparatus of the third example.
Figure 20:
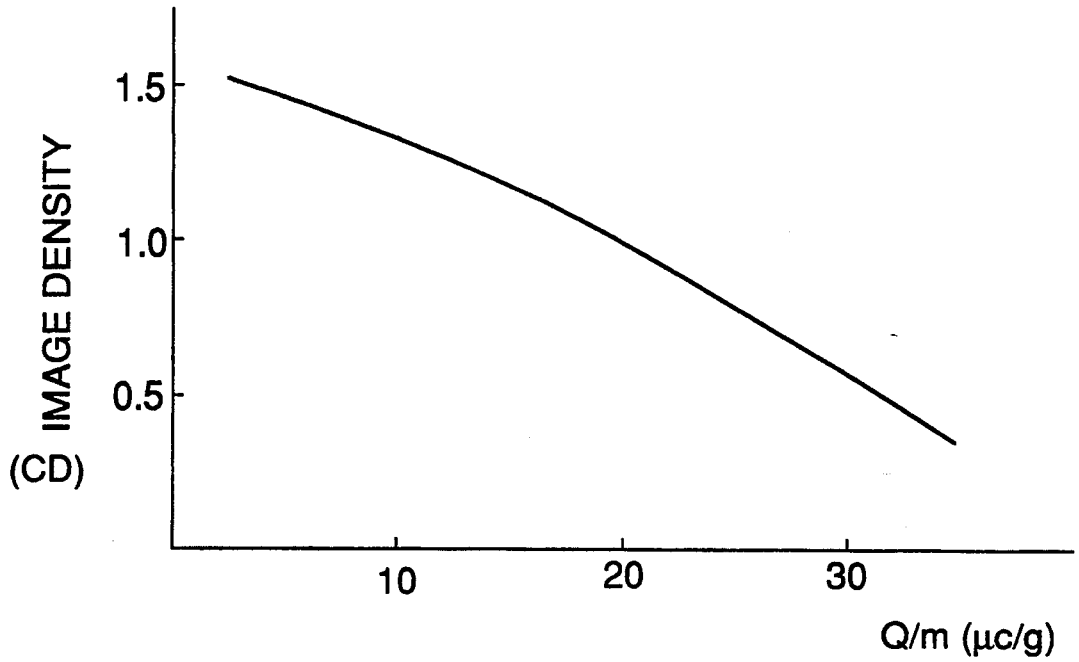
FIG. 20 is a graph showing a change in the image density with respect to the toner concentration (wt %: weight mixing ratio in 2-component developer provided in a developing unit.

Pressing a main switch (not illustrated) causes power supply which starts the first CPU50 and the second CPU60 (step F-1 in FIG. 18).

The first CPU50 drives the first motor driver 10, so that the main motor is started. The first and second stirring rollers 20*e* and 20*f* of the developing unit 20 are connected with this drive system so as to stir the 2-component developer. Temperature of the heater of a fixing unit is raised to a predetermined value. Also, the first CPU50 conducts the preprocessing as follows: the photoreceptor drum 1 connected with the main motor drive system is driven; and the photoreceptor drum 1 is repeatedly charged and discharged by the charger 41 and discharger (not shown) so that the process conditions for image formation are adjusted. In the preprocessing, the number A of continuous copies, which has been set by an operator through operating a predetermined button, is set on the first counter CT1 (step F-2).

Incidentally, second CPU60 constantly judges, based on a toner concentration judgment program, whether or not the toner concentration detection signal from toner concentration detection means 163 is a set value of 5 (wt %) or less as explained above, and the second CPU60 sends to toner concentration judgment result register R1 of the first CPU50 the toner concentration NG signals when the toner concentration detection signal is not more than 5 (wt %) and the toner concentration OK signals when the toner concentration signal exceeds 5 (wt %).

Then, the first CPU50 reads out a signal that has been set in toner concentration judgment result register R1 (step F-3), and it is judged whether the signal is a toner concentration NG signal or not (step F-4). When it is a toner concentration NG signal, toner is supplied (step F-5), and the program advances to step (F-6). On the other hand, when it is a toner concentration OK signal, the program immediately advances to step (F-6), and when it is judged whether or not the counted value on the second counter CT2 is "0", it is judged whether or not the number of overall copies relating to the counted value setting has reached 1000. When the number of overall copies has not reached 1000, the program advances to step (F-9). When the number of overall copies has reached 1000, the first CPU50 sets the number "1000", which is the setting value of the number of overall copies, on the second counter CT2 (step F-7), and the image density control interruption is generated, so that an image density control command signal is outputted into the second CPU60 (step F-8).

In response to the image density control command signal sent from the first CPU50, the second CPU60 starts the optical scanning system 54 and turns on the light source so that the reference density plate is irradiated with light. Reflected light is sent onto the photoreceptor drum 1 through the first and second mirrors so as to form a reference electrostatic latent image (step F-8 in FIG. 19). Then, the developing unit 20 is driven so that the reference electrostatic latent image can be visualized into a toner image. In this way, a reference toner image is formed (step F-82). Next, the second CPU60 reads out reference image density CD corresponding to a toner concentration detection signal sent from the toner concentration detection means 63, from lookup table T, and the obtained reference image density CD is set in the reference image density register R2 (step F-83).

Actual optical image density is taken in from the optical image density measurement means 161 and compared with the reference image density held in reference image density register R2 so as to judge whether it agrees with the reference image density or not (step F-84). When it does not agree with the reference image density, it is judged whether or not developing bias of developing bias circuit 162 is an initial value (step F-85). When it is an initial value, that is, when the developing bias has not been changed, the developing bias is changed by adjusting developing bias circuit 162 (step F-86), and the sequence returns. Concrete examples for changing developing bias will be explained later. In the case where the developing bias is not the initial value, the circumstances are as follows: although the developing bias has been changed, the actual optical image density has not recovered to the reference image density. These circumstances will be explained later. In this case, the program is immediately returned.

When it has been judged that the actual optical image density and the reference image density coincide with each other, it is judged whether the developing bias of developing bias circuit 162 is the initial value or not (step F-87). In the case where the developing bias is not the initial value, it means that the actual optical image density has recovered to the reference image density when the developing bias has been changed. Therefore, the developing bias is returned to the initial value (F-88), and the program is returned. On the other hand, in the case where developing bias is the initial value, the actual optical image density initially coincides with the reference image density. Therefore, it is not necessary to change the developing bias, so that the program is returned as it is.

Then, the first CPU50 carries out the image forming process in accordance with the image forming program (step F-9 shown in FIG. 18). After that, the counted value of the number of continuous copies on the first counter CT1 is subtracted by 1, and also the counted value of the number of continuous copies on the second counter CT2 is subtracted by 1 (step F-10), and it is judged whether the developing bias is the initial value or not (step F-11). In the case where the developing bias is the initial value, it is judged whether or not the counted value of the number of continuous copies on the first counter CT1 is "0". As a result of the foregoing, it is judged whether or not the number of copies has reached the number A of continuous copies relating to setting (step F-12). In the case where the counted value on the first counter CT1 is "0" and the number of copies has reached the number A of continuous copies, the program is completed . On the other hand, in the case where the number of copies has not reached the number A, the program returns to step (F-3) so that the necessary number of copies can be made.

When developing bias is judged not to be an initial value in Step (F-11), namely when the developing bias is compensated by Second CPU60 and is not reset to the initial value thereafter, decrement of 1 from copying number B for resetting bias on Third Counter CT3 is made (Step F-13). Then, countdown value (A) of copying number A on First Counter CT1 is judged whether it is not .Less than countdown value (B) of copying number B for resetting bias on the Third Counter CT3 or not (Step F-14). When the result of the judgment shows that the countdown value (A) of the copying number A is not less than the countdown value (B) of the copying number B for resetting bias on the Third Counter CT3, a judgment is formed whether or not the copies in quantity of the copying number B for resetting bias related to setting have been completed (Step F-15) through a judgment whether or not the countdown value (B) of the copying number B for resetting bias on the Third Counter CT3 is "0". When the result of the judgment shows that the number of copies made has not reached the copying number B for resetting bias, the sequence returns to Step (F-9) because it is apparent that the set copying number A has not been completed.

On the other hand, when the countdown value (B) on the Third Counter CT3 is "0" and the copying number B for resetting bias related to setting has been completed, the copying number B for resetting bias is set on the Third Counter CT3 (Step F-16). Then, the sequence returns to Step (F-8) for causing the compensated developing bias to return to its initial value.

In the step (F-14), when the countdown value (A) for copying number A is judged to be smaller than the countdown value (B) for copying number for resetting bias B, the copying number A related to setting is judged whether it has been completed or not (step F-17) through judgment whether the countdown value (A) for copying number A on the first counter CT1 is "0" or not. If the result of the judgment shows that the copying number A has not been completed, the sequence goes back to step (F-9) for completing the copying number A. On the other hand, when the countdown value (A) on the first counter CT1 is "0" and the copying number A related to setting has been completed, the sequence ends. In this case, the sequence ends with developing bias remaining unchanged to its initial value. In the succeeding continuous copying, however, the developing bias is reset to its initial value because processes of step (F-13) and thereafter are executed through step (F-11).

Resetting of developing bias to its initial value in step (F-88) in FIG. 19 has the following meaning. Namely, as explained above, the first CPU50 executes an image forming process after the developing bias is compensated by the second CPU60. When copying is continued for a while with the developing bias compensated to the lower level, developability sometimes becomes too high. Under such conditions, toner having higher toner potential in two-component developer is consumed, and fresh toner supply is started. After compensation of developing bias, therefore, a reference toner image is prepared by executing an image density control program when the predetermined copying number (for example, 50 sheets) has been completed, and when an optical image density is returned to solid line A or the neighborhood thereof, the developing bias is returned to its original proper value.

As is apparent from the above explanation, toner density is constantly monitored and when it is lowered, toner concentration control is conducted immediately, while the developing bias control is conducted at an interval of 1000 copies made. The reason for this is that intermittent control is practically enough sufficiently for the developing bias and toner saving is aimed because toners used for forming a reference toner image is removed by a cleaner which cleans photoreceptor drum 1 to be incapable of being used for ordinary copying.

Next, developing bias control in FIG. 19 conducted by second CPU60 will be explained concretely as follows. In this case, developing bias is one wherein AC bias is superimposed on DC bias which represents an example for adjusting effective values of DC components and AC components with fixed AC frequency. Incidentally, initial charge potential on photoreceptor drum 1 is constant.

In the comparative calculation in step (F-84), when reference image density held in reference density register R is almost the same as actual image density obtained from optical image density measuring means 161, toner charge amount in two-component developer contained in developing unit 20 is optimum, and image density CD and toner concentration $T_c$ are on a locus shown with solid line A in FIG. 21 or in the vicinity thereof. In this case, it is possible to form toner images of toner particles on photoreceptor drum 1 effectively and clearly. Namely, image density of about 0.4–1.2 makes contrast to be broad sufficiently and makes adhering force between photoreceptor drum 1 and toner to be appropriate. Therefore, clear images having no image ship can be made in the subsequent image forming process. Accordingly, it is not necessary to adjust developing bias. Therefore, DC component $V_{DC}=-250$ (V), AC component peak-to-peak voltage $V_{p\text{-}p}=1500$ (V) and AC frequency $f_{AC}=3$ KHz are kept as they are, as stated above.

In the comparative calculation in step (F-84), however, when actual image density is much lower than the reference image density, toner charge amount is presumed to be greater than the optimum value. For example, the toner charge amount is presumed to be on a locus shown with one-dot chain line B in FIG. 21, which makes it impossible to obtain sufficient image density and contrast.

Due to the background mentioned above, second CPU60 enhances developability by controlling developing bias circuit 162 to lower DC component $V_{DC}$ of developing bias and to enhance AC component $V_{AC}$. To be concrete, adjustment is made to obtain DC component $V_{DC}=-100$ (V), AC component peak-to-peak voltage $V_{p\text{-}p}=2000$ (V) and AC frequency $f_{AC}=-3$ KHz. This elevates the developing power, and one-dot chain Line B in FIG. 21 is regarded to be corrected to trace the solid line A. Therefore, it is possible to obtain sufficient image density and contrast which reflect images on a document.

When a toner charge amount exceeds a prescribed range and developing power is lowered accordingly, concurrent boosting of AC bias causes the developing power to be restored promptly as mentioned above. The reason for this is that boosting of peak-to-peak voltage $V_{p\text{-}p}$ of AC component s can improve effectively toner behavior rather than only displacement of DC components.

Further, when actual image density is much higher than the reference image density in the comparative calculation in step (F-84), a toner charge amount is presumed to be smaller than the optimum value. For example, the toner charge amount is presumed to be on a locus shown with one-dot chain line C in FIG. 21, which makes it impossible to reproduce images in high fidelity due to the image density that is too high.

Second CPU60, therefore, lowers developing power by controlling developing bias circuit 162 to enhance DC component $V_{DC}$ of developing bias and to lower AC component $V_{AC}$. To be concrete, adjustment is made to obtain DC component $V_{DC}=-350$ (V), AC component peak-to-peak voltage $V_{p-p}=1200$ (V) and AC frequency $f_{AC}=3$ KHz. Owing to the foregoing, developing power can be lowered, and broken line C in FIG. 21 is substantially compensated to overlap with solid line A. Therefore, it is possible to obtain sufficient image density and contrast which reflect images on a document. In this case, however, problems such as image-repelling and image slip take place in the course of developing, transferring and fixing steps. Therefore, second CPU60 sends a command to first CPU50, instructing the first CPU50 to conduct sufficient agitation inside developing unit 20. After sufficient agitation inside developing unit 20 through control of the first CPU50, the above-mentioned developing bias control may be conducted again.

In the present example, when image density is lowered or raised even when toner concentration is kept almost constantly at a predetermined value, it is possible to adjust developing power by detecting the change and thereby controlling developing conditions to a desired level, which means a correction to a locus shown with solid line A in FIG. 18. Therefore, it is possible to obtain sufficient image density and contrast which reflect a document image.

Further, even in the case of appropriate conditions including initial charge potential $V_H=-600$ (V), AC frequency of 5.0 KHz, peak-to-peak voltage $V_{p-p}=2500$ (V), developing bias $V_{DC}=-500$ (V) and toner concentration of 3.0 (wt %) ±0.2 (wt %) in the course of reversal development employing two-component developer, the same effect as in the foregoing was obtained in the control similar to the foregoing by regulating to AC frequency of 4.0 KHz, peak-to-peak voltage $V_{p-p}=2800$ (V) and developing bias $V_{DC}=-550$ (V) when image density is lowered and by regulating to to AC frequency of 5.0 KHz, peak-to-peak voltage $V_{p-p}=-2000$ (V) and developing bias $V_{DC}=-450$ (V) when image density is too high.

Further, under the conditions of initial charge potential $V_H=-800$ (V), AC frequency of 3.0 KHz, peak-to-peak voltage $V_{p-p}=2200$ (V), developing bias $V_{DC}=-600$ (V) and toner concentration of 5.0 (wt %) ±0.3 (wt %), the same effect as in the foregoing was obtained in the same control as in the foregoing by regulating to peak-to-peak voltage $V_{p-p}=-3000$ (V) and developing bias $V_{DC}=-700$ (V) or to peak-to-peak voltage $V_{p-p}=2000$ (V) and developing bias $V_{DC}=-500$ (V).

In a color developing apparatus equipped with a plurality of similar developing units, a consumption amount of each color toner sometimes differs greatly from others. Therefore, the invention was able to be applied favorably on occasions wherein two-component developer employing insulating carrier of resin-coated ferrite core was loaded and development was conducted under AC electric field.

The invention is not limited to the above-mentioned third example, and various methods including one wherein toner concentration control and electrostatic latent image potential control are conducted by only one CPU may be employed.

As explained above, an image recording apparatus in the third example of the invention makes it possible, when image density is lowered or heightened despite toner concentration kept at a predetermined value constantly, to reproduce an image at proper density by detecting the lowered or heightened image density and controlling developing conditions to predetermined values.

A color image forming apparatus in the fourth example of the invention will be explained as follows, referring to drawings.

Figure 22:
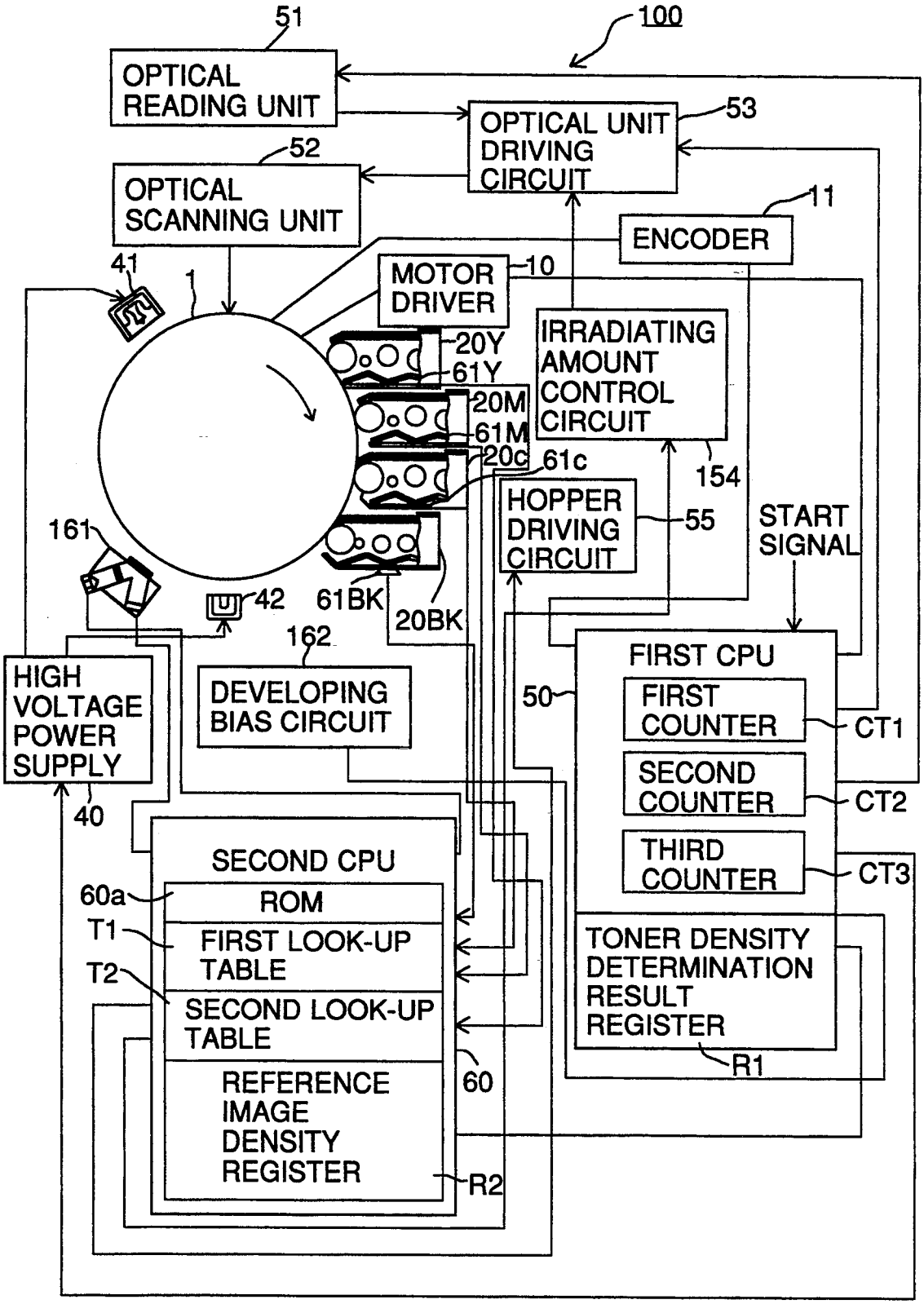
FIG. 22 is a block diagram of the color image forming apparatus of the fourth example of the present invention.

FIG. 22 is a block diagram of a color image forming apparatus in the fourth example of the invention, and the color image forming apparatus 100 is equipped with photoreceptor drum 1 that is an image carrier, first motor driver 10 that controls rotation of the photoreceptor drum 1, four developing units 20BK, 20C, 20M and 20Y, high voltage power supply 40, transfer unit 42, charging unit 41, optical reading unit 51, optical scanning unit 52, optical unit driving circuit 53, irradiating amount control circuit 154, hopper drive circuit 55, first CPU50, second CPU60, optical density measuring means 161, developing bias circuit 162 and toner concentration detection means 61BK, 61C, 61M and 61Y each being provided on each of developing units 20BK, 20C, 20M and 20Y.

When an unillustrated copy button is pressed, a light source emits light, based on image signals corresponding to image density of document images from the optical scanning unit 52 under the control of the first CPU50 for irradiating photoreceptor drum 1. Thereby, there is formed on the light-sensitive surface of the photoreceptor 1 an electrostatic latent image which is developed in succession by developing units 20BK, 20C, 20M and 20Y to be a plurality of toner images differing in color each other which are laminated (superimposed) on the photoreceptor drum 1 and transferred onto a transfer sheet when the transfer unit 42 is subjected to discharge driving based upon registration signals. After that, the transfer sheet is subjected to fixing so that transferred images thereon may be reproduced images which are preservable Namely, black BK, cyan C, magenta M and yellow Y are basic colors and other colors are reproduced by selecting these basic colors and superimposing them. In this case, the superimposing for colors other than basic colors is in the sequence of cyan C, magenta M and yellow Y from the lower layer. Incidentally, superimposing of a plurality of toner images may also be conducted on a transfer drum, for example, in place of photoreceptor drum 1.

Photoreceptor drum 1 is an OPC photoreceptor in which a drum-shaped conductive support made of aluminum having a diameter of 150 mm is used as a support and a 0.1-μm-thick interlayer composed of ethylene-vinyl acetate copolymer and a 35-μm-thick light-sensitive layer are laminated on the support. When the light-sensitive layer is irradiated by light, surface potential thereon is lowered. Therefore, when the photoreceptor drum 1 is irradiated by light based on shading gradation of document images after being charged to a predetermined voltage uniformly in advance, the surface potential on the photoreceptor drum 1 lacks uniformity and portions where potential is lowered can be formed. This is what is called an electrostatic latent image. The photoreceptor drum 1 is not limited to this and it may also be of other constitutions including one composed of amorphous silicone. In this case, the photoreceptor is the OPC photoreceptor mentioned above for convenience' sake of explanation. A latent-image-carrier is not limited to photoreceptor drum 1 but it may also be a belt-shaped one.

Motor driver 10 is a circuit that drives and controls a main motor (not illustrated) which rotates mainly the photoreceptor drum 1, and it controls, based upon control signals from the first CPU50, the number of rotations of the main motor and ON-OFF for the main motor.

Encoder 11 generates pulse signals having a predetermined width corresponding to rotation phases of the photoreceptor drum 1 and sends them to the first CPU50. Thereby, the first CPU50 detects rotation phase of the photoreceptor drum 1.

Optical reading unit 51 is composed of an illumination lamp constituted to be one with an unillustrated first scanning mirror, the second scanning mirror (V mirror) traveling at the speed which is a half that of the first scanning mirror and others, thus a document is scanned with a length of an optical path in front of a lens being kept to be constant. Thereby, the optical scanning unit 51 guides reflected light from a document positioned on a platen glass so that an image may be formed on a light-accepting portion of a solid image sensor, and sends output signals from the solid image sensor to optical unit driving circuit 53 as image information signals.

In the case of an analog system, a scanning unit known widely is used as the optical scanning unit 52. For example, it is composed of an illuminating lamp constituted in one with the first scanning mirror and the second scanning mirror (V mirror) which travels at the speed that is one half of the first scanning mirror, though they are not illustrated in the figure, and it scans a document with an optical path length in front of a lens being kept always to be constant. At a lower end portion on one side of the platen glass, there is provided, for example, a reference density plate corresponding to optical reflection density CD=1.0 which is illuminated by the illuminating lamp to form on photoreceptor 1 a reference latent image that is developed with toners later. It is further possible to adjust illumination intensity in the above-mentioned constitution by regulating power supply what is called CVR with which the aforementioned illuminating lamp is lit.

As an optical scanning unit of a digital system type, a method employing the same reading-scanning system and a method wherein image data forming a reference density portion are stored in a memory and a reference latent image is formed based upon the aforementioned image data are available. In the case of a digital system type, optical scanning unit 52 of FIG. 22 that is an exposure means for forming an electrostatic latent image may also be a laser scanning unit equipped with a polygon mirror which rotates to cause a laser beam emitted from a semiconductor laser modulates the image signals to scan or a fixed scanning unit employing an LED array and liquid crystals.

In the optical scanning unit of a digital system type, a laser beam emitted therefrom is modulated either by an intensity modulation method or by a pulse width modulation method. In the intensity modulation method, irradiating intensity is regulated by adjusting an electric current running through, for example, a semiconductor laser. In the pulse width modulation method, on the other hand, irradiating amount (irradiated area per one pixel) is regulated by adjusting a slice level of, for example, a reference wave.

Optical unit driving circuit 53 is a circuit including one controlling a mechanical system for a polygon mirror and others and including an image processing circuit that processes image signals coming from optical reading unit 51. For example, reference image density data varying stepwise or continuously up to 0–1.0 of optical reflection density are stored in ROM, and optical scanning unit 52 is controlled to form a reference latent image based on the data stored in ROM. In the present example, the reference image density data correspond to 1.0 of optical reflection density. The invention, however, is not limited to this.

Irradiating amount control circuit 54 is a circuit controlling an electric current running to a semiconductor laser constituting a part of the optical unit driving circuit 53 in the intensity modulation method, and it is a circuit controlling a slice level of a reference wave in the pulse width modulation method.

Developing units 20BK, 20C, 20M and 20Y are to contain respectively black, cyan, magenta and yellow two-component developers, and mechanical structures thereof are the same as those in other examples except that color components of two-component developer to be contained are different.

Figure 23:
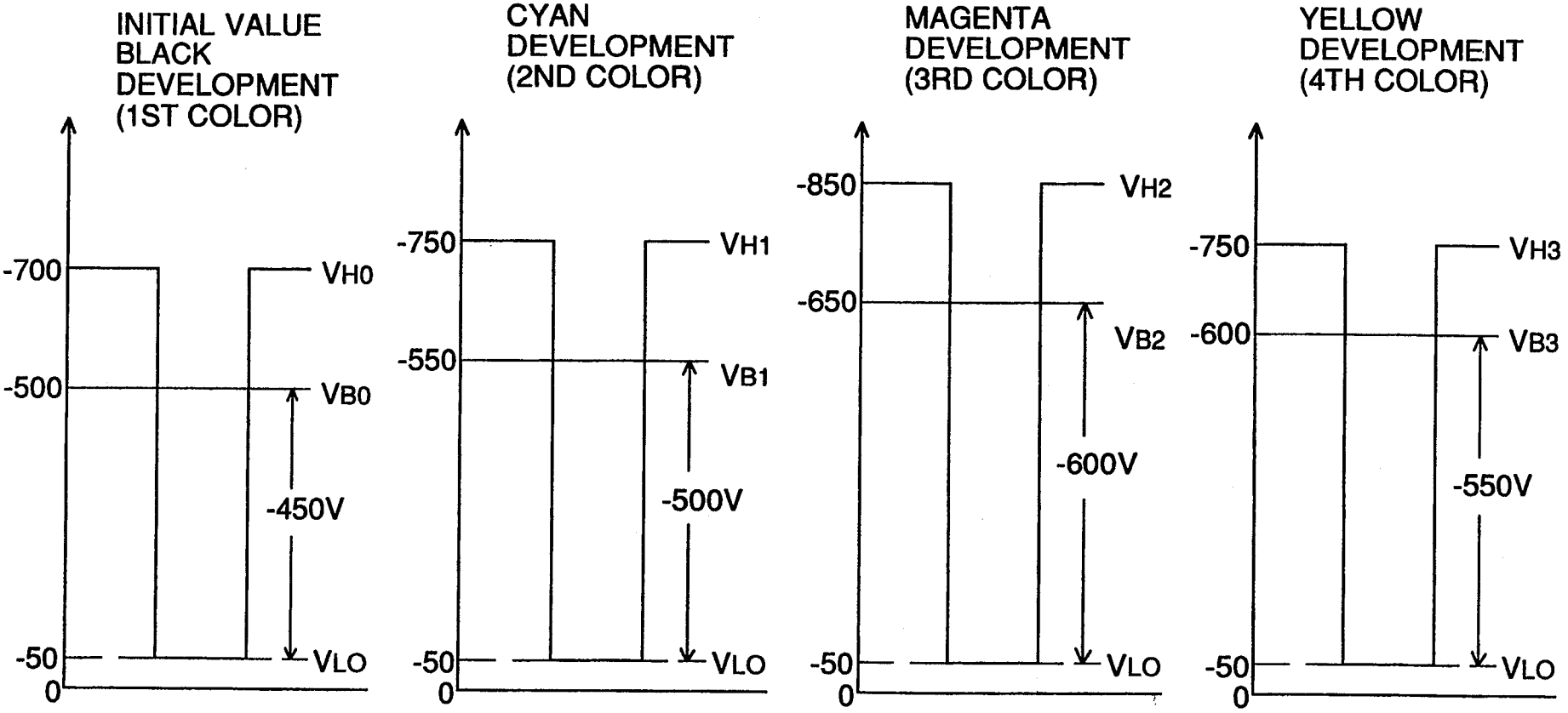
FIGS. 23(*a*) to 23(*d*) are schematic illustrations showing the initial value of the developing potential gap of a color image forming apparatus and also showing variations.

FIG. 23 is a diagram showing electrostatic process conditions (developing potential gap) in the course of forming latent images for laminating on photoreceptor drum 1 the toner images each having its own color. FIG. 23(*a*) is a diagram showing electrostatic process conditions on the occasion that toner charge amount for each color is proper due to fresh two-component developer filled, namely on the occasion of an initial stage. To be concrete, initial charge potential $V_{110}=-700$ V, developing bias $V_{BO}=-500$ V, exposure portion potential $V_{LO}=-50$, and developing potential gap $V_{BO}$-$V_{LO}=-450$ V. FIG. 23(*b*) is a diagram showing electrostatic process conditions for causing the developability to be appropriate when charge amount of cyan or yellow toner, for example, increases in the course of continuous copying and thereby the developability is deteriorated. To be concrete, a change is made to satisfy initial charge potential $V_{H1}=-750$, developing bias $V_{B1}=-550$V, exposure portion potential $V_{LO}=-50$ and developing potential gap $V_{B1}$-$V_{LO}=-500$ V, for example, when developability for cyan or yellow is deteriorated. FIG. 23(*c*) is a diagram showing electrostatic process conditions for causing the developability to be appropriate when charge amount of magenta toner, for example, increases and thereby the developability is deteriorated. To be concrete, a change is made to satisfy initial charge potential $V_{H2}=-850$, developing bias $V_{B2}=-650$ V, exposure portion potential $V_{LO}=-50$ and developing potential gap $V_{B2}$-$V_{LO}=-600$ V, for example, when developability for magenta is deteriorated.

The first CPU50 includes the first counter CT1 to count the number of copies, the second counter CT2 and the third counter CT3. The first counter CT1 counts the number of continuous copies using a detection signal sent from the paper discharge sensor. The second counter CT2 counts the number of copies that indicates the timing at which the developing potential gap control program is carried out, that is, the second counter CT2 counts the number of overall copies after the previous developing potential gap control was carried out. Specifically, the developing potential gap control program is carried out each time 1000 copies are made. The third counter CT3 counts the number of copies that indicates the timing to judge whether or not the image density has returned to a predetermined level when the developing potential gap control program was carried out, that is, the third counter CT3 counts the number of copies that indicates the timing at which the potential is returned. Specifically, it is judged whether or not the image density has returned to a predetermined level at a point of time when 50 copies has been made after the developing potential gap control program was carried out. According to the result of the judgment, the developing potential gap is returned to the initial value. The first, second and third counters CT1, CT2 and CT3 are down-counters, and the number of continuous copies, the number of overall copies and the amount of developing potential gap return judgment copies are respectively set on the counters. The aforementioned numbers are counted by the counters, and when the counted value becomes "0", the predetermined number of copies can be provided.

Next, with reference to the flow charts shown in FIGS. 24 and 25, the image recording operation of the image recording apparatus of the invention will be explained as follows. FIG. 4 shows a main flow to be carried out by the first CPU50 shown in FIG. 1. FIG. 25 is an electrostatic latent image potential control flow to be carried out by the second CPU60. When a main switch (not shown) is pressed, electrical power is supplied to the apparatus. As a result, the first CPU50 and the second CPU60 are started (step F-1 in FIG. 24).

The first CPU50 drives the first motor driver 10, so that the main motor is started. The first and second stirring rollers 20*e* and 20*f* of the developing units 20BK, 20C, 20M and 20Y are connected with this drive system so as to stir the 2-component developer. Temperature of the heater of a fixing unit (not shown) is raised to a predetermined value. Also, the first CPU50 conducts the preprocessing as follows: the photoreceptor drum 1 connected with the main motor drive system is driven; and the photoreceptor drum 1 is repeatedly charged and discharged by the charger 41 and discharger (not shown) so that the process conditions for image formation are adjusted. In the preprocessing, the number A of continuous copies, which has been set by an operator through operating a predetermined button, is set on the first counter CT1 (step F-2).

As described before, the second CPU judges in accordance with the toner concentration judging program whether or not the toner concentration detection signals sent from the toner concentration detection means 61BK, 61C, 61M and 61Y have become not more than a predetermined value of 7.5 wt %. In the case where it is not more than 7.5 wt %, a toner concentration NG signal is transmitted from the second CPU60 to the toner concentration judgment result register R1, and in the case where it is more than 7.5 wt %, a toner concentration OK signal is transmitted to the toner concentration judgment result register R1.

Then, the first CPU50 reads out a signal that has been set in toner concentration judgment result register R1 (step F-3), and it is judged whether the signal is a toner concentration NG signal or not (step F-4). When it is a toner concentration NG signal, toner for the color is supplied (step F-5), and the program advances to step (F-6). On the other hand, when it is a toner concentration OK signal for all colors, the program immediately advances to step (F-6), and when it is judged whether or not the counted value on the second counter CT2 is "0", it is judged whether or not the number of overall copies relating to the counted value setting has reached 1000. When the number of overall copies has not reached 1000, the program advances to step (F-9). When the number of overall copies has reached 1000, the first CPU50 sets the number "1000", which is the setting value of the number of overall copies, on the second counter CT2 (step F-7), and the image density control interruption is generated, so that an image density control command signal is outputted into the second CPU60 (step F-8).

In response to the image density control command signal sent from the first CPU50, the second CPU60 drives optical system driving circuit 53 to cause optical scanning unit 52 to form in succession exposure portions (reference electrostatic latent images) corresponding to optical reflection density CD=1.0 for each color on photoreceptor drum 1 (step F-81 in FIG. 25). Then, the developing units 20BK, 20C, 20M and 20Y are driven so that the reference electrostatic latent image can be visualized into a toner image. In this way, a reference toner image for each color is formed (step F-82). Next, the second CPU60 reads out reference image density CD corresponding to a toner concentration detection signal for each color sent from the toner concentration detection means 61BK, 61C, 61M and 61Y, from the first lookup table T1, and the obtained reference image density CD is set in the reference image density register R2 (step F-83).

Actual optical image density is taken in from the optical image density measurement means 161 and compared with the reference image density for relevant color held in reference image density register R2 so as to judge whether it agrees with the reference image density or not, namely, whether there exists a color with lowered developability or not (step F-84). When there is a color with lowered developability, it is judged whether or not the developing potential gap for the color is an initial value (step F-85). When it is an initial value, that is, when the developing potential gap has not been changed, a changing amount of the developing potential gap corresponding to the actual optical image density is read out from the second lookup table T2 (step F-86). In accordance with the changing amount of developing potential gap read, the developing potential gap is changed (step F-87) and the program is returned. The developing potential gap is changed in the following manner: initial charging potential $V_H$ of the photoreceptor drum 1 is adjusted when the high voltage power supply 40 and the charger 41 are controlled; the amount of irradiating light is adjusted by irradiating amount control circuit 154 and the development bias $V_B$ is adjusted by the development bias circuit 162. The detail will be explained later.

In the case where the developing potential gap is not the initial value, the circumstances are as follows: although the developing potential gap has been changed, the developability has not recovered properly. These circumstances will be explained later. In this case, the program is immediately returned. However, this returning is made after step (F-85) and step (F-86) are conducted for all colors whose developability has been lowered.

When it has been judged in the step (F-84) that the developability is not lowered for all colors, it is judged whether the developing potential gap is the initial value or not (step F-88). In the case where the developing potential gap is not the initial value in terms of color, it means that the developability for the color has recovered properly when the developing potential gap has been changed. Therefore, the developing potential gap for the color is returned to the initial value (F-89), and the program is returned. On the other hand, in the case where the developing potential gaps for all colors are the initial value, the developability for all colors is appropriate from the beginning and it is not necessary to change the developing potential gap, so that the program is returned as it is.

Figure 24:
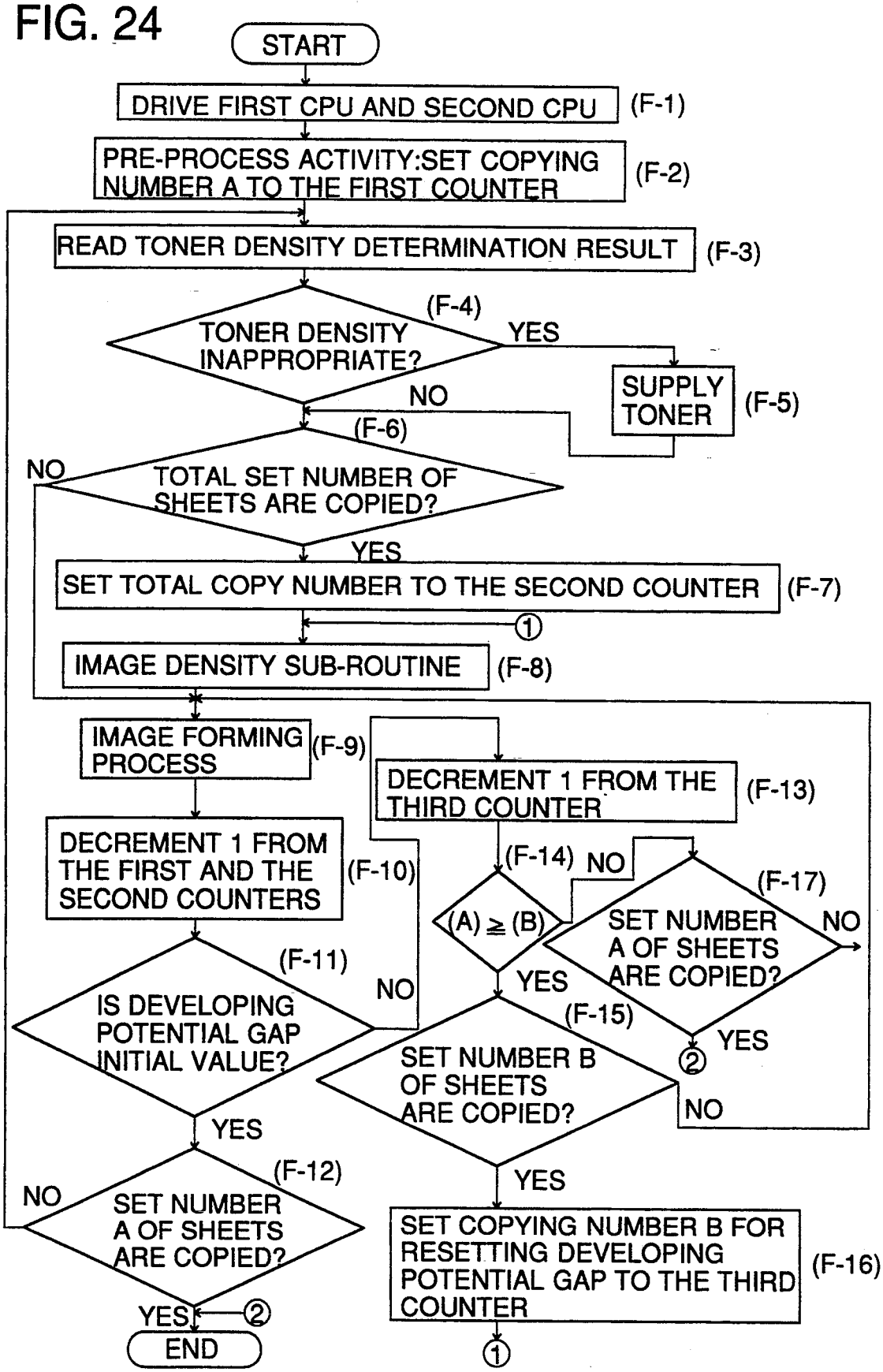
FIG. 24 is a flow chart showing an image recording operation of the image recording apparatus of the fourth example of the present invention.
Figure 25:
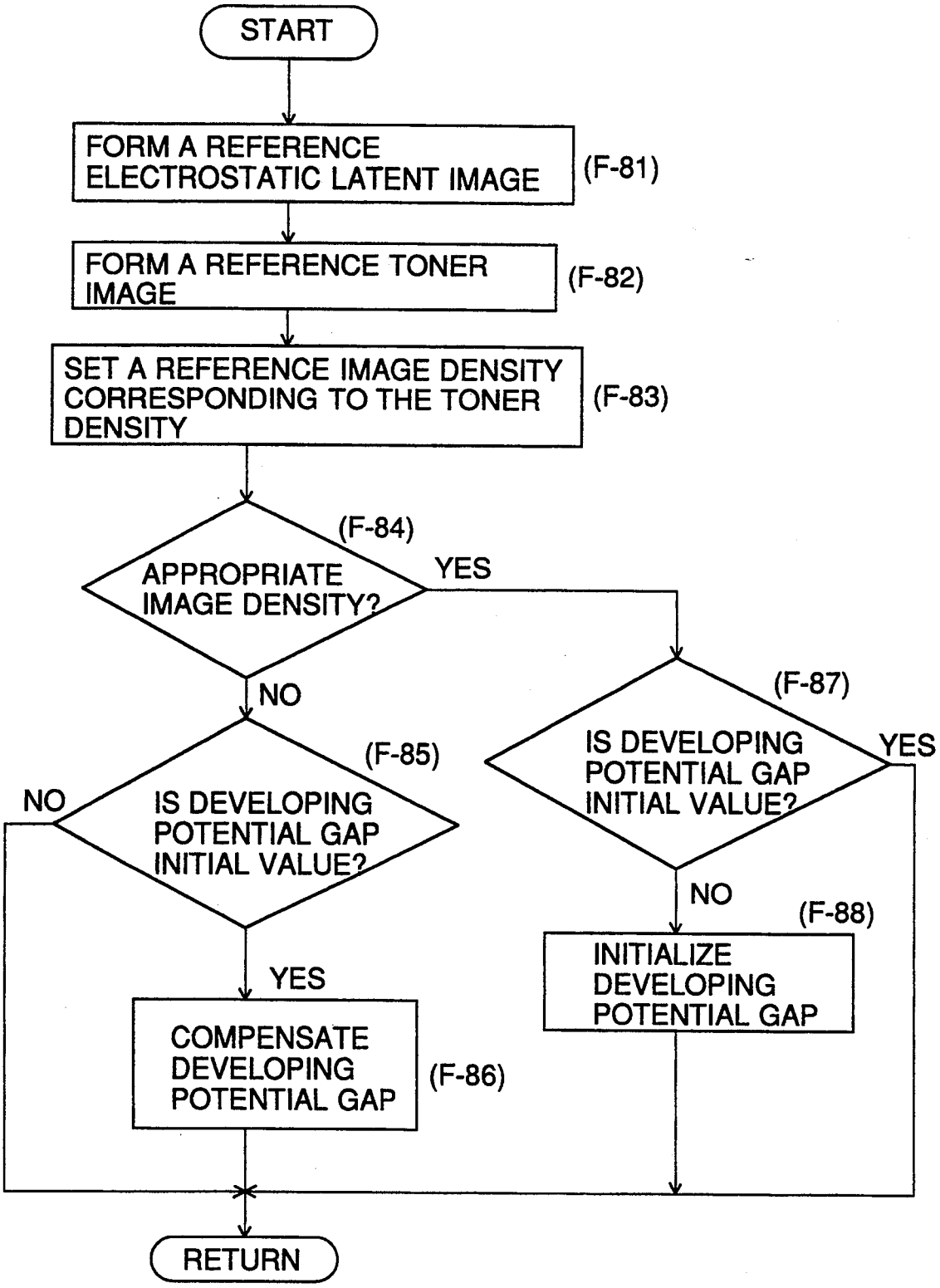
FIG. 25 is a flow chart showing an image density controlling operation of the image recording apparatus of the fourth example of the present invention.

Then, the first CPU50 carries out the image forming process in accordance with the image forming program (step F-9 shown in FIG. 24). After that, the counted value of the number of continuous copies on the first counter CT1 is subtracted by 1, and also thee counted value of the number of continuous copies on the second counter CT2 is subtracted by 1 (step F-10), and it is judged whether the developing potential gap is the initial value or not for all colors (step F-11). In the case where the developing potential gap is the initial value for all colors, it is judged whether or not the counted value of the number of continuous copies on the first counter CT1 is "0". As a result of the foregoing, it is judged whether or not the number of copies has reached the number A of continuous copies relating to setting (step F-12). In the case where the counted value on the first counter CT1 is "0" and the number of copies has reached the number A of continuous copies, the program is completed. On the other hand, in the case where the number of copies has not reached the number A, the program returns to step (F-3) so that the necessary number of copies can be made.

When developing potential gap is judged by color not to be an initial value in Step (F-11), namely when the developing potential gap is compensated by Second CPU60 and is not reset to the initial value in terms of color thereafter, decrement of 1 from copying number B for resetting developing potential gap on Third Counter CT3 is made (Step F-13). Then, countdown value (A) of copying number A on First Counter CT1 is judged whether it is not less than countdown value (B) of copying number B for resettling developing potential gap on the Third Counter CT3 or not (Step F-14). When the result of the judgment shows that the countdown value (A) of the copying number A is not less than the countdown value (B) of the copying number B for resetting developing potential gap on the Third Counter CT3, a judgment is formed whether or not the copies in quantity of the copying number B for resetting developing potential gap related to setting have been completed (Step F-15) through a judgment whether or not the countdown value (B) of the copying number B for resetting developing potential gap on the Third Counter CT3 is "0". When the result of the judgment shows that the number of copies made has not reached the copying number B for resetting developing potential gap, the sequence returns to Step (F-9) because it is apparent that the set copying number A has not been completed.

On the other hand, when the count down value (B) on the Third Counter CT3 is "0" and the copying number B for resetting potential related to setting has been completed, the copying number B for resetting developing potential gap is set on the Third Counter CT3 (Step F-16). Then, the sequence returns to Step (F-8) for causing the compensated developing potential gap to return to its initial value.

In the step (F-14), when the countdown value (A) for copying number A is judged to be smaller than the countdown value (B) for copying number for resetting developing potential gap B, the copying number A related to setting is judged whether it has been completed or not (step F-17) through judgment whether the countdown value (A) for copying number A on the first counter CT1 is "0" or not. If the result of the judgment shows that the copying number A has not been completed, the sequence goes back to step (F-9) for completing the copying number A. On the other hand, when the countdown value (A) on the first counter CT1 is "0" and the copying number A related to setting has been completed, the sequence ends. In this case, the sequence ends with developing potential gap remaining unchanged to its initial value. In the succeeding continuous copying, however, the developing potential gap is reset to its initial value because processes of step (F-13) and thereafter are executed through step (F-11).

Resetting of developing potential gap to its initial value in step (F-88) in FIG. 25 has the following meaning. Namely, as explained above, the first CPU50 executes an image forming process after the developing potential gap is compensated by the second CPU60. When copying is continued for a while with the developing potential gap compensated to the lower level, developability sometimes becomes too high. Under such conditions, toner having higher toner potential in two-component developer is consumed, and fresh toner supply is started. After compensation of developing potential gap, therefore, when the predetermined copying number (for example, 50 sheets) has been completed, an image density control program is executed again to confirm that the developability has been restored properly, and then the developing potential gap relating the compensation is returned to the initial value.

Next, an operation for controlling developing potential gap in FIG. 25 conducted by second CPU60 in the case of reversal development will be explained concretely. In the case of this example, photoreceptor drum 1 is made of an OPC light-sensitive layer, and a developer used is a two-component developer (toner concentration 7.5 (wt %) ±0.5(wt %)) composed of an insulating magnetic coating carrier having a particle size of 40 μm and a toner having a particle size of 8.5 μm. Developing bias contains only DC components and it is fixed at exposure portion potential $V_L = -50$ (V) and output of semiconductor laser, initial charging voltage $V_H$ and developing bias potential $V_B$ are adjusted.

In the comparative calculation in step (F-84), when reference data held in a register is almost the same as measured data obtained from optical reflection density measuring means 161, toner charge amount Q/m in developer contained in developing unit 20 is an optimum value of −25 (μc/g), and developing potential gap $V_{BO}$-$V_{BL}$ corresponding to developing density CD=1.0 is −450 (V) as shown in FIG. 23(*a*). This condition means that toner charge amount for each color is optimum in value or is in. This electrostatic process condition is common to all colors when fresh developers are filled. When the reference data agree mostly with measured data as shown above, it is not necessary to adjust developing potential gap $V_{BO}$-$V_{BL}$. Therefore, electrostatic conditions corresponding to developing density CD=1.0 take electrostatic initial charge potential $V_{HO} = -700$ (V), exposure portion potential $V_{LO} = -50$ (V), developing bias $V_{BO} = -500$ (V), developing potential gap $V_{BO}$-$V_{LO} = -450$ (V)

and semiconductor laser output value LD=1.2 (mW) remaining unchanged from initial values.

In this case, toner images made of toner particles can be formed efficiently and clearly on photoreceptor drum 1. In the case of black toner, therefore, contrast can be obtained sufficiently widely at image density of about 0-about 1.2 and adhering power between photoreceptor drum 1 and toner is optimum. Therefore, no image slip takes place in the succeeding image forming process and thereby clear images can be made, which also applies to other colors.

In the comparative calculation in step (F-84), however, when measurement data obtained from optical image measuring means 61BK, 61C, 61M and 61Y, for example, are much lower than the reference data, toner charge amount Q/m is presumed to be about −30 (μC/g) that is greater in terms of absolute value than the optimum value of −25 (μC/g). In this case, it is impossible to obtain sufficient image density and contrast unless the developing potential gap is enlarged.

Due to the background mentioned above, second CPU60 enhances developing potential gap $V_B$-$V_L$ for elevating developing power by controlling high voltage power supply 40, irradiating amount control means 154 and developing bias circuit 162.

To be concrete, a change is made for cyan and yellow, as electrostatic process conditions corresponding to developing density CD=1.0, to satisfy initial charge potential $V_{H1}=-750$ (V), exposure portion potential $V_{LO}=-50$ (V), developing bias $V_{B1}=-550$ (V), $V_{B3}=-600$ (V) and output value of semiconductor laser LD=1.5 (mW) when developing biases for cyan and yellow are represented respectively by $V_{B1}$ and $V_{B3}$, as shown in FIGS. 23(*b*) and 23(*d*), though the foregoing remains unchanged for black. With regard to magenta, a change is made to satisfy initial charge potential $V_{H2}=850$ (V), exposure portion potential $V_{LO}=-50$ (V), developing bias $V_{B2}=-650$ (V) and output of semiconductor laser LD=1.8 (mW), as shown in FIG. 23(*c*) (step F-74). Owing to this, developing power in each of developing steps for cyan, yellow and magenta is higher than that in initial conditions, which results in correction of developing power in each developing step mentioned above. Incidentally, with regard to control amount in the course of development for cyan toner and yellow toner, it is preferable that the control amount for yellow toner in the later step (upper layer) is greater than that for cyan toner in the former step ( lower layer).

Accordingly, it is possible to correct color reproduction for a colored document even when developing power is deteriorated, thereby satisfactory color reproduction can be maintained constantly and sufficient image density and contrast corresponding to images on a document can be obtained. An example shown in FIG. 23, in this case, corresponds to an occasion wherein deterioration of image density (developability) for each color is similar to what is shown in FIG. 24(*c*), and developing potential gap $V_B$-$V_L$ is increased depending on the extent of deterioration of developability, namely on the extent of deterioration of toner deposit.

Incidentally, a color image forming apparatus in the fourth example employs a process wherein toners are superimposed to form a plurality of toner layers on photoreceptor drum 1. Therefore, toner potential caused by a lower toner layer formed previously on the photoreceptor drum 1 sometimes deteriorates developing power for the upper toner layer. It has been found that it is advantageous that developing power for developing by means of developing unit 20Y containing yellow toner for an upper layer that is developed in the later stage is slightly stronger than developing power for developing by means of developing unit 20C containing cyan toner, in the case mentioned above, just like the occasion of cyan toner and yellow toner in the aforementioned example. Further, the same effect as in the foregoing was obtained with optical scanning unit 52 wherein a light source is a semiconductor laser and a size of exposure portion of each dot (area of latent image) is adjusted by irradiating amount control circuit 154 employing a pulse width modulation method.

As described above, even when the image density is deteriorated in spite of toner concentration maintained almost constant at a predetermined value in the fourth example, it is possible to adjust the developing power by detecting the deterioration of image density and by controlling charge potential, intensity or quantity of imagewise exposure, and electrostatic process conditions composed of developing bias and others, namely by controlling developing potential gap to a predetermined level. Therefore, it is possible to obtain sufficient image density and contrast corresponding to images on a colored document, and reproduction of color balance is improved.

As explained above, a color image forming apparatus in the fourth example of the invention makes it possible, when color image density is deteriorated or enhanced in spite of toner concentration maintained almost constant at a predetermined value, to reproduce color images at appropriate density by detecting the deterioration or enhancement of toner image density and by controlling electrostatic process conditions to a predetermined level.

Toner layers on photoreceptor drum 1 in the course of color image forming in the fifth example will be explained as follows, referring to FIGS. 26–31.

Figure 26:
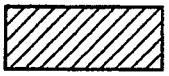
FIGS. 26(*a*), 26(*b*) and 26(*c*) are schematic illustrations showing a section of a toner image of each color in the case where the toner charge amount of each color is appropriate.
Figure 26:
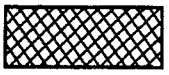
Figure 26:
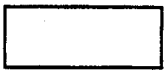
Figure 26:
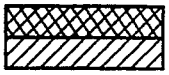
Figure 26:
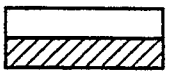
Figure 26:
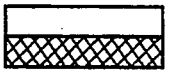
Figure 26:
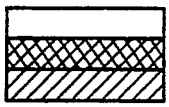

Each of FIGS. 26(*a*)–26(*g*) represents a sectional view of a toner image on photoreceptor drum 1 in each color reproduction made under the condition of appropriate toner charge amount in each color developer. Each of FIGS. 26(*a*), 26(*b*) and 26(*c*) shows a sectional view of a toner image in reproduction for each of cyan, magenta and yellow at a predetermined optical reflection image density, and all of them have the similar amount of toner deposit which shows an appropriate value. FIG. 26(*d*) represents a sectional view of a toner image reproducing blue at a predetermined optical reflection image density, FIG. 26(*e*) represents a sectional view of a toner image reproducing green at a predetermined optical reflection image density, FIG. 26(*f*) represents a sectional view of a toner image reproducing red at a predetermined optical reflection image density. Toner deposit on each color toner layer of them is almost the same, color balance thereof is excellent, they are reproduced as blue, green and red respectively, and they show sufficient image density. FIG. 26(*g*) represents a sectional view of a toner image wherein three colors of cyan, magenta and yellow at optical reflection image density CD=1.0 are superimposed to reproduce black, and each color toner deposit is appropriate with excellent color color balance.

Figure 27:
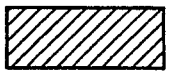
FIGS. 27(*a*), 27(*b*) and 27(*c*) are schematic illustrations showing a section of a toner image of each color in the case where only the charge amount of magenta toner exceeds an appropriate value.
Figure 27:
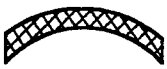
Figure 27:
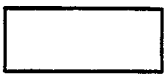
Figure 27:
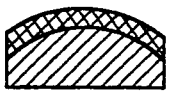
Figure 27:
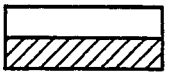
Figure 27:
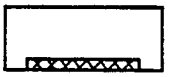

FIGS. 27(*a*)–27(*f*) are illustrative diagrams each showing that only a toner charge amount of magenta exceeds an appropriate value. In each of FIG. 27(*a*), FIG.27(*b*), FIG. 27(*c*), FIG. 27(*d*), FIG. 27(*e*) and FIG. 27(*f*), both cyan layer and yellow layer have appropriate toner deposit. As shown in FIG. 27(*a*) and FIG. 27(*c*), therefore, sufficient image density is shown in single color reproduction for cyan or yellow. Further, as shown in FIG. 27(*e*), green reproduction is accomplished. In FIG. 27(*b*), FIG. 27(*d*) and FIG. 27(*f*), on the contrary, toner deposit on a magenta layer is lower than an appropriate value. Therefore, it is not possible to obtain sufficient density in single color reproduction for magenta shown in FIG. 27(*b*). FIG. 27(*d*) represents a sectional view of a toner image reproducing blue at a predetermined optical reflection image density, wherein toner deposit on a cyan toner layer is sufficient but that on a magenta toner layer is lower than an appropriate value. This results in insufficient color reproduction which generates blue that is closer to cyan FIG. 27(*f*) represents a sectional view of a toner image reproducing red at a predetermined optical reflection image density, wherein toner deposit on a yellow toner layer is sufficient but that on a magenta toner layer is lower than an appropriate value. This results in insufficient reproduction for red which generates yellowish red, namely orange.

Figure 28:
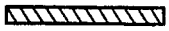
FIGS. 28(*a*), 28(*b*) and 28(*c*) are schematic illustrations showing a condition in which colors are balanced by pulse-width-modulation in the case where only the charge amount of magenta tone exceeds an appropriate value.
Figure 28:
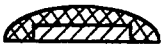
Figure 28:
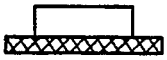

FIGS. 28(*a*)-28(*c*) are illustrative diagrams wherein color balance can be corrected by optimum reproducibility for each color on an image recording apparatus in the present example when only toner charge amount for magenta exceeds an appropriate value. Making color reproducibility to be optimum, in this case, is achieved by changing imagewise exposure amount per one pixel by changing the reference pulse width when generating signals for modulating light source for imagewise exposure by means of a pulse width modulation method, and thereby adjusting latent image potential (exposure portion potential) formed on photoreceptor drum 1 for controlling toner deposit in the course of development. In this case, no problem of destroying color balance takes place in green reproduction which will therefore be omitted in terms of explanation. FIG. 28(*a*) is an illustrative diagram showing that a magenta toner layer at a predetermined optical reflection image density is corrected and that an area of the toner layer is enlarged. FIG. 28(*b*) shows a sectional view of a toner image reproducing blue at predetermined optical reflection image density wherein a cyan toner layer shows sufficient toner deposit, a magenta toner layer shows toner deposit that is lower than an appropriate value, an area of a toner layer is enlarged and color balance is corrected satisfactorily, which therefore reproduces blue properly. FIG. 28(*c*) Shows a sectional view of a toner image reproducing red at predetermined optical reflection image density wherein a yellow toner layer shows sufficient toner deposit, a magenta toner layer shows toner deposit that is lower than an appropriate value, an area of a toner layer is enlarged and color balance is corrected satisfactorily, which therefore reproduces red properly.

Figure 29:
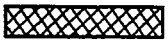
FIGS. 29(*a*), 29(*b*) and 29(*c*) are schematic illustrations showing a condition in which colors are balanced by intensity-modulation in the case where only the charge amount of magenta toner exceeds an appropriate value.
Figure 29:
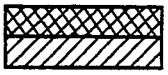
Figure 29C:
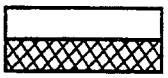

FIGS. 29(*a*)-29(*c*) are illustrative diagrams wherein color balance can be corrected by optimum reproducibility for each color on an image recording apparatus in the present example when only toner charge amount for magenta exceeds an appropriate value. Making color reproducibility to be optimum, in this case, is achieved by changing reference imagewise exposure amount per one pixel when modulating light source for imagewise exposure by means of an intensity modulation method, and thereby adjusting latent image potential (exposure portion potential) formed on photoreceptor drum 1 for controlling toner deposit in the course of development. In this case, no problem of destroying color balance takes place in green reproduction which will therefore be omitted in terms of explanation. FIG. 29(*a*) is an illustrative diagram showing that a magenta toner layer at a predetermined optical reflection image density is corrected and that toner deposit on a toner layer is sufficient. FIG. 29(*b*) shows a sectional view of a toner image reproducing blue at predetermined optical reflection image density wherein a cyan toner layer and a magenta toner layer show sufficient toner deposit, and color balance is corrected satisfactorily, which therefore reproduces blue properly. FIG. 29(*c*) shows a sectional view of a toner image reproducing red at predetermined optical reflection image density wherein a yellow toner layer and a magenta toner layer show sufficient toner deposit, and color balance is corrected satisfactorily, which therefore reproduces red properly.

Figure 30:
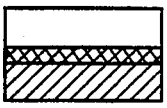
FIGS. 30(*a*), 30(*b*) and 30(*c*) are schematic illustrations showing a condition in which black is reproduced in the case where only the charge amount of magenta toner exceeds an appropriate value, FIGS. 31(*a*), 31(*b*) and 31(*c*) are schematic illustrations showing the section of a toner image of each color in the case where the charge amounts of cyan and magenta exceed an appropriate value.
Figure 30:
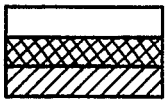
Figure 30:
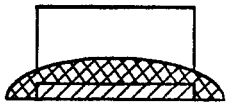

FIG. 30(*a*)-30(*c*) represent illustrative diagrams showing how color balance is corrected through an intensity modulation method similarly to the case in FIG. 6 on an image recording apparatus in the present example when only magenta toner charge amount exceeds an appropriate value. FIG. 30(*a*) represents an illustrative diagram showing toner layer correction made in the case of reproduction of black being at optical reflection image density CD=1.0 before the correction. In FIG. 30(*a*), toner deposit for only a magenta toner layer is reduced, color balance is destroyed and brown is reproduced. FIG. 30(*b*) is an illustrative diagram of color balance correction in the case of reproducing black at optical refection image density CD=1.0 by means of an intensity modulation method similarly to the occasion in FIG. 6, and FIG. 30(*c*) is an illustrative diagram of color balance correction in the case of reproducing black at optical reflection image density CD=1.0 by means of a pulse width modulation method. In both cases mentioned above, black is reproduced.

Figure 31:
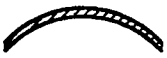
FIG 31(*d*), 31(*e*), 31(*f*) and 31(*g*) respectively represent a toner image reproducing blue, green, red and black wherein the toner deposit is lower than an appropriate level for both a cyan toner layer and a magenta toner layer, but color balance is not destroyed.
Figure 31:
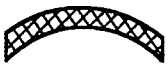
Figure 31:
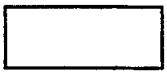
Figure 31:
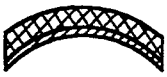
Figure 31:
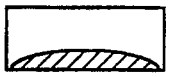
Figure 31:
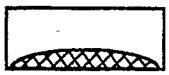
Figure 31:
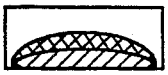

FIGS. 31(*a*)-31(*g*) represent illustrative diagrams each showing how cyan or magenta toner charge amount exceeds an appropriate value in an image recording apparatus in the present example. FIG. 31(*c*) shows a proper toner deposit on a yellow toner image. FIGS. 31(*a*) and 31(*b*) , however, show respectively a cyan toner layer and a magenta toner layer both having toner deposit lower than an appropriate level. Therefore, it is not possible to obtain sufficient density in single color reproduction. FIG. 31(*d*) represents a sectional view of a toner image reproducing blue at predetermined optical reflection image density, wherein toner deposit is lower than an appropriate level in both a cyan toner layer and a magenta toner layer, but color balance is not destroyed. Therefore, light blue is reproduced. FIG. 31(*e*) shows a sectional view of a toner image reproducing green at predetermined optical reflection image density, wherein a yellow toner layer has sufficient toner deposit, while a cyan toner layer shows toner deposit that is lower than an appropriate level. Therefore, color balance is destroyed and yellowish green is reproduced. FIG. 31(*f*) is a sectional view of a toner image reproducing red at predetermined optical reflection image density, wherein a yellow toner layer shows sufficient toner deposit, while a magenta toner layer is lower in terms of toner deposit than an appropriate level. Therefore, color balance is destroyed and a color of orange is reproduced. FIG. 31(*g*) is a sectional view of a toner image reproducing black at optical reflection image density CD=1.0, wherein a yellow layer shows sufficient toner deposit, while a magenta layer and a cyan layer show toner deposit that is lower than an appropriate level. Therefore, color balance is destroyed and a color of light brown is reproduced incidentally, first counter CT1, second counter CT2 and third counter CT3 each of which counts a number of copies are built in first CPU50 wherein the first counter CT1 counts a number of copies in continuous copying using detected signals from a sheet ejection sensor, and the second counter CT2 counts a number of copies showing the timing for executing an exposure condition control program, namely a number of summed up copies made after execution of previous control of exposure conditions. To be concrete, an exposure condition control program is executed each time 1000 copies are made. The third counter CT3, on the other hand, counts, after executing an exposure condition control program, a copying number for resetting exposure value that shows the timing for judging whether or not the control has returned the image density to a desired level, namely the timing of judgment for resetting exposure condition (exposure value to control imagewise exposure level for obtaining desired developing potential gap, hereinafter referred to simply as an exposure value). Concretely, after execution of an exposure condition control program, image density is judged whether it has been restored to a desired level or not after 50 copies are made, and an exposure value is returned to its initial value based upon the judgment. Incidentally, all of the first counter CT1, the second counter CT2 and the third counter CT3 are of a type of counting-down, wherein a number of copies made in succession, a number of summed up copies and a copying number for resetting exposure value are respectively established to be counted down. When a value counted down shows "0", it indicates that established number of copies have been made.

Next, image recording operation of the present image recording apparatus will be explained as follows, referring to flowcharts in FIGS. 32 and 33. Incidentally, FIG. 32 represents a main flow to be executed by the first CPU50 in FIG. 22, while FIG. 33 represents a flow to control exposure conditions (namely, exposure values for controlling imagewise exposure level for obtaining desired developing bias gap) for execution by means of the second CPU60.

Figure 32:
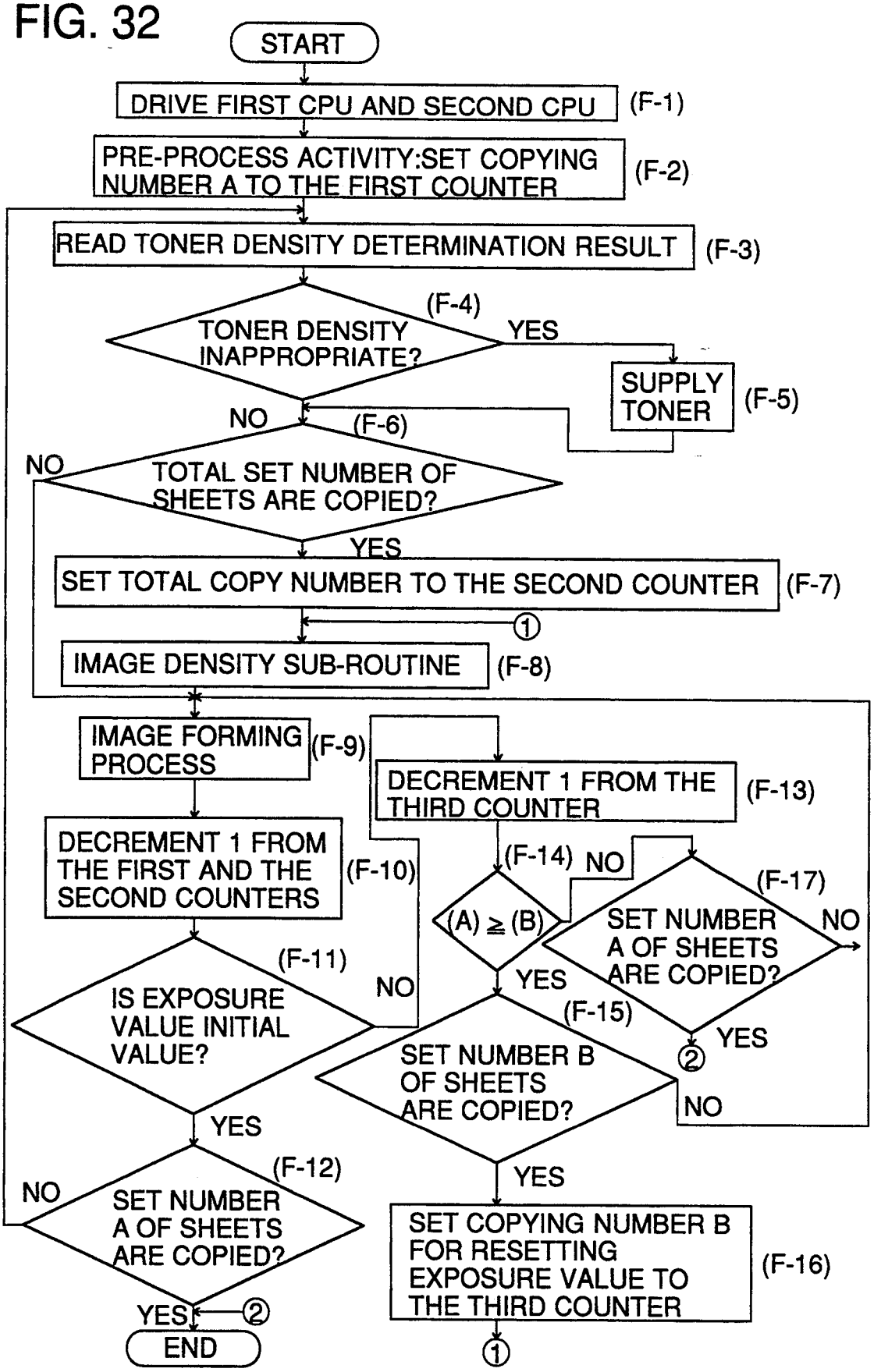
FIG. 32 is a flow chart showing an image recording operation in the image forming method of the fifth example of the present invention.
Figure 33:
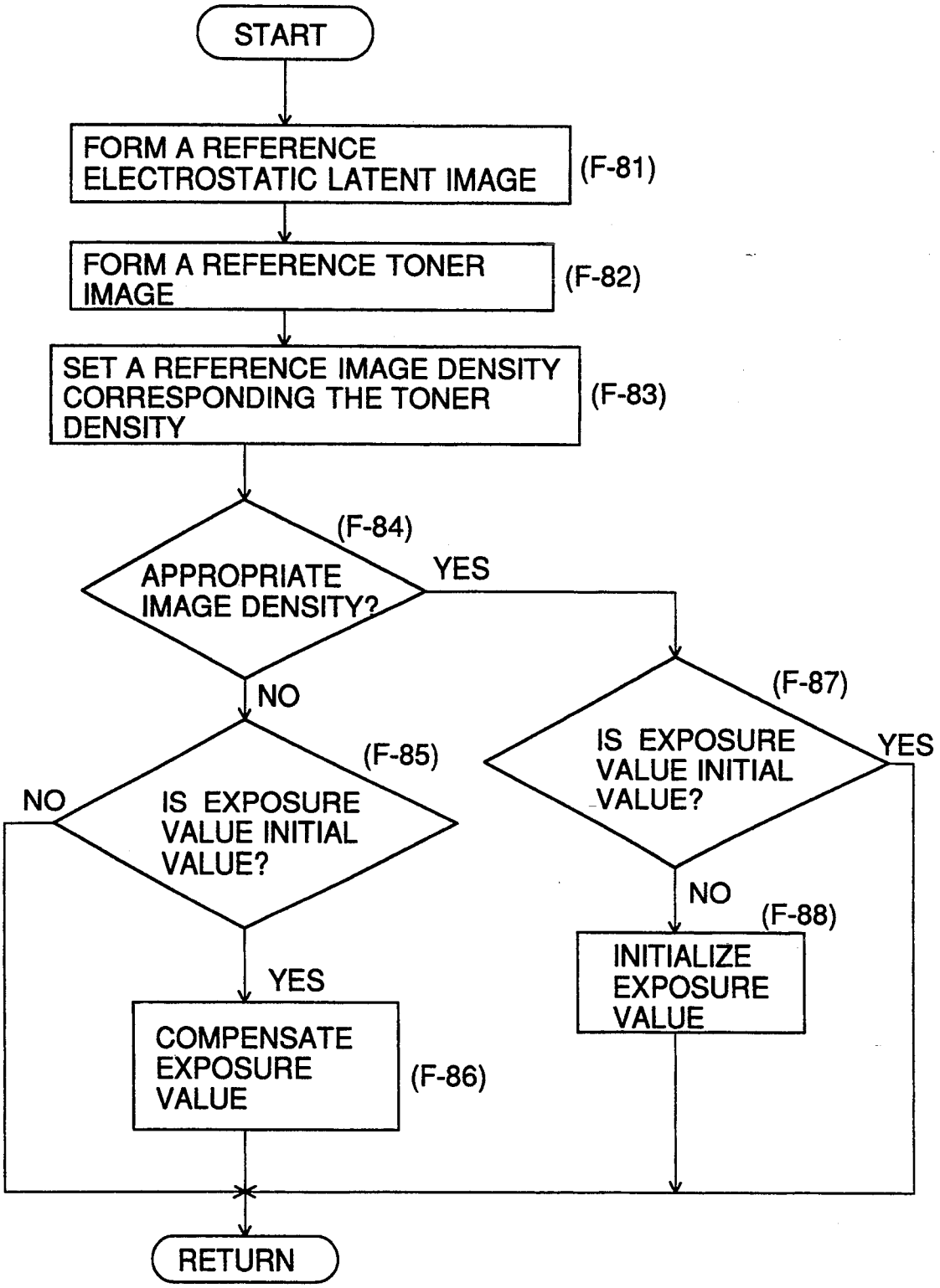
FIG. 33 is a flow chart showing an image density control operation in the image forming method of the fifth example of the present invention.

Pressing a main switch (not illustrated) causes power supply which starts the first CPU50 and the second CPU60 (step F-1 in FIG. 32).

The first CPU50 drives the first motor driver 10, so that the main motor is started. The first and second stirring rollers 20*e* and 20*f* of the developing units 20BK, 20C, 20M and 20Y are connected with this drive system so as to stir the 2-component developer. Temperature of the heater of a fixing unit (not shown) is raised to a predetermined value. Also, the first CPU50 conducts the preprocessing as follows: the photoreceptor drum 1 connected with the main motor drive system is driven; and the photoreceptor drum 1 is repeatedly charged and discharged by the charger 41 and discharger (not shown) so that the process conditions for image formation are adjusted. In the preprocessing, the number A of continuous copies, which has been set by an operator through operating a predetermined button, is set on the first counter CT1 (step F-2).

As described before, the second CPU judges in accordance with the toner concentration judging program whether or not the toner concentration detection signals sent from the toner concentration detection means 61BK, 61C, 61M and 61Y have become not more than a predetermined value of 7.5 wt %. In the case where it is not more than 7.5 wt %, a toner concentration NG signal is transmitted from the second CPU60 to the toner concentration judgment result register R1, and in the case where it is more than 7.5 wt %, a toner concentration OK signal is transmitted to the toner concentration judgment result register R1.

Then, the first CPU50 reads out a signal that has been set in toner concentration judgment result register R1 (step F-3), and it is judged whether the signal is a toner concentration NG signal or not (step F-4). When it is a toner concentration NG signal, toner for the color is supplied (step F-5), and the program advances to step (F-6). On the other hand, when it is a toner concentration OK signal for all colors, the program immediately advances to step (F-6), and when it is judged whether or not the counted value on the second counter CT2 is "0", it is judged whether or not the number of overall copies relating to the counted value setting has reached 1000. When the number of overall copies has not reached 1000, the program advances to step (F-9). When the number of overall copies has reached 1000, the first CPU50 sets the number "1000", which is the setting value of the number of overall copies, on the second counter CT2 (step F-7), and the image density control interruption is generated, so that an image density control command signal is outputted into the second CPU60 (step F-8).

In response to the image density control command signal sent from the first CPU50, the second CPU60 drives optical system driving circuit 53 to cause optical scanning unit 52 to form in succession exposure portions (reference electrostatic latent images) corresponding to optical reflection density CD=1.0 for each color on photoreceptor drum 1 (step F-81 in FIG. 33). Then, the developing units 20BK, 20C, 20M and 20Y are driven so that the reference electrostatic latent image can be visualized into a toner image. In this way, a reference toner image for each color is formed (step F-82). Next, the second CPU60 reads out reference image density CD corresponding to a toner concentration detection signal for each color sent from the toner concentration detection means 61BK, 61C<61M and 61Y, from the first lookup table T1, and the obtained reference image density CD is set in the reference image density register R2 (step F-83).

Actual optical image density is taken in from the optical image density measurement means 161 and compared with the reference image density for relevant color held in reference image density register R2 so as to judge whether it agrees with the reference image density or not, namely, whether there exists a color with lowered developability or not (step F-84). When there is a color with lowered developability, it is judged whether or not the exposure value for controlling imagewise exposure level an initial value (step F-85). When it is an initial value, that is, when the exposure value for controlling imagewise exposure level has not been changed, a changing amount of the exposure value for controlling imagewise exposure level corresponding to the actual optical image density is read out from the second lookup table T2 (step F-86). In accordance with the changing amount of exposure value for controlling imagewise exposure level read, the exposure value for controlling imagewise exposure level is changed (step F-87) and the program is returned. The exposure value for controlling imagewise exposure level is changed in the following manner: an irradiating amount by means of irradiating amount control circuit 154 is adjusted and thereby exposure portion potential $V_L$ is controlled. The detail will be explained later.

In the case where the exposure amount for controlling imagewise exposure level is not the initial value, the circumstances are as follows: although the exposure amount for controlling imagewise exposure level has been changed, the developability has not recovered properly. These circumstances will be explained later. In this case, the program is immediately returned. However, this returning is made after step (F-85) and seep (F-86) are conducted for all colors whose developability has been lowered.

When it has been judged in the step (F-84) that the developability is not lowered for all colors, it is judged whether the exposure value for controlling imagewise exposure level is the initial value or not (step F-88). In the case where the exposure value for controlling imagewise exposure level is not the initial value in terms of color, it means that the developability for the color has recovered properly when the exposure value for controlling imagewise exposure level has been changed. Therefore, the exposure value for controlling imagewise exposure level for the color is returned to the initial value (F-89), and the program is returned. On the other hand, in the case where the exposure value for controlling imagewise exposure level for all colors are the initial value, the developability for all colors is appropriate from the beginning and it is not necessary to change the exposure value for controlling imagewise exposure level, so that the program is returned as it is.

Then, the first CPU50 carries out the image forming process in accordance with the image forming program (step F-9 shown in FIG. 32). After that, the counted value of the number of continuous copies on the first counter CT1 is subtracted by 1, and also the counted value of the number of continuous copies on the second counter CT2 is subtracted by 1 (step F-10), and it is judged whether the exposure value for controlling imagewise exposure level is the initial value or not for all colors (step F-11). In the case where the exposure value for controlling imagewise exposure level is the initial value for all colors, it is judged whether or not the counted value of the number of continuous copies on the first counter CT1 is "0". As a result of the foregoing, it is judged whether or not the number of copies has reached the number A of continuous copies relating to setting (step F-12). In the case where the counted value on the first counter CT1 is "0" and the number of copies has reached the number A of continuous copies, the program is completed. On the other hand, in the case where the number of copies has not reached the number A, the program returns to step (F-3) so that the necessary number of copies can be made.

When an exposure value for controlling an imagewise exposure level is judged in terms of color not to be an initial value in Step (F-11), namely, when the exposure value for controlling an imagewise exposure level is compensated by Second CPU60 and is not reset to the initial value thereafter, decrement of 1 from copying number B for resetting exposure value on Third Counter CT3 is made (Step F-13). Then, countdown value (A) of copying number A on First Counter CT1 is judged whether it is not less than countdown value (B) of copying number B for resetting exposure value on the Third Counter CT3 or not (Step F-14). When the result of the judgment shows that the countdown value (A) of the copying number A is not less than the countdown value (B) of the copying number B for resetting exposure value on the Third Counter CT3, a judgment is formed whether or not the copies in quantity of the copying number B for resetting exposure value related to setting have been completed (Step F-15) through a judgment whether or not the countdown value (B) of the copying number B for resetting exposure value on the Third Counter CT3 is "0". When the result of the judgment shows that the number of copies made has not reached the copying number B for resetting exposure value, the sequence returns to Step (F-9) because it is apparent that the set copying number A has not been completed.

On the other hand, when the countdown value (B) on the Third Counter CT3 is "0" and the copying number B for resetting exposure value related to setting has been completed, the copying number B for resetting exposure value is set on the Third Counter CT3 (Step F-16). Then, the sequence returns to Step (F-8) for causing the compensated exposure value for controlling imagewise exposure level to return to its initial value.

In the step (F-14), when the countdown value (A) for copying number A is judged to be smaller than the countdown value (B) for copying number for resetting exposure value B, the copying number A related to setting is judged whether it has been completed or not (step F-17) through judgment whether the countdown value (A) for copying number A on the first counter CT1 is "0" or not . If the result of the judgment shows that the copying number A has not been completed, the sequence goes back to step (F-9) for completing the copying number A. On the other hand, when the countdown value (A) on the first counter CT1 is "0" and the copying number A related to setting has been completed, the sequence ends. In this case, the sequence ends with exposure value for controlling imagewise exposure level remaining unchanged to its initial value. In the succeeding continuous copying, however, the exposure value for controlling imagewise exposure level is reset to its initial value because processes of step (F-13) and thereafter are executed through step (F-11).

Resetting of exposure value for controlling imagewise exposure level to its initial value in step (F-88) in FIG. 33 has the following meaning. Namely, as explained above, the first CPU50 executes an image forming process after the exposure value for controlling imagewise exposure level is compensated by the second CPU60. When copying is continued for a while with the exposure value for controlling imagewise exposure level compensated to the lower level, developability sometimes becomes too high. Under such conditions, toner having higher toner potential in two-component developer is consumed, and fresh toner supply is started. After compensation of the exposure value for controlling imagewise exposure level, therefore, developability is confirmed to be optimum and then the exposure value for controlling imagewise exposure level related to the compensation is returned to the initial value by executing an image density control program at the point when the predetermined copying number (for example, 50 sheets) has been completed.

Figure 34:
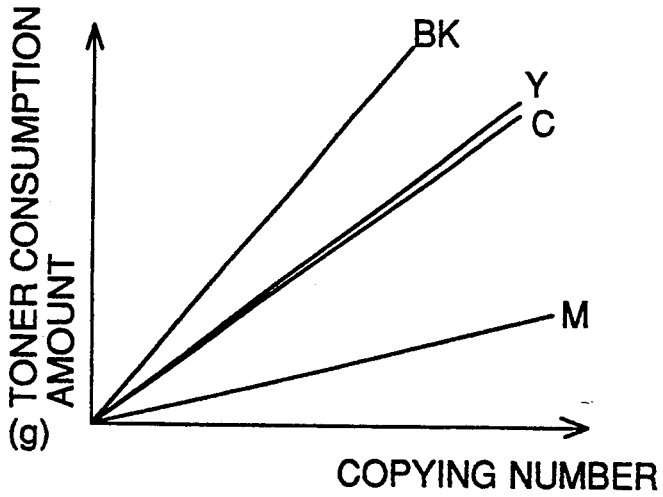
FIG. 34(*a*) is a graph showing a relation between the number of copies and the toner consumption of each color used for color image formation.
Figure 34:
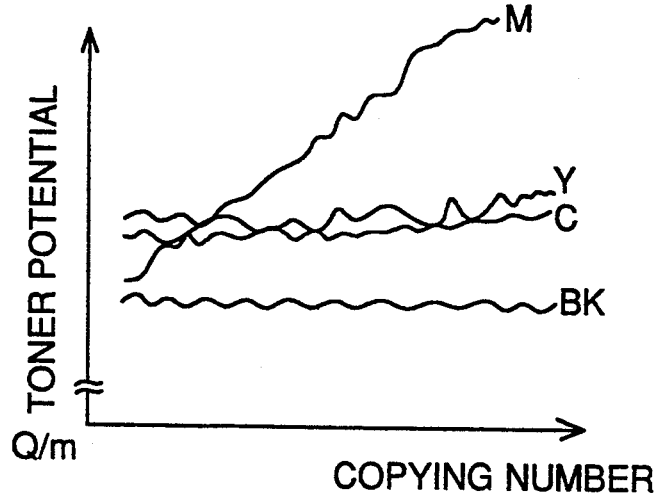
Figure 34:
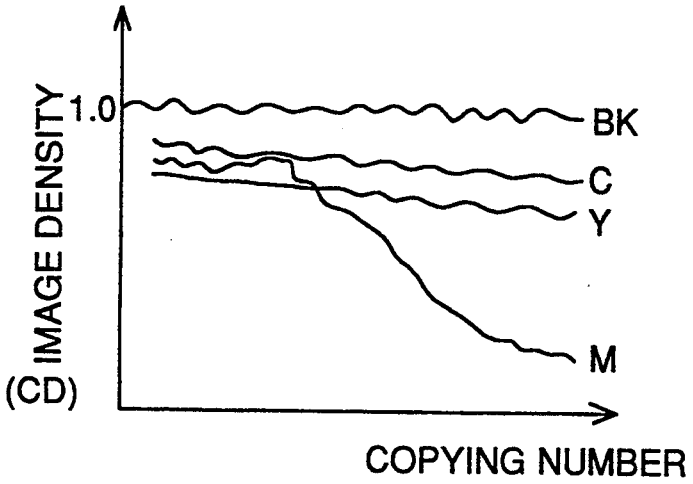

Next, controlling operation for exposure value (exposure condition) for controlling imagewise exposure level in FIG. 33 conducted by second CPU60 in the course of reversal development will be explained concretely as follows. In the case of this example, photoreceptor drum 1 is an OPC photoreceptor, developer to be used is two-component developer composed of insulating coating carrier having a particle size of 40 μm and toner having a particle size of 8.5 μm, and toner concentration is kept to be kept at 7.5 (wt %) ±0.5 (wt %). In this example, developing bias contains only DC components, and exposure portion potential $V_L$ is controlled by adjusting an output value (irradiating amount) of a semiconductor laser through an intensity modulation method by means of irradiating amount control circuit 154 with initial charging potential $V_H=-700$ (V) and developing bias $V_B=-500$ (V) which are fixed. Incidentally, in the present example, optical reflection density for black toner is not measured. The reason for this is that the optical reflection density for black is not lowered easily as shown in FIG. 34(*c*). However, it may also be allowed to measure optical reflection density for black to control exposure conditions, just like the occasions for cyan, magenta and yellow.

In the comparative calculation in step (F-84), when reference data held in register for each color are almost the same as measurement data obtained from optical reflection density measuring means 161, toner charge amounts Q/m in cyan, magenta and yellow developers contained respectively in developing units 20C, 20M and 20Y are optimum values of −24 (μC/g), −23 (mC/g) and −24 (μC/g) respectively, developing density CD is equal to 1.0 and exposure value $V_B$-$V_L$ for controlling imagewise exposure level is equal to −450 (V). These conditions mean that rooter charge amount for each color toner is in an optimum value or in the vicinity thereof. These electrostatic process conditions are the same for all colors when fresh developer is filled. When reference data mostly agree with measurement data as stated above, it is not necessary to adjust exposure value $V_B$-$V_L$ for controlling imagewise exposure level. Therefore, as stated above, electrostatic conditions corresponding to developing density CD=1.0 are represented by electrostatic initial charge potential $V_H=-700$ (V), exposure portion potential $V_L=-50$ (V), developing bias $V_B=-500$ (V), exposure value for controlling imagewise exposure level $V_B$-$V_L=-450$ (V) and output value of semiconductor laser LD=1.0 (mW) each representing an initial value.

In this case, it is possible to form toner images composed of toner particles on photoreceptor drum 1 efficiently and clearly. Therefore, sufficient image density has a broad range of contrast between 0 and 1.2, and appropriate adhering power between photoreceptor drum 1 and toner are assured for each color toner. Thus, no image offset takes place in the course of succeeding image forming process, and clear images are reproduced, resulting in color reproduction with appropriate image density and color balance that is not destroyed.

In the comparative calculation in step (F-84), however, when measured data for magenta from optical image measuring means 161 is extremely lower than reference data stored in a register, for example, toner charge amount is presumed to be a value that is greater than an appropriate value of −25 (μC/g), and it is, for example, about 30.5 μC/g or more. In such a case, developability is on a lower level, and it is not possible to obtain sufficient image density and contrast as shown in FIGS. 27(*a*)-27(*f*), without enhancing the developability by controlling an exposure value for imagewise exposure level control and thereby enlarging a developing potential gap.

With regard to a color showing lowered developability, therefore, second CPU60 enhances developability by controlling irradiating amount control means 154 to lower exposure portion potential $V_L$ and thereby enhancing developing power by enhancing exposure value for controlling imagewise exposure level $V_B$-$V_L$. To be concrete in the example mentioned above, a semiconductor laser output value LD for magenta is adjusted to 1.5 (mW) and exposure portion potential $V_L$ is lowered, though semiconductor laser output values LD for black, cyan and yellow are maintained at the aforementioned 1.0 (mW).

Thereby, as shown in FIG. 29(*a*), toner deposit for magenta arrives at an appropriate value and developability is enhanced, resulting in the corrected developing power. Therefore, it is possible to obtain sufficient image density and contrast reflecting images on a document, thus, color reproduction without destroying color balance can be realized as shown in FIGS. 29(*b*) and 29(*c*). Incidentally, as shown in FIG. 31, when developability for cyan and magenta is lowered, the same effect was obtained with output values 1.5 (mW) and 1.8 (mW) of semiconductor lasers respectively for cyan and magenta both corresponding to image density CD=1.0. When developability is lowered for all colors of cyan, magenta and yellow, the same effect was obtained with output values 1.3 (mW), 1.5 (mW) and 1.8 (mW) of semiconductor lasers respectively for cyan, magenta and yellow all corresponding to image density CD=1.0.

Incidentally, a color image forming apparatus in the fifth example employs a process wherein toners are superimposed to form a plurality of toner layers on photoreceptor drum 1. Therefore, toner potential caused by a lower toner layer formed previously on the photoreceptor drum 1 sometimes deteriorates developing power for the upper toner layer. It has been found that it is advantageous in the case mentioned above to control the exposure value to cause developing power for yellow toner for an upper layer to be slightly stronger than that for cyan toner for a lower layer.

As described above, even when the image density is deteriorated in spite of toner concentration maintained almost constant at a predetermined value in the fifth example, it is possible to adjust the developing power by detecting the deterioration of image density and by controlling the exposure condition to a desired level. Therefore, it is possible to obtain sufficient image density and contrast corresponding to images on a colored document, and reproduction of color balance is improved.

What is claimed is:

1. An image forming apparatus for forming a color toner image on a photoreceptor, comprising:

means for forming a latent image, corresponding to one of a plurality of different color compositions of a color image, on the photoreceptor;

means for developing said latent image with a developer in a color corresponding to said one of said plurality of different color compositions;

means for applying a developing bias between said photoreceptor and said developing means;

means for controlling a toner concentration of said developer, in said color corresponding to said one of said plurality of different color compositions, so that said toner concentration of said developer is equalized;

means for forming a reference color toner image in said color corresponding to said one of said plurality of different color compositions, on said photoreceptor;

means for detecting a toner deposition amount of said reference color toner image; and means for increasing said developing bias when said toner concentration of said developer, in said color corresponding to said one of said plurality of different color compositions, is equalized and said toner deposition amount of said reference color toner image is smaller than a predetermined value.

2. An image forming apparatus for forming a color toner image on a photoreceptor, comprising:

means for forming a plurality of latent images on the photoreceptor, wherein each one of said plurality of latent images correspond to a respective one of a plurality of different color compositions of a color image;

developing means including a plurality of developers for developing each one of said plurality of latent images with that one of said plurality of developers, which is in a color corresponding to one of said plurality of different color compositions, to form a color toner image layer on said photoreceptor;

wherein a plurality of color toner image layers formed by said plurality of developers are superimposed to form a superimposed color toner image on said photoreceptor;

means for providing a developing potential gap between said photoreceptor and said one of said developers, said developing potential gap having a developing bias potential thereacross to form said plurality of color toner image layers;

means for controlling a toner concentration of each of said plurality of developers, so that said toner concentration of said one of said plurality of developers is maintained to be a constant value;

means for forming reference color toner images, each of which corresponds to one of said plurality of developers;

means for detecting a toner deposition amount of each of said reference color toner images; and means for increasing said developing potential gap when said toner concentration of one of said developers is maintained to be said constant value, and said toner deposition amount of one of said reference color toner images, corresponds to a color of said one of said developers, and a deposition amount of said reference color toner image is smaller than a predetermined value; and wherein said developing potential gap, when one of said plurality of color toner image layers is formed to be higher in a height direction of said superimposed color toner image, is increased to be greater than another developing potential gap, that is provided when another one of said plurality of color toner image layers is formed in said height direction of said superimposed color toner image to be lower than said one of said plurality of color toner images.

3. An image forming apparatus for forming a color toner image on a photoreceptor, comprising:

forming means for forming a plurality of latent images on the photoreceptor, wherein each one of said plurality of latent images corresponds to a respective one of a plurality of different color compositions of a color image; and wherein said forming means forms said plurality of latent images pixel by pixel, and said forming means is capable of changing an exposure amount per pixel when said plurality of latent images are formed;

developing means including a plurality of developers for developing each one of said plurality of latent images with that one of the plurality of developers, which has a color corresponding to said one of said plurality of different color compositions, to form a color toner image layer on said photoreceptor;

wherein a plurality of color toner image layers formed by said plurality of developers are superimposed on each other to form a superimposed color toner image on said photoreceptor;

means for providing a developing potential gap between said photoreceptor and one of said developers, said developing potential gap having a developing bias potential thereacross to form said plurality of color toner image layers;

means for controlling a toner concentration of each of said plurality of developers, so that said toner concentration of said one of said plurality of developers is maintained to be a constant value;

means for forming reference color toner images, each reference color toner image corresponding to one of said plurality of developers;

means for detecting a toner deposition amount of each of said reference color toner images; and means for increasing an exposure amount per pixel of one of said plurality of latent images, when said toner concentration of said one of said developers is maintained to be said constant value, and said toner deposition amount of one of said reference color toner images, is a color corresponding to a color of said one of said developers, and said toner deposition amount of said one of said reference color toner images is smaller than a predetermined value.

4. The apparatus of claim 3, wherein:

when one of said plurality of color toner image layers is to be formed to be in a higher layer in a height direction of said superimposed color toner image, then said exposure amount per pixel is increased to be an exposure amount per pixel which is greater than another exposure amount per pixel, that would be provided to form another one of said plurality of color toner image layers that is in a lower layer in said height direction of said superimposed color toner image.

5. The apparatus of claim 3, wherein said forming means includes a light irradiation resource being capable of forming said plurality of latent images dot by dot in different sizes by compensating an irradiating amount of said light irradiation resource.

6. The apparatus of claim 5, wherein said forming means compensates said irradiating amount of said light irradiation resource by changing a pulse width of said light irradiation resource.

* * * * *